US005761314A

United States Patent [19]

Inanaga et al.

[11] Patent Number: 5,761,314

[45] Date of Patent: Jun. 2, 1998

[54] AUDIO REPRODUCING APPARATUS AND HEADPHONE

[75] Inventors: Kiyofumi Inanaga, Kanagawa; Yuji Yamada, Tokyo, both of Japan

[73] Assignee: Sony Corporation, Tokyo, Japan

[21] Appl. No.: 513,848

[22] PCT Filed: Jan. 27, 1995

[86] PCT No.: PCT/JP95/00096

§ 371 Date: Dec. 4, 1995

§ 102(e) Date: Dec. 4, 1995

[87] PCT Pub. No.: WO95/20866

PCT Pub. Date: Aug. 3, 1995

[30] Foreign Application Priority Data

| | | | |
|---|---|---|---|
| Jan. 27, 1994 | [JP] | Japan | 6-007900 |
| Jan. 27, 1994 | [JP] | Japan | 6-007902 |
| Feb. 14, 1994 | [JP] | Japan | 6-017600 |
| Mar. 18, 1994 | [JP] | Japan | 6-049287 |

[51] Int. Cl.[6] ..... H04S 5/00; H04R 5/02

[52] U.S. Cl. ..... 381/17; 381/25

[58] Field of Search ..... 381/183, 187, 381/71, 25, 74

[56] References Cited

U.S. PATENT DOCUMENTS

| | | | |
|---|---|---|---|
| 4,888,805 | 12/1989 | Karppala, Jr. | 381/25 |
| 5,181,248 | 1/1993 | Inanaga et al. | 381/25 |
| 5,276,740 | 1/1994 | Inanaga et al. | 381/187 |
| 5,333,206 | 7/1994 | Koss | 381/183 |
| 5,335,285 | 8/1994 | Gluz | 381/187 |
| 5,481,615 | 1/1996 | Eatwell et al. | 381/71 |
| 5,495,534 | 2/1996 | Inanaga et al. | 381/125 |

FOREIGN PATENT DOCUMENTS

| | | | |
|---|---|---|---|
| 566321 | 8/1957 | Italy | 381/183 |
| 53-23601 | 3/1978 | Japan | 381/183 |
| 56-48796 | 5/1981 | Japan | 381/183 |
| 3-128598 | 5/1991 | Japan | 381/183 |

*Primary Examiner*—Forester W. Isen
*Attorney, Agent, or Firm*—Jay H. Maioli

[57] ABSTRACT

An object of the present invention is to provide an audio reproducing apparatus which makes a radiation impedance from an inlet of an external auditory canal of a listener to an outside approximate to that obtained when the listener does not put the apparatus, facilitates localization of a reproduced sound image, and allows the listener to feel more comfortable when putting the apparatus on the head. Headphone units (120) of a headphone are disposed so as to be opposed to both the left and right ears (23*a*), (23*b*) of a listener (23). Planes of the headphone units (120) opposed to both the left and right ears (23*a*), (23*b*) of the listener (23) are provided with being inclined at a predetermined angle forward or backward so as not to be perpendicular to a straight line passing the centers of both the left and right ears (23*a*), (23*b*) of the listener (23).

41 Claims, 38 Drawing Sheets

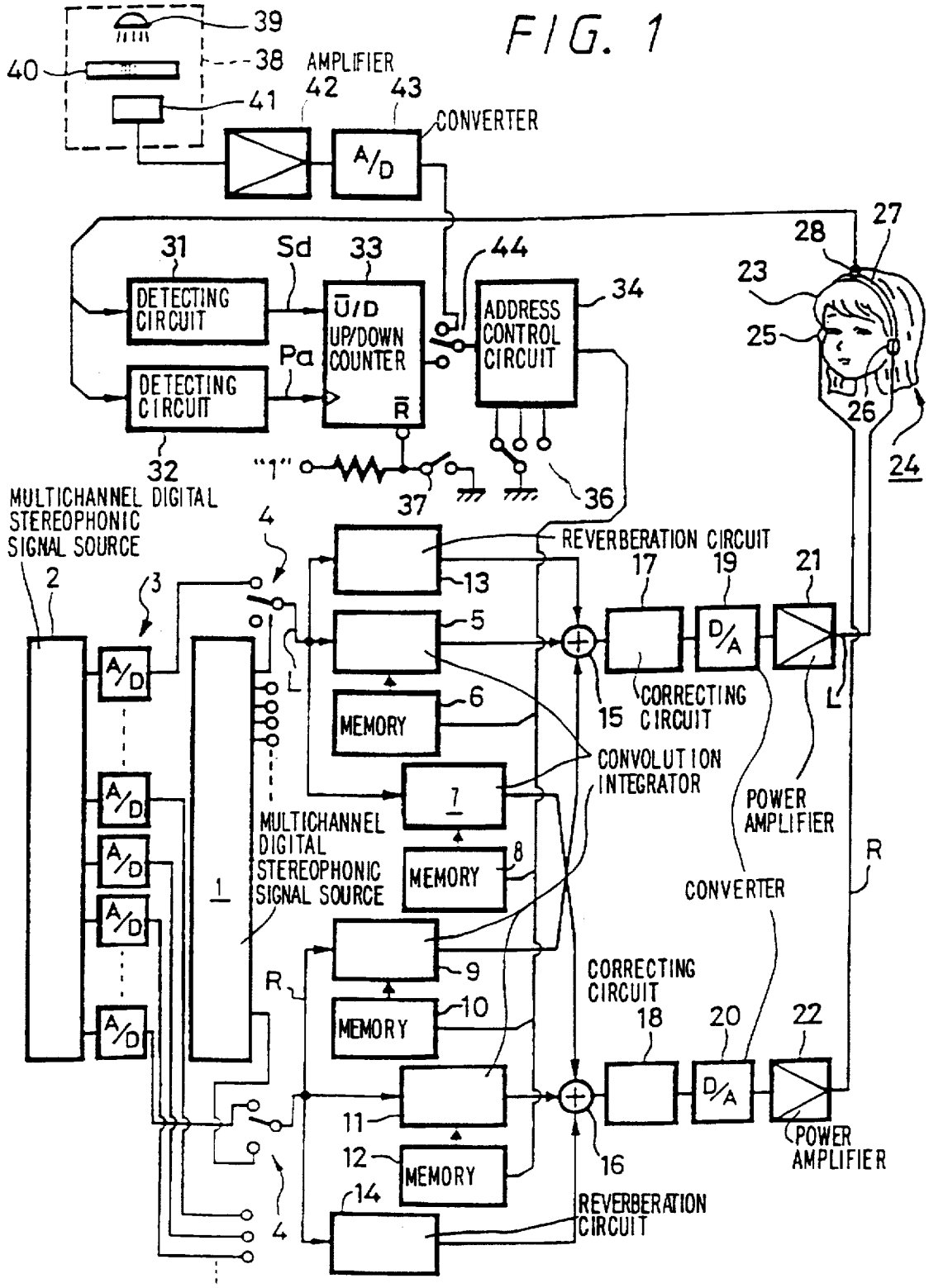
FIG. 1
39
38
40
41
AMPLIFIER
42
43
CONVERTER
A/D
31
Sd
33
44
DETECTING CIRCUIT
Ū/D
UP/DOWN COUNTER
R̄
ADDRESS CONTROL CIRCUIT
34
Pa
DETECTING CIRCUIT
32
"1"
37
36
28
27
23
25
26
24
MULTICHANNEL DIGITAL STEREOPHONIC SIGNAL SOURCE
2
3
4
REVERBERATION CIRCUIT
13
17
19
21
5
D/A
L
MEMORY
6
15
CORRECTING CIRCUIT
CONVOLUTION INTEGRATOR
7
POWER AMPLIFIER
MULTICHANNEL DIGITAL STEREOPHONIC SIGNAL SOURCE
1
MEMORY
8
CONVERTER
R
9
CORRECTING CIRCUIT
MEMORY
10
18
20
22
11
12
MEMORY
16
POWER AMPLIFIER
14
REVERBERATION CIRCUIT

FIG. 4

| $\theta$ | Table Address | Impulse Response $h_{m,n}(t,\theta)$ | | | |
|---|---|---|---|---|---|
| | | $h_{LL}(t,\theta)$ | $h_{LR}(t,\theta)$ | $h_{RL}(t,\theta)$ | $h_{RR}(t,\theta)$ |
| 0° | 0 | $h_{LL}(t,0)$ | $h_{LR}(t,0)$ | $h_{RL}(t,0)$ | $h_{RR}(t,0)$ |
| 2° | 1 | $h_{LL}(t,1)$ | $h_{LR}(t,1)$ | $h_{RL}(t,1)$ | $h_{RR}(t,1)$ |
| 4° | 2 | $h_{LL}(t,2)$ | $h_{LR}(t,2)$ | $h_{RL}(t,2)$ | $h_{RR}(t,2)$ |
| 6° | 3 | $h_{LL}(t,3)$ | $h_{LR}(t,3)$ | $h_{RL}(t,3)$ | $h_{RR}(t,3)$ |
| ⋮ | 4 ⋮ | ⋮ | ⋮ | ⋮ | ⋮ |
| 358° | 179 | $h_{LL}(t,358)$ | $h_{LR}(t,358)$ | $h_{RL}(t,358)$ | $h_{RR}(t,358)$ |

FIG. 6

| θ | Table Address | Control Data $\Delta T_{IJ}(\theta)$, $\Delta L_{IJ}(\theta)$ | | | |
|---|---|---|---|---|---|
| | | $\Delta T_{LL}(\theta), \Delta L_{LL}(\theta)$ | $\Delta T_{LR}(\theta), \Delta L_{LR}(\theta)$ | $\Delta T_{RL}(\theta), \Delta L_{RL}(\theta)$ | $\Delta T_{RR}(\theta), \Delta L_{RR}(\theta)$ |
| 0° | 0 | $\Delta T_{LL}(0), \Delta L_{LL}(0)$ | $\Delta T_{LR}(0), \Delta L_{LR}(0)$ | $\Delta T_{RL}(0), \Delta L_{RL}(0)$ | $\Delta T_{RR}(0), \Delta L_{RR}(0)$ |
| 2° | 1 | $\Delta T_{LL}(1), \Delta L_{LL}(1)$ | $\Delta T_{LR}(1), \Delta L_{LR}(1)$ | $\Delta T_{RL}(1), \Delta L_{RL}(1)$ | $\Delta T_{RR}(1), \Delta L_{RR}(1)$ |
| 4° | 2 | $\Delta T_{LL}(2), \Delta L_{LL}(2)$ | $\Delta T_{LR}(2), \Delta L_{LR}(2)$ | $\Delta T_{RL}(2), \Delta L_{RL}(2)$ | $\Delta T_{RR}(2), \Delta L_{RR}(2)$ |
| 6° | 3 | $\Delta T_{LL}(3), \Delta L_{LL}(3)$ | $\Delta T_{LR}(3), \Delta L_{LR}(3)$ | $\Delta T_{RL}(3), \Delta L_{RL}(3)$ | $\Delta T_{RR}(3), \Delta L_{RR}(3)$ |
| ⋮ | 4 ⋮ | ⋮ | ⋮ | ⋮ | ⋮ |
| 358° | 179 | $\Delta T_{LL}(179), \Delta L_{LL}(179)$ | $\Delta T_{LR}(179), \Delta L_{LR}(179)$ | $\Delta T_{RL}(179), \Delta L_{RL}(179)$ | $\Delta T_{RR}(179), \Delta L_{RR}(179)$ |

$\Delta T_{IJ}(\theta)$ : Difference In Time Between Sounds Obtained at Both Ears $\Delta L_{IJ}(\theta)$ : Difference in Level Between Sounds Obtained at Both Ears

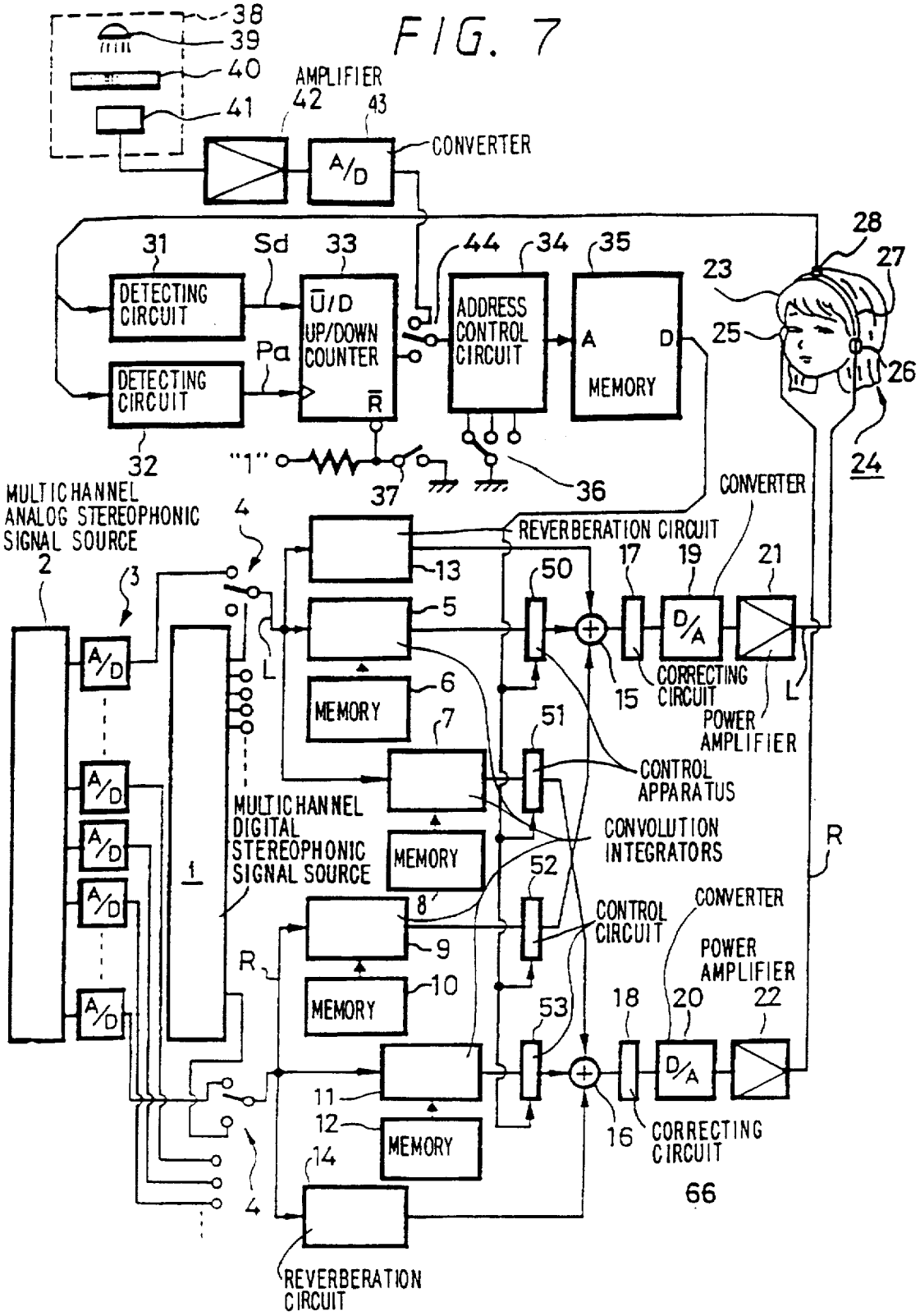
FIG. 7
38
39
40
41
AMPLIFIER
42
43
CONVERTER
A/D
31
Sd
33
44
34
35
28
27
23
25
26
24
DETECTING CIRCUIT
Ū/D
UP/DOWN COUNTER
R̄
ADDRESS CONTROL CIRCUIT
A
D
MEMORY
Pa
DETECTING CIRCUIT
32
"1"
37
36
MULTICHANNEL ANALOG STEREOPHONIC SIGNAL SOURCE
2
3
4
REVERBERATION CIRCUIT
13
5
50
17
19
21
CONVERTER
D/A
CORRECTING CIRCUIT
15
POWER AMPLIFIER
L
MEMORY
6
7
51
CONTROL APPARATUS
MULTICHANNEL DIGITAL STEREOPHONIC SIGNAL SOURCE
1
CONVOLUTION INTEGRATORS
R
52
8
CONTROL CIRCUIT
CONVERTER
9
POWER AMPLIFIER
10
53
18
20
22
11
12
16
CORRECTING CIRCUIT
14
66
REVERBERATION CIRCUIT

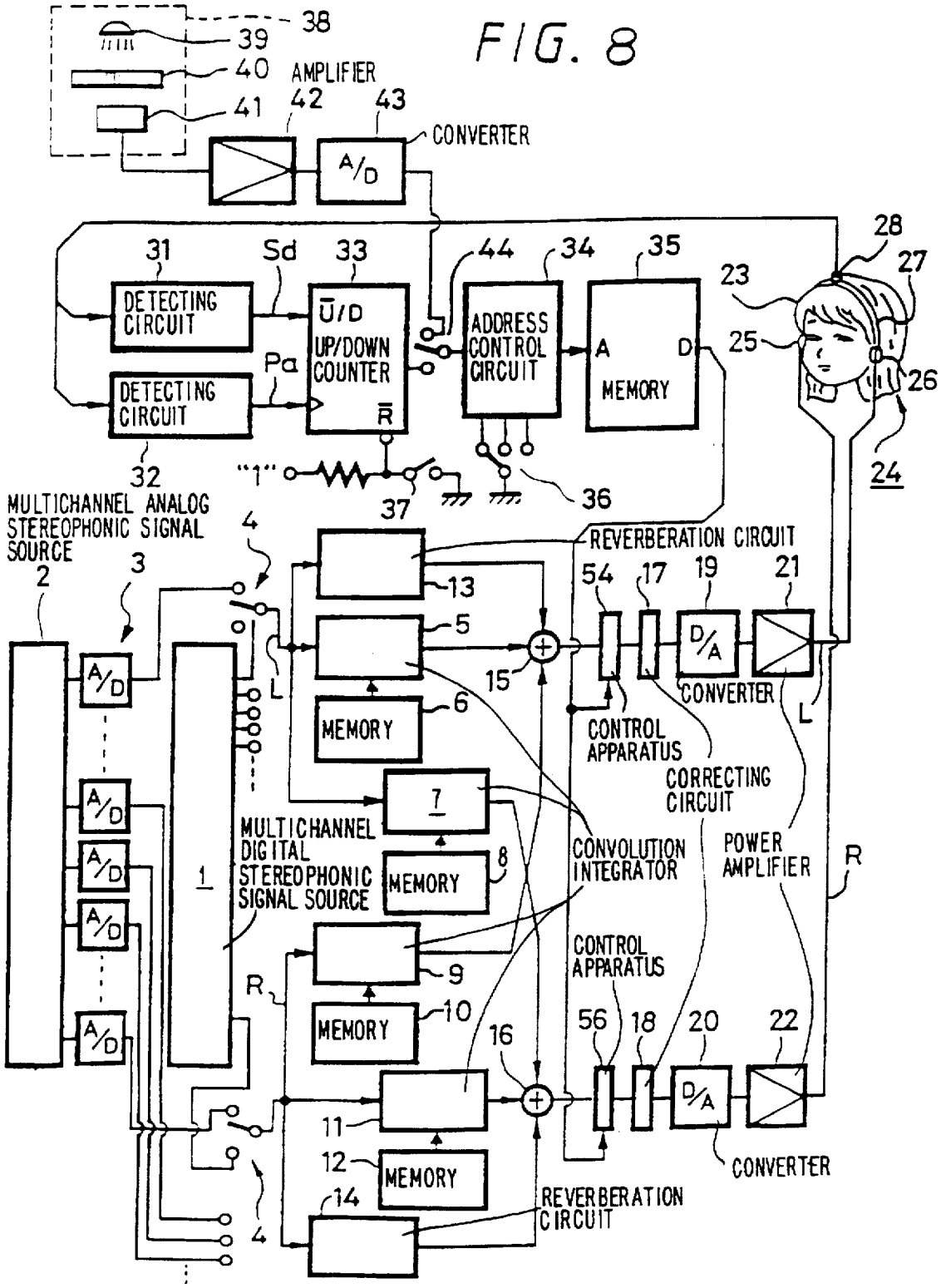
FIG. 8
38
39
40
41
AMPLIFIER
42
43
CONVERTER
A/D
31
Sd
33
44
34
35
28
27
23
25
26
24
DETECTING CIRCUIT
Ū/D
UP/DOWN COUNTER
R̄
ADDRESS CONTROL CIRCUIT
A
D
MEMORY
Pa
DETECTING CIRCUIT
32
"1"
37
36
MULTICHANNEL ANALOG STEREOPHONIC SIGNAL SOURCE
2
3
4
REVERBERATION CIRCUIT
13
54
17
19
21
5
15
D/A
CONVERTER
L
MEMORY
6
CONTROL APPARATUS
CORRECTING CIRCUIT
7
MULTICHANNEL DIGITAL STEREOPHONIC SIGNAL SOURCE
1
MEMORY
8
CONVOLUTION INTEGRATOR
POWER AMPLIFIER
R
9
CONTROL APPARATUS
R
MEMORY
10
56
18
20
22
16
11
12
MEMORY
14
REVERBERATION CIRCUIT
CONVERTER

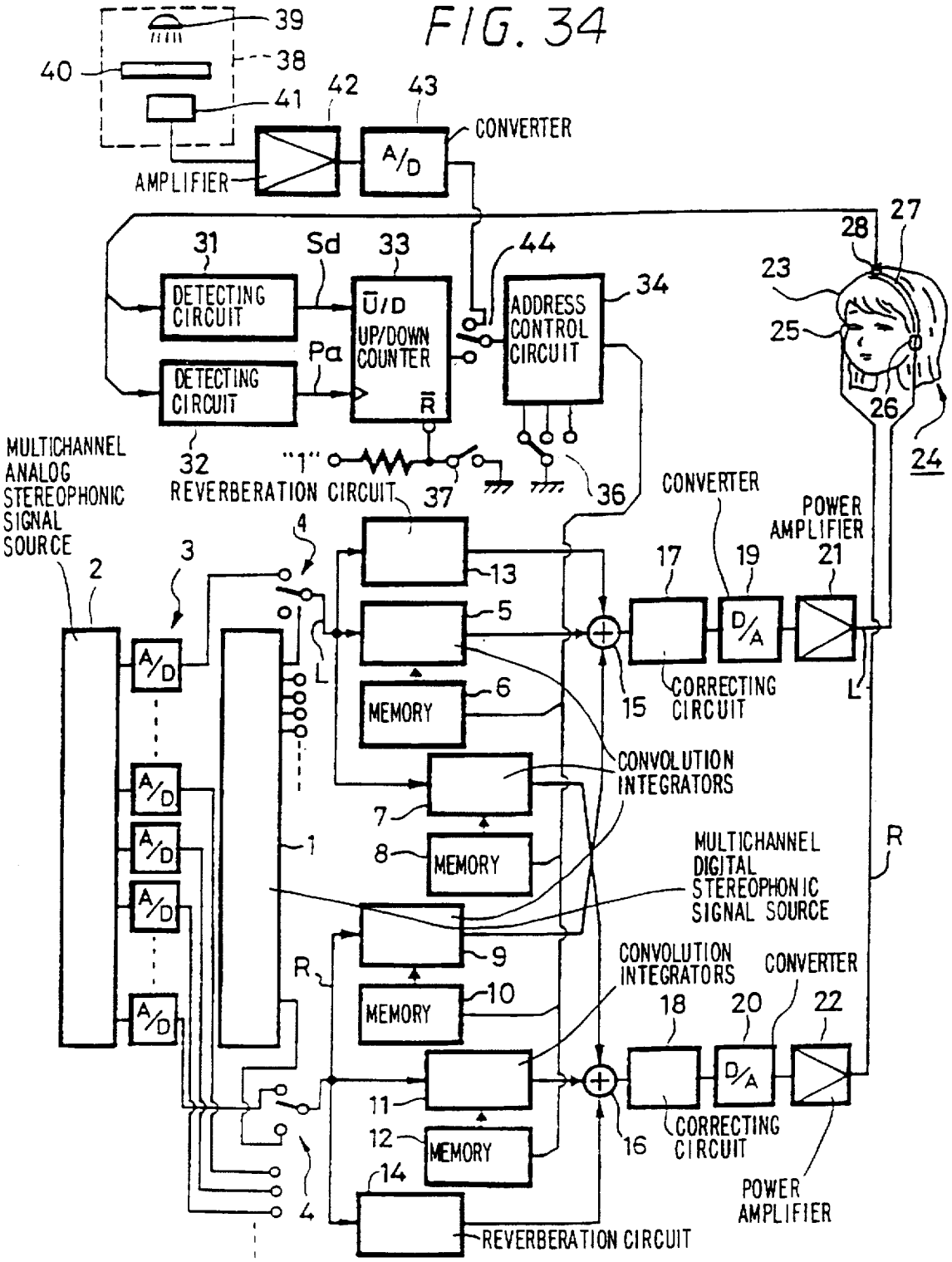
FIG. 34
39
38
40
41
42
43
CONVERTER
AMPLIFIER
A/D
27
28
23
25
26
24
31
Sd
33
44
34
DETECTING CIRCUIT
Ū/D
UP/DOWN COUNTER
R̄
ADDRESS CONTROL CIRCUIT
Pa
DETECTING CIRCUIT
32
"1"
REVERBERATION CIRCUIT
37
36
MULTICHANNEL ANALOG STEREOPHONIC SIGNAL SOURCE
2
3
4
CONVERTER
POWER AMPLIFIER
17
19
21
13
5
D/A
A/D
L
6
MEMORY
15
CORRECTING CIRCUIT
L'
CONVOLUTION INTEGRATORS
7
8
MEMORY
1
MULTICHANNEL DIGITAL STEREOPHONIC SIGNAL SOURCE
R
9
R
CONVOLUTION INTEGRATORS
CONVERTER
10
MEMORY
18
20
22
11
12
MEMORY
16
CORRECTING CIRCUIT
14
POWER AMPLIFIER
REVERBERATION CIRCUIT

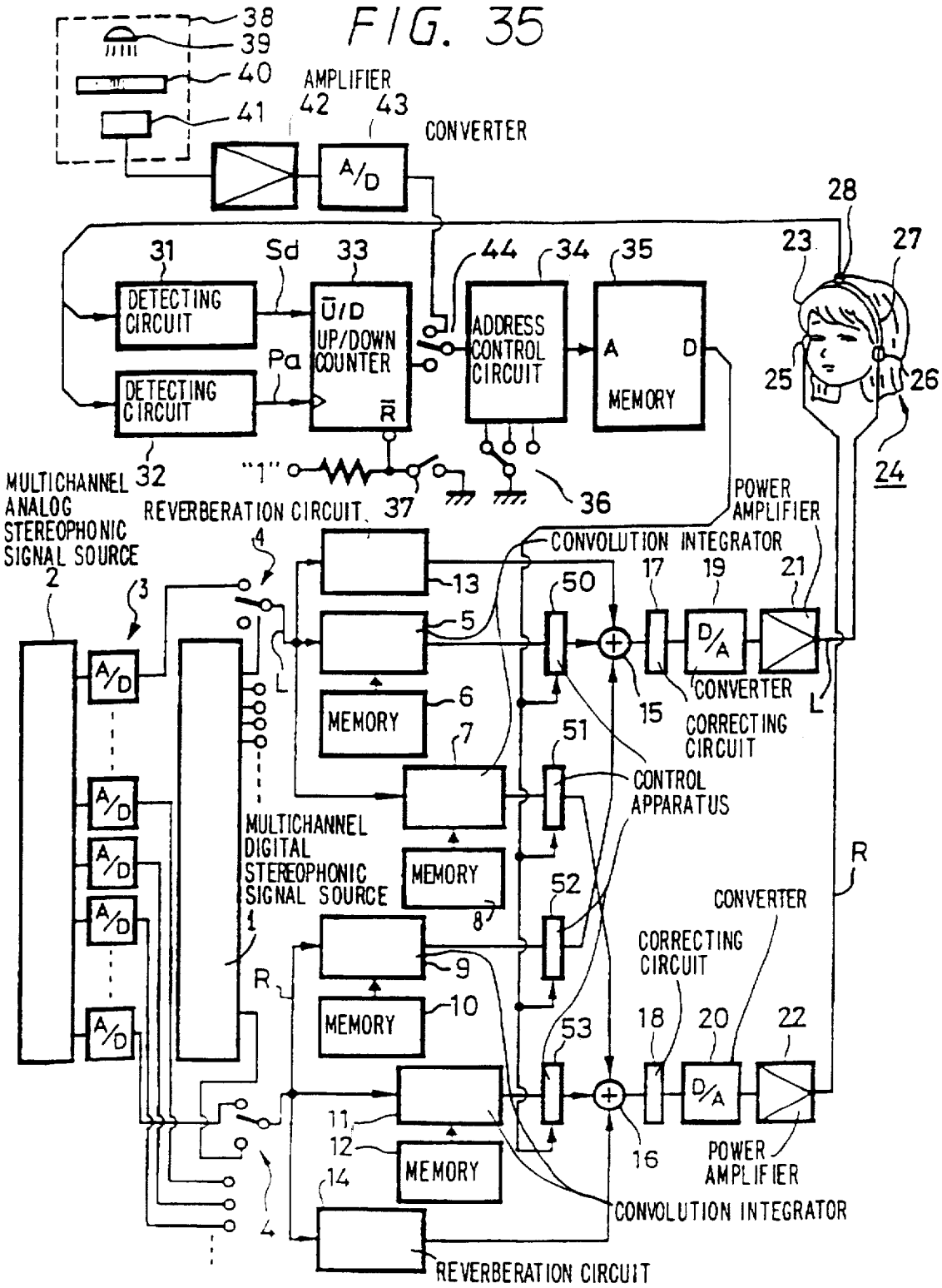
FIG. 35
38
39
40
41
AMPLIFIER
42
43
CONVERTER
A/D
28
23
27
31
Sd
33
44
34
35
DETECTING CIRCUIT
Ū/D
UP/DOWN COUNTER
R̄
ADDRESS CONTROL CIRCUIT
A
D
MEMORY
Pa
DETECTING CIRCUIT
25
26
24
32
"1"
37
36
MULTICHANNEL ANALOG STEREOPHONIC SIGNAL SOURCE
REVERBERATION CIRCUIT
POWER AMPLIFIER
CONVOLUTION INTEGRATOR
2
3
4
13
50
17
19
21
5
D/A
CONVERTER
L
6
MEMORY
15
CORRECTING CIRCUIT
7
51
CONTROL APPARATUS
MULTICHANNEL DIGITAL STEREOPHONIC SIGNAL SOURCE
MEMORY
52
R
8
CONVERTER
1
CORRECTING CIRCUIT
9
R
MEMORY
10
53
18
20
22
11
12
MEMORY
16
POWER AMPLIFIER
14
CONVOLUTION INTEGRATOR
REVERBERATION CIRCUIT

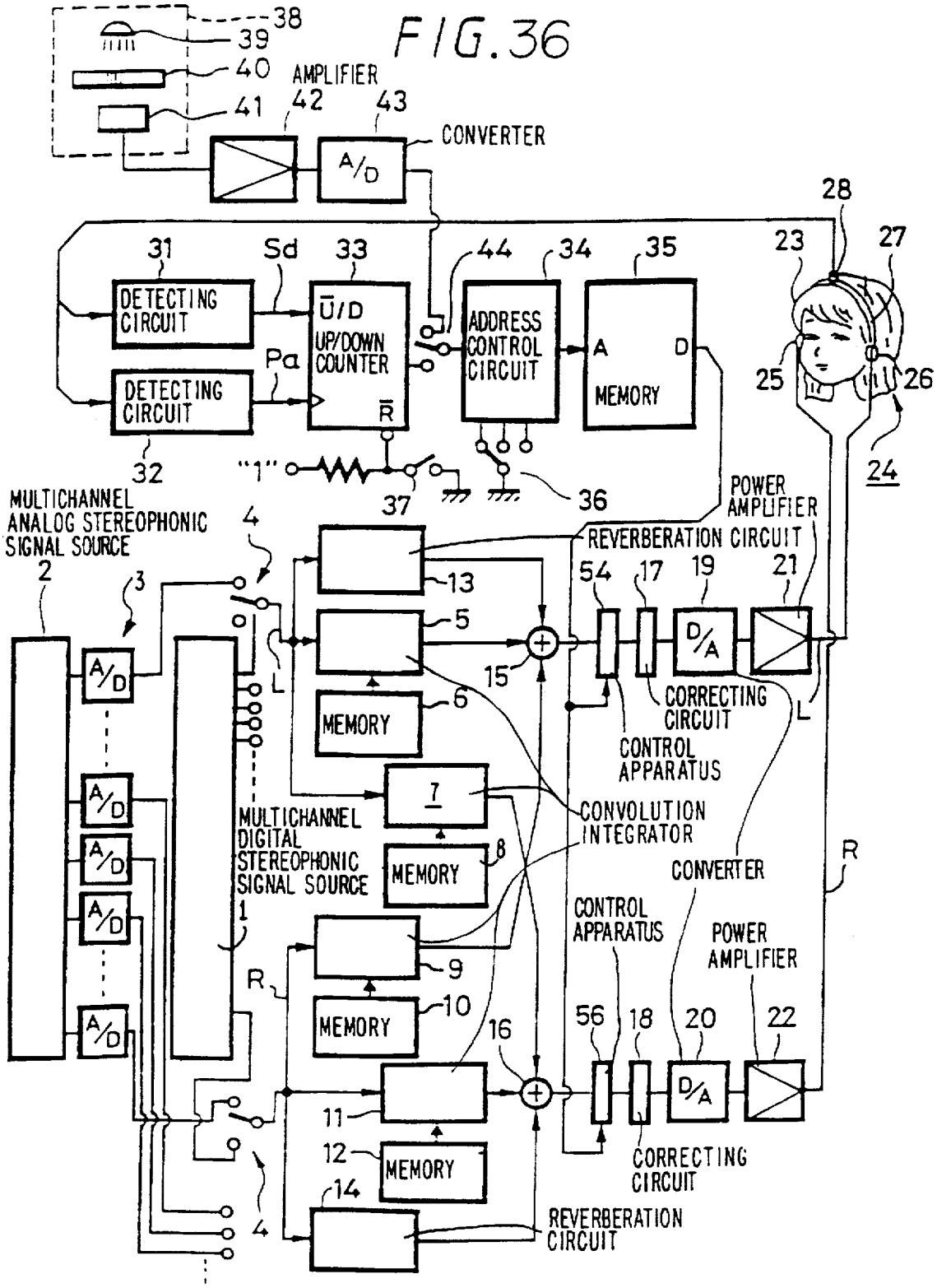
FIG. 36
38
39
40
41
AMPLIFIER
42
43
CONVERTER
A/D
28
23
27
31
Sd
33
44
34
35
DETECTING CIRCUIT
Ū/D
UP/DOWN COUNTER
R̄
ADDRESS CONTROL CIRCUIT
A
D
MEMORY
Pa
DETECTING CIRCUIT
25
26
24
32
"1"
37
36
MULTICHANNEL ANALOG STEREOPHONIC SIGNAL SOURCE
2
3
4
POWER AMPLIFIER
REVERBERATION CIRCUIT
13
54
17
19
21
5
15
D/A
CORRECTING CIRCUIT
L
MEMORY
6
CONTROL APPARATUS
7
CONVOLUTION INTEGRATOR
MULTICHANNEL DIGITAL STEREOPHONIC SIGNAL SOURCE
MEMORY
8
CONVERTER
R
1
CONTROL APPARATUS
POWER AMPLIFIER
9
R
MEMORY
10
56
18
20
22
16
11
D/A
12
MEMORY
CORRECTING CIRCUIT
14
REVERBERATION CIRCUIT 97. Supporting Bar
98. Supporting Member

AUDIO REPRODUCING APPARATUS AND HEADPHONE

AUDIO REPRODUCING APPARATUS AND HEADPHONE TECHNICAL FIELD

The present invention relates to an audio reproducing apparatus and a headphone suitable for use in reproduction of an audio signal through a headphone, for example.

BACKGROUND ART

There has conventionally been a method of reproducing an audio signal using a headphone which a listener puts on the head with both ears covered therewith to listen to the audio signal from both ears. When the method of reproducing the audio signal through the headphone is employed, there occurs a phenomenon referred to as a so-called lateralization in which a reproduced sound image is perceived to be inside the head of the listener even if the audio signal from a signal source is a stereophonic signal.

On the other hand, the system of reproducing the audio signal through the headphone includes a binaural sound-wave pickup and reproduction system. The binaural sound-wave pickup and reproduction system is the following system. Microphones, so-called dummy-head microphones, are located in left and right auricles of a dummy head which is made to imitate the listener's head. An audio signal from a signal source is picked up by the dummy-head microphones. When the audio signal thus picked up is reproduced and the listener actually listens to the reproduced audio signal with the headphone, the listener can obtain presence with which the listener feels as if he listened to the sounds directly from the signal source. According to the binaural sound-wave pickup and reproduction system, it is possible to improve the picked-up and reproduced sound image in directivity, localization, presence and so on. However, when the above-mentioned binaural reproduction is carried out, it is necessary to provide a signal source as a special source which is picked up by the dummy-head microphones as a sound source signal and different from that use for reproduction with speakers.

It has been supposed to achieve, by applying the above-mentioned binaural sound-wave pickup and reproduction system, a reproduction effect in which a general stereophonic signal is reproduced through the headphone and a reproduced sound image is localized outside the head (at a speaker position) similarly to the reproduction by the speakers. With this arrangement, when the headphones are used for reproduction, the same effect as the reproduction with the speakers is achieved and an effect in which the reproduced sound is prevented from being leaked to the outside is further achieved due to the headphones. However, when stereophonic reproduction is carried out by using the speakers, even if the listener changes the direction of his head (face), absolute direction and position of a sound image are not changed and only the relative direction and position of the sound image the listener perceives are changed. On the other hand, in the case of the binaural reproduction using the headphone, even if the listener changes his head (face), the relative direction and position of the sound image which the listener perceives are not changed. Therefore, even if the binaural reproduction is carried out by using the headphone, then when the listener changes the direction of the head (face), the sound image is formed inside the listener's head. It is particularly difficult to effect a so-called forward localization, i.e., to localize the sound image in front of the listener. Moreover, in this case, the sound image tends to be elevated above the head and hence becomes unnatural.

According to a reproduction method using headphones disclosed in Japanese patent publication No. 42-227, on the contrary the following binaural reproduction system using headphones is supposed. Specifically, directivity and localization of a sound image are determined by difference in volume, time, phase and so on between sounds perceived by the left and right ears of the listener. The system disclosed in the above publication has a level control circuit and a variable delay circuit in an audio signal line of each of the left and right channels and also has a means for detecting the direction of the listener's head. The level control circuit and the variable delay circuit for the audio signal in each of the channels are controlled based on a signal representing the detected direction of the listener's head.

In the above-mentioned reproduction method using the headphone disclosed in Japanese patent publication No. 42-227, however, a motor is driven by directly using the detection signal representing the direction of the listener's head and a variable resistor and a variable capacitor in the level control circuit and the variable delay circuit are mechanically controlled based on an analog signal by using the motor. Therefore, after the listener has turned the head, a time delay is caused before the differences in volume and time between the audio signals of the respective channels supplied to the headphone are changed. It is impossible for the disclosed reproduction system to sufficiently respond to the movement of the listener's head.

According to the reproduction method using headphones disclosed in Japanese patent publication No. 42-227, the characteristics obtained when the differences in volume and time are changed must be determined based on the relative positional relationship between a sound source and the listener, a shape of the listener's head, shapes of listener's auricles and so on. Specifically, if a certain characteristic is determined, then the relative positional relationship between the sound source and the listener is fixed so that it is impossible to change a sense of distance and a distance between the sound sources. Further, since listeners have different shapes of heads and auricles, an effect of the method differs depending upon the listeners. Moreover, in the above publication, there is not disclosed a means for correcting characteristics inherent in sound sources used when transfer functions from a virtual sound source to the listener's ears is measured and characteristics inherent in the headphone used by the listener. Especially, since the characteristics are changed largely depending on the headphone used, the reproduction state is changed.

According to a stereophonic reproduction system disclosed in Japanese patent publication No. 54-19242, a relationship between the listener's head direction detected by a gyroscope and change amounts of differences in volume and time between audio signals in both channels which are supplied to the headphone is continuously calculated.

However, the stereophonic reproduction system in the above Japanese patent publication No. 54-19242 requires a memory of a huge capacity for continuously calculating and storing the relationship of the change amounts of the differences in volume and time between the audio signals so that it is very difficult to realize the stereophonic reproduction system. Moreover, in the above publication, there is not disclosed the means for correcting the characteristics inherent in sound sources used when transfer functions from the virtual sound source to the listener's ears is measured and the characteristics inherent in the headphone used by the listener.

According to an audio reproduction apparatus disclosed in Japanese laid-open patent publication No. 01-112900 filed by the same applicant as the applicant of the present invention, there is provided an apparatus for discretely, not continuously, calculating data of the relationship between the change amounts of the differences in volume and time between audio signals and processing of the audio signals.

However, the Japanese laid-open patent publication No. 01-112900 in which the audio reproduction apparatus is disclosed presents only an abstract concept of a principle that can be applied to both analog and digital signal processings and lacks a specific description required when the audio reproduction apparatus effects the analog or digital signal processing and is applied to actual products. Moreover, in the above publication, there is not disclosed the means for correcting the characteristics inherent in sound sources used when transfer functions from a virtual sound source to the listener's ears is measured and the characteristics inherent in the headphone used by the listener.

According to an audio-signal reproduction apparatus disclosed in Japanese laid-open patent publication No. 03-214897 filed by the same applicant as the applicant of the present invention, transfer functions from respective virtual sound source positions to the listener's ears are fixed and subjected to signal processing and then levels and delay times of signals supplied to the ears are controlled in response to an angle of a head gyration. Therefore, it is possible to simplify an arrangement and save a large memory capacity.

Each of the above-mentioned conventional reproduction method using headphones, the stereophonic reproduction system, the audio reproduction apparatus and the audio-signal reproduction apparatus requires a memory having a large memory capacity for signal processing and hence cannot be embodied without digital signal processing. However, in each of them, specific signal processing and specific means and method for putting it into a practical use are not disclosed. Therefore, there is then the disadvantage that it is difficult to put each of the systems and apparatus into a practical use.

In order to produce the same state as a state where a listener actually listens to a sound with the ears, it is necessary that the correct characteristics of a headphone to be used. However, when a conventional headphone is used, its sound generating units directly press ears of the listener so as to cover the whole or a part of the ears, so that a state of an acoustic space from an external auditory canal to an outside is largely different from a state of that obtained when the listener actually listens to the sound. Therefore, there is then the disadvantage that it is difficult to calculate the characteristics used to correct the difference and an audio signal to be reproduced is reproduced with characteristics different from the characteristics obtained when the audio signal is picked up by a microphone.

Since the sound generating units directly press the ears of the listener so as to cover the whole or a part of the ears when the conventional headphone is used, there are clearances between the headphone and the ears. The clearances are changed every time when the listener wears the headphone, so that reproduction characteristics of the audio signal are not stable. Therefore, there is then the disadvantage that it is difficult to calculate the characteristics for correction.

Since the sound generating unit directly presses the ears of the listener so as to cover the whole or a part of the ears when the conventional headphone is used, the ears are always covered with the headphone and the ears get stuffy because the listener puts the headphone closely, which frequently makes the listener feel uncomfortable. Therefore, there is then the disadvantage that the conventional headphone is not always suitable for listening to the audio signal comfortably.

Since the sound generating unit directly presses the ears of the listener so as to cover the whole or a part of the ears when the conventional headphone is used, it is difficult to hear any external sound indicating danger and harm might occur if the listener does not hear it. Therefore, there is then the disadvantage that the conventional headphone lacks safety.

Although shapes of ears are different depending on individual listeners, the conventional headphones have the same shapes. There is then the disadvantage that the conventional headphone is not provided with a means for correcting difference among shapes of ears of the listeners.

It is frequently observed that whenever the listener wears the conventional headphone, positional relationship between the headphone and the ears are different. However, there is then the disadvantage that the conventional headphone is not provided with a means for correcting the positional displacement.

When the conventional headphone is used, a reproduced sound is reflected by an ear portion so that a noise resulting from a reflected wave is produced in the reproduced sound and an external noise is mixed therewith. However, there is then the disadvantage that the conventional headphone is not provided with a means for correcting the noises.

When the conventional headphone is used, a reproduced sound is different depending upon characteristics of a sound source and a headphone to be used. However, there is then the disadvantage that the conventional headphone is not provided with a means for correcting the difference thereof.

DISCLOSURE OF THE INVENTION

In view of such aspects, the present invention is made and its first object is to provide an audio reproducing apparatus in which a radiation impedance from inlets of external auditory canals of a listener to an outside is approximate to that obtained when the listener does not put the apparatus on the head, it is possible to facilitate localization of a reproduced sound image and it is possible for the listener to feel more comfortable when putting the apparatus on the head.

In view of such aspects, the present invention is made and its second object is to provide an audio reproducing apparatus which smooths reproduction characteristics by an adaptive processing to remove a difference among individuals and a noise resulting from a reflected wave or the like.

In view of such aspects, the present invention is made and its third object is to provide a headphone in which the radiation impedance from the inlets of the external auditory canals of the listener to the outside is close to that obtained when the listener does not put the headphone on the head, it is possible to facilitate the localization of the reproduced sound image and it is possible for the listener to feel more comfortable when putting the headphone on the head.

In view of such aspects, the present invention is made and its fourth object is to provide a headphone which smooths the reproduction characteristics by the adaptive processing to remove the difference among individuals and the noise resulting from the reflected wave or the like.

An audio reproducing apparatus according to a first invention includes a signal source for supplying audio signals in a plurality of channels, a storage means which, after an impulse response from a virtual sound source position with respect to a reference direction of a listener's head to both ears corresponding to a head movement of the listener is measured at every angle which the listener can recognize, records the measured impulse response or which, after a difference in time between audio signals from a virtual sound source position with respect to the reference direction of the listener's head to both ears of the listener and a difference in level therebetween is measured, stores a control signal representing the difference in time between the audio signals and the difference in level therebetween, at least one angle detecting means for detecting a head movement of at least one listener with respect to the reference direction at every predetermined angle to output a signal, an address signal generating means for converting an angle detected by the angle detecting means into an address signal, a control means for correcting the audio signals in respective channels from the signal source based on the impulse response or control signal stored in the storage means, and an audio signal reproducing means which has a pair of sound generating units disposed at positions opposed to both ears of the listener and supplied with the audio signals corrected by correcting means, can be mounted on the listener's head and is provided such that a radiation impedance from an inlet of an external auditory canal to the outside becomes approximate to that obtained when the audio reproducing means is not mounted on the listener's head. According to the audio reproducing apparatus, an address of the storage means is designated by an address signal output from the address signal generating means based on a detection signal from the angle detecting means. The impulse response or the control signal stored in the storage means is read out therefrom. The control means corrects the audio signals from the signal source based on the impulse response or the control signal read out from the storage means. The audio signals supplied from the signal source are corrected with respect to the head movement of the listener in a real-time fashion. The radiation impedance of the audio reproducing means from the inlet of the external auditory canal to the outside is set approximate to that obtained when the audio reproducing means is not mounted on the listener's head, thereby sound generating characteristics of the sound generating unit being set approximate to characteristics obtained when the audio signals are picked up. Therefore, since by an opening portion provided through the sound generating unit of the audio reproducing means so as to be opposed to at least an ear position of the listener, sound generating characteristics of the sound generating unit are set approximate to characteristics obtained when the audio signals are picked up, the radiation impedance of the audio reproducing means from the inlet of the external auditory canal to the outside becomes approximate to that obtained when the listener does not put the audio reproducing means on the head. It is possible to facilitate localization of a reproduced sound image and it is possible for the listener to feel more comfortable when wearing the audio reproducing means on the head.

According to an audio reproducing apparatus of a second invention, the sound generating unit has the opening portion defined at least at a position opposed to the listener's ear and the sound generating characteristics of the sound generating unit are set approximate to the characteristics obtained when the audio signals are picked up. Therefore, since by the opening portion provided through the sound generating unit of the audio reproducing means so as to be opposed at least to an ear position of the listener, the sound generating characteristics of the sound generating unit are set approximate to the characteristics obtained when the audio signals are picked up, the radiation impedance from the inlet of the external auditory canal to the outside becomes approximate to that obtained when the listener does not put the audio reproducing means on the head. It is possible to facilitate the localization of the reproduced sound image and it is possible for the listener to feel more comfortable when wearing the audio reproducing means on the head.

According to an audio reproducing apparatus of a third invention, the audio reproducing means includes a head mount body which can be mounted on the listener's head and a supporting means for supporting the respective sound generating means at positions of the head mount body which are away from the listener's ears by a predetermined distance. Therefore, since the supporting means provided at the head mount body of the audio reproducing means prevents the sound generating units from pressing the listener's ears and the sound generating characteristics of the sound generating unit are set approximate to the characteristics obtained when the audio signals are picked up, the radiation impedance from the inlet of the external auditory canal to the outside becomes approximate to that obtained when the listener does not put the audio reproducing means on the head. It is possible to facilitate the localization of the reproduced sound image and it is possible for the listener to feel more comfortable when wearing the audio reproducing means on the head.

According to an audio reproducing apparatus of a fourth invention, a pair of the sound generating units is disposed so as to be opposed to the left and right ears of the listener and planes of the respective sound generating units opposed to the listener's left and right ears can be inclined at an optional angle relative to a straight line passing through the center of the listener's left and right ears. Therefore, it is possible to reduce sound waves supplied from the sound generating units and reflected by the ears of the listener and the head side portions thereof and to emphasize the sound wave arriving from the direction in which the planes of the sound generating units are inclined. Moreover, it is possible to avoid the influence caused by the difference among the shapes of the auricles of the individual listeners or the like.

According to an audio reproducing apparatus of a fifth invention, the sound generating units are disposed so as to be opposed to the left and right ears of the listener, and provided with the planes of the respective sound generating units opposed to the listener's left and right ears being inclined at a predetermined angle relative to a straight line passing through the centers of the listener's left and right ears so as to be rotated around to a line perpendicular to the straight line passing through the centers of both ears. Therefore, it is possible to reduce the sound waves supplied from the sound generating units and reflected by the ears of the listener and the head side portion thereof and to emphasize the sound wave arriving from the direction in which the planes of the sound generating units are inclined. Moreover, it is possible to avoid the influence caused by the difference among the shapes of the auricles of the individual listeners or the like. Particularly when the planes are inclined forward, it is possible to localize the sound image in front of the listener. When the planes are inclined backward, the sound wave reflected by an auricle portion is reduced. Therefore, it is possible to facilitate correction and to pick up a sound in front of the listener.

According to an audio reproducing apparatus of a sixth invention, the sound generating units are disposed so as to be opposed to the left and right ears of the listener, and provided with the planes of the respective sound generating units opposed to the listener's left and right ears being inclined at a predetermined angle relative to the straight line passing through the centers of both ears so as to be rotated around lines in the vertical direction of the listener's head and within planes perpendicular to the straight line passing through the centers of the listener's left and right ears. Therefore, it is possible to reduce the sound waves supplied from the sound generating units and reflected by the ears of the listener and the head side portion thereof and to emphasize the sound wave arriving from the direction in which the planes of the sound generating units are inclined. Moreover, it is possible to avoid the influence caused by the difference among the shapes of the auricles of the individual listeners or the like.

According to an audio reproducing apparatus of a seventh invention, the sound generating units are disposed so as to be opposed to the left and right ears of the listener, and provided with the planes of the respective sound generating units opposed to the listener's left and right ears being inclined at a predetermined angle relative to the straight line passing through the centers of both ears so as to be rotated around lines in the direction to a listener's face and within the planes perpendicular to the straight line passing through the centers of the listener's left and right ears. Therefore, it is possible to reduce sound waves supplied from the sound generating units and reflected by the ears of the listener and the head side portions thereof and to emphasize the sound wave arriving from the direction in which the planes of the sound generating units are inclined. Moreover, it is possible to avoid the influence caused by the difference among the shapes of the auricles of the individual listeners and so on.

According to an audio reproducing apparatus of an eighth invention, the supporting means includes a supporting mechanism which moves the planes of the sound generating units opposed to the listener's left and right ears close to or away from the listener's left and right ears. Therefore, since the planes of the sound generating units opposed to the listener's left and right ears can be moved close to or away from the listener's left and right ears, it is possible to avoid the influence caused by the difference among the shapes of the auricles of the individual listeners and so on.

According to an audio reproducing apparatus of a ninth invention, each of the sound generating units is formed of a plurality of sound generator units and the respective sound generator units are supplied with signals obtained by dividing a frequency band of the corrected audio signal to be supplied to the audio reproducing means into a plurality of frequency bands. Therefore, since a band of the audio signal is divided into the plurality of bands, the audio reproducing means has a plurality of sound generator units corresponding to the plurality of bands and the plurality of sound generator units emanate the sounds, the characteristics become clear and the correction of the audio signals can be facilitated.

According to an audio reproducing apparatus of a tenth invention, the audio reproducing means includes an attachment member to which the sound generating unit is attached, the sound generating unit is disposed substantially in parallel to the side portion of the listener's head and the sound generating unit is attached with a diaphragm of the sound generating unit being inclined at a predetermined angle relative to the attachment member. Therefore, it is possible to reduce the sound waves supplied from the sound generating units and reflected by the ears and head side portions of the listener and to change the effect of picking up the sounds.

According to an audio reproducing apparatus of an eleventh invention, the audio reproducing means includes the head mount body which can be mounted on the listener's head and the supporting means for supporting the respective sound generating units on the head mount body at the positions located away from the listener's ears by a predetermined distance. Therefore, since the supporting members provided at the head mount body of the audio reproducing means prevents the sound generating units from pressing on the listener's ears and the sound generating characteristics of the sound generating units are set approximate to the characteristics obtained when the audio signals are picked up, the radiation impedance from the inlet of the external auditory canal to the outside becomes approximate to that obtained when the listener does not put the audio reproducing means on the head. It is therefore possible to facilitate the localization of the reproduced sound image and it is possible for the listener to feel more comfortable when wearing the audio reproducing means on the head.

According to an audio reproducing apparatus of a twelfth invention, the pair of sound generating units is disposed so as to be opposed to the left and right ears of the listener and the planes of the respective sound generating units opposed to the listener's left and right ears can be inclined at an optional angle relative to the straight line passing through the centers of the listener's left and right ears. Therefore, it is possible to reduce the sound waves supplied from the sound generating units and reflected by the ears of the listener and the head side portions thereof and to emphasize the sound wave arriving from the direction in which the planes of the sound generating units are inclined. Moreover, it is possible to avoid the influence caused by the difference among the shapes of the auricles of the individual listeners and so on.

According to an audio reproducing apparatus of a thirteenth invention, the sound generating units are disposed so as to be opposed to the left and right ears of the listener, and provided with the planes of the respective sound generating units opposed to the listener's left and right ears being inclined at a predetermined angle relative to the straight line passing through the center of the listener's left and right ears so as to be rotated around the lines perpendicular to the straight line passing through the centers of both ears. Therefore, it is possible to reduce the sound waves supplied from the sound generating units and reflected by the ears of the listener and the head side portion thereof and to emphasize the sound wave arriving from the direction in which the planes of the sound generating units are inclined. Moreover, it is possible to avoid the influence caused by the difference among the shapes of the auricles of the individual listeners and so on. Particularly when the planes are inclined forward, it is possible to localize the sound image in front of the listener. When the planes are inclined backward, the sound wave reflected by the auricle portion is reduced. Therefore, it is possible to facilitate the correction and to pick up the sound of an external field in front of the listener.

According to an audio reproducing apparatus of a fourteenth invention, the sound generating units are disposed so as to be opposed to the left and right ears of the listener, and provided with the planes of the respective sound generating units opposed to the listener's left and right ears being inclined at a predetermined angle relative to a straight line passing through the centers of both ears so as to be rotated around the lines in the vertical direction of the listener's head and within the planes perpendicular to the straight line passing through the centers of the listener's left and right ears. Therefore, it is possible to reduce the sound waves supplied from the sound generating units and reflected by the ears of the listener and the head side portions thereof and to emphasize the sound wave arriving from the direction in which the planes of the sound generating units are inclined. Moreover, it is possible to avoid the influence caused by the difference among the shapes of the auricles of the individual listeners and so on.

According to an audio reproducing apparatus of a fifteenth invention, the sound generating units are disposed so as to be opposed to the left and right ears of the listener, and provided with the planes of the respective sound generating units opposed to the listener's left and right ears being inclined at a predetermined angle relative to the straight line passing through the centers of both ears so as to be rotated around the lines in the direction to a listener's face and within planes perpendicular to the straight line passing through the centers of the listener's left and right ears. Therefore, it is possible to reduce the sound waves supplied from the sound generating units and reflected by the ears of the listener and the head side portions thereof and to emphasize the sound wave arriving from the direction in which the planes of the sound generating units are inclined. Moreover, it is possible to avoid the influence caused by the difference among the shapes of the auricles of the individual listeners and so on.

According to an audio reproducing apparatus of a sixteenth invention, the supporting means includes the supporting mechanism which moves the planes of the sound generating units opposed to the listener's left and right ears close to or away from the listener's left and right ears. Therefore, since the planes of the sound generating units opposed to the listener's left and right ears can be moved close to or away from the listener's left and right ears, it is possible to avoid the influence caused by the difference among the shapes of the auricles of the individual listeners and so on.

According to an audio reproducing apparatus of a seventeenth invention, the respective sound generating units are formed of a plurality of sound generator units and the respective sound generator units are supplied with the signals obtained by dividing a frequency band of the corrected audio signal to be supplied to the audio reproducing means into the plurality of frequency bands. Therefore, since the band of the audio signal is divided into a plurality of bands, the audio reproducing means has a plurality of sound generator units corresponding to the plurality of bands and the plurality of sound generator units emanate the sounds, the characteristics become clear and the correction of the audio signals can be facilitated.

According to an audio reproducing apparatus of an eighteenth invention, the audio reproducing means includes the attachment member for attaching the sound generating unit, the sound generating unit being disposed substantially in parallel to the side of listener's head and the sound generating unit being attached with the diaphragm of the sound generating unit being inclined at a predetermined angle with respect to the attaching member. Therefore, it is possible to reduce the sound waves supplied from the sound generating units and reflected by the ears and head side portions of the listener and to change an effect of picking up the sounds.

An audio reproducing apparatus of a nineteenth invention includes the signal source for supplying the audio signals in a plurality of channels, the storage means which, after the impulse response from the virtual sound source position with respect to the reference direction of the listener's head to both ears corresponding to the head movement of the listener is measured, stores the measured impulse response or which, after the difference in time between the audio signals from the virtual sound source position with respect to the reference direction of the listener's head to both ears of the listener and the difference in level therebetween are measured, stores the control signal representing the difference in time between the audio signals and the difference in level therebetween, at least one angle detecting means for detecting the head movement of at least one listener with respect to the reference direction at every predetermined angle to output the signal, the address signal generating means for converting the angle detected by the angle detecting means into the address signal, the control means for correcting the audio signals in respective channels from the signal source based on the impulse response or control signal stored in the storage means, an audio signal reproducing means which has the microphones provided so as to be opposed to the ears of the listener, can be mounted on the listener's head, is supplied with the audio signals corrected by the control means, and reproduces the supplied audio signals, and an adaptive processing filter which, after reproduction characteristics of the audio signals output from the audio reproducing means are measured by the microphones, subjects the reproduction characteristics to smoothing processing based on the measured results to thereby correct the audio signals in respective channels corrected by the control means. According to the audio reproducing means, based on the detection signal from the angle detecting means, the address of the storage means is designated by the address signal output from the address signal generating means. The impulse response or the control signal stored in the storage means is read out therefrom. The control means corrects the audio signals from the signal source based on the impulse response or the control signal read out from the storage means. The audio signals supplied from the signal source are corrected with respect to the head movement of the listener in a real-time fashion. The adaptive processing filter corrects the audio signals in respective channels corrected by the control means by a process of smoothing the reproduction characteristics. The audio reproducing means reproduces the audio signals. Therefore, based on the signal corresponding to the angle from the angle detecting means, the address of the storage means is designated by the address signal output from the address signal generating means. The impulse response or the control signal stored in the storage means is read out therefrom. The control means corrects the audio signals from the signal source based on the impulse response or the control signal. The audio signals are corrected with respect to the head movement of one or a plurality of listeners in a real-time fashion. The adaptive processing filter corrects the audio signals in respective channels corrected by the control means through a process of smoothing the reproduction characteristics. Thus, the audio signals are reproduced by the audio reproducing means.

According to an audio reproducing apparatus of a twentieth invention, the audio reproducing means includes the head mount body which can be mounted on the listener's head and the supporting means for supporting the respective sound generating units at the positions of the head mount body which are away from the listener's ears by a predetermined distance. Therefore, since the supporting members provided at the head mount body of the audio reproducing means prevents the sound generating units from pressing the listener's ears and the sound generating characteristics of the sound generating units are set approximate to the characteristics obtained when the audio signals are picked up, the radiation impedance from the inlet of the external auditory canal to the outside becomes approximate to that obtained when the listener does not put the audio reproducing means on the head. It is possible to facilitate the localization of the reproduced sound image and it is possible for the listener to feel more comfortable when wearing the audio reproducing means on the head.

According to an audio reproducing apparatus of a twenty-first invention, the audio reproducing means includes the holding means for holding the microphones at the positions opposed to the earholes of the listener. Therefore, since the microphones provided in the audio reproducing means so as to be opposed to the listener's ears are microphones fixed by the supporting members so as to be opposed to the listener's earholes, it is possible to reliably measure a noise entering the listener's earhole through an actual measurement and hence it is possible for the adaptive processing filter to carry out the correction based on the inverse characteristics.

According to an audio reproducing apparatus of a twenty-second invention, the audio reproducing means includes a pair of the sound generating units respectively supplied with the audio signals corrected by the control means and corrected by the adaptive processing filter and the holding means which holds the microphones at the positions which are opposed to the listener's earhole and are closer to the listener's auricles as compared with the sound generating units. Therefore, since the microphones provided in the audio reproducing means so as to be opposed to the listener's ears are the microphones fixed by the supporting members so as to be opposed to the listener's earholes, it is possible to reliably measure the noise entering the listener's earhole through the actual measurement and hence it is possible for the adaptive processing filter to carry out the correction based on the inverse characteristics.

According to an audio reproducing apparatus of a twenty-third invention, the audio reproducing means includes a pair of the sound generating units supplied with the audio signals corrected by the control means and corrected by the adaptive processing filter and the holding means which holds the microphones at the positions which are opposed to the listener's earholes and are projected toward the listener's auricles as compared with the sound generating units. Therefore, the microphone provided in the audio reproducing means so as to be opposed to the listener's ear is the microphone fixed by the supporting member so as to be opposed to the listener's earhole, it is possible to reliably measure the noise entering the listener's earhole through the actual measurement and hence it is possible for the adaptive processing filter to carry out the correction based on the inverse characteristics.

According to an audio reproducing apparatus of a twenty-fourth invention, each of the holding means is provided at its one end in the audio reproducing means and has at its other end the flexible supporting member to which the microphone is attached. Therefore, the microphone provided in the audio reproducing means so as to be opposed to the listener's ear is a probe microphone positioned by the flexible supporting member so as to be opposed to the listener's earhole, so that it is possible to reliably measure the noise entering the listener's earhole through the actual measurement by moving the probe microphone with fine adjustment and hence it is possible for the adaptive processing filter to carry out the correction based on the inverse characteristics.

According to an audio reproducing apparatus of a twenty-fifth invention, after reflection characteristics and noise characteristics of the audio signals at the listener's earhole are measured by the microphone, the adaptive processing filter generates inverse characteristics of the reflection characteristics and noise characteristics at the listener's earhole based on measured results, and corrects the audio signals in the respective channels corrected by the control means based on the inverse characteristics of the reflection characteristics and the noise characteristics at the listener's earhole. Therefore, since after the reflected waves of the audio signals and so on and the extraneous noises are measured by the microphone provided in the audio reproducing means so as to be opposed to the listener's ear, the adaptive processing filter generates the inverse characteristics of the noise characteristics and corrects the audio signals in the respective channels corrected by the control means based on the inverse characteristics of the noise characteristics, it is possible to reproduce the audio signals under the same condition by removing the noise caused by the difference among the shapes of the ears of the individual listeners and the extraneous noises and by smoothing the characteristics.

According to an audio reproducing apparatus of a twenty-sixth invention, an adaptive processing FIR filter is employed as the adaptive processing filter. Therefore, since the adaptive processing FIR filter is employed as the adaptive processing filter, it is possible to form the digital filters by programs under the desired conditions and to process the audio signals in the digital signal processing.

According to an audio reproducing apparatus of a twenty-seventh invention, the adaptive processing filter sets a predetermined target value and corrects characteristics inherent in the audio reproducing means such that a value of the characteristics becomes approximate to the target value. Therefore, since the adaptive processing filter sets a predetermined target value and corrects characteristics inherent in the audio reproducing means such that a value of the characteristics becomes approximate to the target value, it is possible to constantly reproduce the sound approximate to the sound from the sound source even if the audio reproducing means is replaced with another one.

According to an audio reproducing apparatus of a twenty-eighth invention, the adaptive processing filter sets a predetermined target value and carries out correction by making a value of the characteristics approximate to the target value such that the sound field becomes approximate to a predetermined one. Therefore, since the adaptive processing filter sets a predetermined target value and carries out correction by making a value of the characteristics approximate to the target value such that the sound field becomes approximate to a predetermined one, it is possible to reproduce optional sound fields such as a specific theater, a specific concert hall or the like.

According to an audio reproducing apparatus of a twenty-ninth invention, the adaptive processing filter is an indirect execution type filter which, after characteristics are measured based on an output from the microphone, carries out the processing based on the inverse characteristics thereof. Therefore, since the adaptive processing filter is an indirect execution type filter which carries out the processing based on the inverse characteristics thereof after the measurement of the characteristics, it is possible to smooth the characteristics by generating the inverse characteristics thereof based on the measurement of the characteristics.

According to an audio reproducing apparatus of a thirtieth invention, the adaptive processing filter is a direct execution type filter which successively carries out the measurement of the characteristics based on the output from the microphone and the processing based on the inverse characteristics thereof. Therefore, since the adaptive processing filter is a direct execution type filter which successively carries out the measurement of the characteristics and the processing based on the inverse characteristics thereof, it is possible for the adaptive processing filters to smooth the characteristics while carrying out the measurement of the characteristics and the generation of the inverse characteristics.

According to an audio reproducing apparatus of a thirty-first invention, the audio reproducing means includes a pair of sound generating units which can be attached to the respective earholes of the both ears of the listener, each of the sound generating units includes a hollow cylinder-shaped member having a non-reflection portion at one end and an open end at the other end opposed to the earhole of the listener and having substantially the same inside diameter as that of the external auditory canal of the listener, the microphone on a side surface of the cylinder-shaped member and the sound generator unit disposed in the vicinity of the microphone so as to be opposed to an inner peripheral surface of the cylinder-shaped member, the other end of the cylinder-shaped member is opposed to the earhole of the listener in a state that the audio reproducing means is mounted on the listener's head, and the audio signals corrected by the control means are supplied to the sound generator units. Therefore, it is possible for the adaptive processing filter to correct the audio signals in respective channels corrected by the control means by smoothing the reproduction characteristics and it is possible to reproduce the audio signals such that the hollow-cylinder-shaped sound generator units of the audio reproducing means cancel the sound wave reflected by the listener's ears.

According to an audio reproducing apparatus of a thirty-second invention, the audio reproducing means includes the head mount body which can be mounted on the listener's head, and the supporting means for supporting the respective sound generating units at the positions of the head mount body which are away from the listener's ears by a predetermined distance. Therefore, since the audio reproducing means has the head mount body which allows the listener to put the audio reproducing means on the head and the sound generator units are supported at the head mount body such that the open end of the sound generator unit is located at least at an interval for enough so as not to press against the earhole of the listener, the radiation impedance from the inlet of the external auditory canal to the outside becomes approximate to that obtained when the listener does not put the audio reproducing means on the head. It is possible to facilitate the localization of the reproduced sound image and it is possible for the listener to feel more comfortable when putting the audio reproducing means on the head.

According to an audio reproducing apparatus of a thirty-third invention, the microphone is provided such that the diaphragm of the microphone is substantially parallel to an inner peripheral surface of the cylinder-shaped member. Therefore, since the microphone provided in the audio reproducing means so as to be opposed to the listener's earhole is located by the supporting means in the vicinity of the open end of the sound generator unit and opposed to the listener's earhole, it is possible to reliably measure the noise entering the listener's earhole through the actual measurement and hence it is possible for the adaptive processing filter to carry out the correction based on the inverse characteristics.

According to an audio reproducing apparatus of a thirty-fourth invention, the cylinder-shaped member includes a flexible portion. Therefore, since the hollow-cylinder-shaped portion of the sound generator unit provided in the audio reproducing means includes the flexible portion, it is possible to finely adjust the position of the open end of the sound generator unit such that the open end is opposed to the position of the ear which is different every time the listener puts on the audio reproducing means or the position of the ear is different depending on each of the individual listeners.

According to an audio reproducing apparatus of a thirty-fifth invention, after the reflection characteristics and the noise characteristics of the audio signal at the listener's earhole are measured by the microphone, the adaptive processing filter generates the inverse characteristics and the noise characteristics of the reflection characteristics at the listener's earhole based on the measured results and corrects the audio signals in respective channels corrected by the control means based on the inverse characteristics of the reflection characteristics and the noise characteristics at the listener's earhole. Therefore, since after the reflection characteristics of the audio signals at the earhole and the noise characteristics are measured by the microphone provided in the audio reproducing means so as to be opposed to the listener's earhole, the adaptive processing filter generates the inverse characteristics of the reflection characteristics and the noise characteristics at the earhole and corrects the audio signals in respective channels corrected by the control means based on the inverse characteristics of the reflection characteristics and the noise characteristics at the earhole, it is possible to reproduce the audio signals under the same condition by removing the reflected waves caused by the difference among the shapes of the ears of the individual listeners and the extraneous noises and by smoothing the characteristics.

According to an audio reproducing apparatus of a thirty-sixth invention, the adaptive processing FIR filter is employed as the adaptive processing filter. Therefore, since the adaptive processing FIR filter is employed as the adaptive processing filter, it is possible to form the digital filters by programs under the desired conditions and to process the audio signals by digital signal processing.

According to an audio reproducing apparatus of a thirty-seventh invention, the adaptive processing filter sets a predetermined target value and corrects the characteristics inherent in the audio reproducing means such that the value of the characteristics becomes approximate to the target value. Therefore, since the adaptive processing filter sets a predetermined target value and corrects the characteristics inherent in the audio reproducing means such that a value of the characteristics becomes approximate to the target value, it is possible to constantly reproduce the sound approximate to the sound from the sound source even if the audio reproducing means is replaced with another one.

According to an audio reproducing apparatus of a thirty-eighth invention, the adaptive processing filter sets a predetermined target value and carries out the correction by making the value of the characteristics approximate to the target value such that the sound field becomes approximate to a predetermined one. Therefore, since the adaptive processing filter sets a predetermined target value and carries out the correction by making a value of the characteristics approximate to the target value such that the sound field becomes approximate to a predetermined one, it is possible to reproduce optional sound fields such as a specific theater, a specific concert hall or the like.

According to an audio reproducing apparatus of a thirty-ninth invention, the adaptive processing filter is the indirect execution type filter which, after characteristics are measured based on the output from the microphone, carries out the processing based on the inverse characteristics thereof. Therefore, since the adaptive processing filter is the indirect execution type filter which carries out the processing based on the inverse characteristics thereof after the measurement of the characteristics, it is possible to smooth the characteristics by generating the inverse characteristics thereof based on the measurement of the characteristics.

According to an audio reproducing apparatus of a fortieth invention, the adaptive processing filter is the direct execution type filter which successively carries out the measurement of the characteristics based on the output from the microphone and the processing based on the inverse characteristics thereof. Therefore, since the adaptive processing filter is the direct execution type filter which successively carries out the measurement of the characteristics and the processing based on the inverse characteristics thereof, it is possible for the adaptive processing filters to smooth the characteristics while carrying out the measurement of the characteristics and the generation of the inverse characteristics.

A headphone according to a forty-first invention includes a mount portion which is mounted on the listener's head, a detecting means provided at a position on the mount portion for detecting the head gyration of the listener, a pair of the sound generating units respectively provided at positions of the mount portion opposed to the left and right ears of the listener, and the supporting means for supporting the respective sound generating units at the positions away from the ears of the listener at a predetermined interval in a state that the mount portion is mounted on the listener's head. Therefore, the radiation impedance from the inlet of the external auditory canal of the listener to the outside becomes approximate to that obtained when the listener does not put on the headphone. It is possible to facilitate the localization of the reproduced sound image and it is possible for the listener to feel more comfortable when putting the headphone on the head.

According to a headphone of a forty-second invention, the mount portion is substantially U-shaped and the supporting means are provided in the mount portion. Therefore, the radiation impedance from the inlet of the external auditory canal of the listener to the outside becomes approximate to that obtained when the listener does not put on the headphone. It is possible to facilitate the localization of the reproduced sound image and it is possible for the listener to feel more comfortable when putting the headphone on the head.

According to a headphone of a forty-third invention, the supporting means is fitted at its one end to the mount portion and provided at its other end with a contact portion which is brought in contact with the head side portion around the ear of the listener. Therefore, the radiation impedance from the inlet of the external auditory canal of the listener to the outside becomes approximate to that obtained when the listener does not put on the headphone. It is possible to facilitate the localization of the reproduced sound image and it is possible for the listener to feel more comfortable when putting the headphone on the head.

BRIEF DESCRIPTION OF DRAWINGS

FIG. 1 is a block diagram showing an audio reproducing apparatus according to an embodiment of the present invention;

FIG. 4 is a diagram showing a table of an impulse response of the audio reproducing apparatus according to the embodiment of the present invention;

FIG. 6 is a diagram showing a table of control data of the audio reproducing apparatus according to the embodiment of the present invention;

FIG. 7 is a block diagram showing an audio reproducing apparatus according to another embodiment of the present invention;

FIG. 8 is a block diagram showing the audio reproducing apparatus according to another embodiment of the present invention;

FIG. 34 is a block diagram showing an audio reproducing apparatus according to another embodiment of the present invention;

FIG. 35 is a block diagram showing the audio reproducing apparatus according to another embodiment of the present invention;

FIG. 36 is a block diagram showing the audio reproducing apparatus according to another embodiment of the present invention;

BEST MODE CARRYING OUT THE INVENTION

Figure 2:
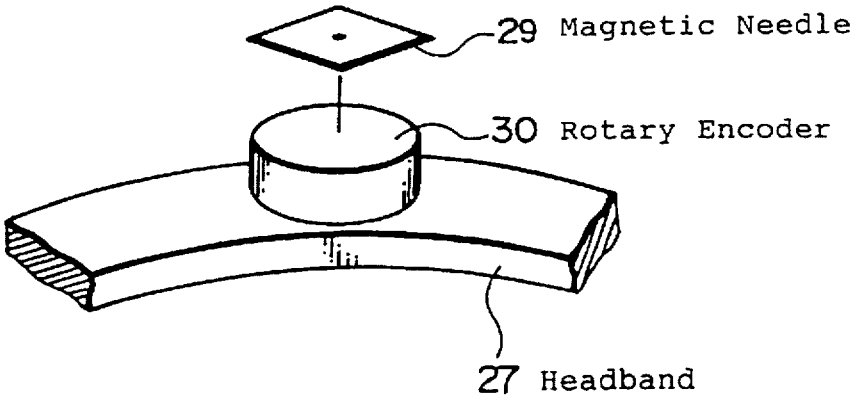
FIG. 2 is a diagram showing an arrangement of a digital angle detector of the audio reproducing apparatus according to the embodiment of the present invention.

An audio reproducing apparatus according to an embodiment of the present invention will hereinafter be described in detail with reference to FIGS. 1 to 19.

According to the audio reproducing apparatus according to the embodiment of the present invention, when audio signals are reproduced by a headphone, the listener can perceive localization, sound field and so on equivalent to those perceived when the audio signals are reproduced by speakers located in a predetermined positional relationship where the speakers would be located even when the audio signals are reproduced by the headphone. Particularly, sound generating units of the headphone which the listener wears on the head are disposed at positions distant from listener's ears to thereby cancel an unnecessary reflected wave. Thus, localization is facilitated and audio signals are corrected so as to have reproduction characteristics approximate to characteristics obtained when a sound is picked up.

Specifically, the audio reproducing apparatus according to the embodiment of the present invention is used in a system of reproducing through a headphone multichannel audio signals obtained by picking up sound in a stereophonic fashion or the like. Particularly, when digitized audio signals to be recorded in or transmitted to respective channels for localizing respective sound images in a predetermined positional relationship (e.g., at right, left and center positions in front of the listener and other positions) are reproduced through the headphone or the like, the sound generating units provided at the optimum attachment positions of the headphone so as to be inclined enable the listener to feel more comfortable when putting the headphone on the head, clarify the characteristics of the headphone to thereby facilitate the correction, and to thereby reproduce the audio signals substantially in a state obtained when the listener does not put the headphone on the head.

FIG. 1 shows an example of the audio reproduction apparatus according to the present invention. Reference numeral 1 depicts a multichannel digital stereophonic signal source, such as a digital audio disc (e.g., a compact disc), a digital satellite broadcasting or the like. Reference numeral 2 depicts an analog stereophonic signal source, such as an analog record, an analog broadcasting or the like. Reference numeral 3 depicts A/D converters which convert the analog signals into digital signals.

If the analog signals are multichannel analog signals, then the A/D converters 3 are provided to match the number of the channels of the analog signals. Reference numeral 4 depicts switchers in which both signals inputted as digital signals and signals inputted as analog signals are processed as digital signals represented by a constant sampling frequency and a constant number of quantizing bits. While the switchers 4 for two channels are shown in FIG. 1, if the signals are multichannel signals, then switchers 4 are provided to match the number of channels.

A left digital signal L of the digital signal series is supplied to a convolution integrator 5. At this time, a set of digitally recorded impulse responses are read out to a memory 6 associated with the convolution integrator 5, the digitally recorded impulse responses being impulse responses from a virtual sound source position in the direction in which a listener 23 turns the head at present with respect to a reference direction of the head to both ears of the listener and being represented by a constant sampling frequency and a constant number of quantizing bits. The digital signal series are subject ed to convolution integral together with the impulse response read out from the memory 6 by the convolution integrator 5 in a real time fashion. A convolution integrator 7 and a memory 8 supply a crosstalk component of a right digital signal R.

Similarly to the left digital signal, the right digital signal R is supplied to a convolution integrator 11. At this time, a set of digitally recorded impulse responses are read out to a memory 12 associated with the convolution integrator 11, the digitally recorded impulse responses being impulse responses from the virtual sound source position in the direction in which the listener 23 turns the head at present with respect to the reference direction of the head to both ears of the listener and being represented by the constant sampling frequency and the constant number of quantizing bits. The digital signal series are subjected to convolution integral together with the impulse response read out from the memory 12 by the convolution integrator 11 in a real time fashion. A convolution integrator 9 and a memory 10 supply a crosstalk component of a right digital signal L.

Similarly, the convolution integrator 7 and the memory 8 and the convolution integrator 11 and the memory 12 carry out the convolution integral with the impulse responses. As described above, the data signal series subjected by the convolution integrators 5, 7, 9 and 11 and the memories 6, 8, 10 and 12 to the convolution integral with the impulse responses are supplied to adders 15, 16, respectively. Two channel digital signals added by the adders 15, 16 are corrected by correcting circuits 17, 18 to remove therefrom characteristics inherent in sound sources and headphones which are used, and then converted by D/A converters 19, 20 into two-channel analog signals. The two-channel analog signals are amplified by power amplifiers 21, 22 and then supplied to headphones 24.

While the impulse responses are stored in a memory 35 in the above embodiment, an arrangement shown in FIG. 7 may be employed. Specifically, a pair of digitally recorded impulse responses from the virtual sound source positions with respect to a fixed head direction with respect to the reference direction to the listener's ears are stored in the memories 6, 8, 10 and 12 associated with the convolution integrators 5, 7, 9 and 11. The digital signal series are subjected to the convolution integral together with the impulse responses in a real-time fashion. The memory 35 stores a control signal representing a difference in time and level between sounds obtained at both ears from the virtual sound source positions to both ears with respect to the reference direction of the head.

A newly detected head movement with respect to the reference direction is converted into a digital address signal representing a magnitude including a direction at every constant unit angle or every predetermined angle. The control signal previously stored in the memory 35 is read out by using the digital address signal. The digital signals in the respective channels subjected to the convolution integral are corrected and changed in a real-time fashion in control apparatus 50, 51, 52 and 53 and results thereof are supplied to the adders 15, 16.

An arrangement shown in FIG. 8 may be employed. Specifically, the digital signal series subjected to the convolution integral together with the impulse responses in a real-time fashion are supplied to the address 15, 16. A newly detected head movement with respect to the reference direction is converted into a digital address signal representing a magnitude of the head movement including its direction at every constant unit angle or every predetermined angle. The control signal previously stored in the memory 35 is read out by using the digital address signal. The two-channel digital signals are corrected and changed by the control apparatus 54, 56 in a real-time fashion.

Each of the control apparatus 50, 51, 52, 53, 54 and 56 may be formed by combining a variable delay apparatus and a variable level controller or a level controller for controlling a level in every frequency band, such as a graphic equalizer having a number of divided bands or the like. Information stored in the memory 35 may be impulse response representing difference in time, level and so on between sounds obtained at both ears from the virtual sound source positions to both ears in the direction in which the listener 23 turns the head with respect to the reference direction of the head. In this case, each of the above-mentioned control apparatus may be formed of an IIR or FIR variable digital filter.

As described above, the digital signals are given spatial information by the control apparatus, corrected by the correcting circuits 17, 18 with respect to characteristics inherent in the sound sources and headphones which are used, changed in response to the head movement, and then converted by the D/A converters 19, 20 into the analog signals. The analog signals are amplified by the amplifiers 21, 22 and then supplied to the head phone 24.

In this case, the correcting circuits 17, 18 for correcting the characteristics inherent in the sound sources and headphones to be used may process signals in an analog or digital fashion. If the headphone is of wireless type, then the correcting circuits may be provided in a main body of the headphone. The correcting circuits may not necessarily be housed in the main body of the headphone, but may be provided in cords of the headphone, for example, or may be provided in connector units for connecting the apparatus main body and the headphone or a subsequent stage. Moreover, the correcting circuits may be provided in the control apparatus of the apparatus main body or a subsequent stage.

A digital angle detector 28 detects a head movement of the listener 23. FIG. 2 shows a detailed arrangement of the digital angle detector 28. FIG. 2 shows the digital angle detector 28 using horizontal component forces of geomagnetism. In the arrangement shown in FIG. 2, a signal indicative of a detected angle is output in the form of a digital signal.

In order to detect the head movement of the listener 23 with respect to the reference direction at every constant unit angle or at every predetermined angle as discrete information, a rotary encoder 30 is provided at a center position of the head with an input shaft thereof being vertical and a magnetic needle 29 is provided at the input shaft thereof. Accordingly, the rotary encoder 30 outputs a signal indicative of the head movement of the listener 23 including the direction with reference to the north and south direction indicated by the magnetic needle 29. While the rotary encoder 30 is attached to a headband 27 of the headphone 24, the rotary encoder 30 may be attached to an attachment device provided independently of the headband 27.

The output from the rotary encoder 30 of the digital angle detector 28 is supplied to detecting circuits 31, 32. The detecting circuit 31 outputs a signal Sd which indicates a direction and is set to "0" or "1" when the listener 23 turns the head in the clockwise direction or in the counterclockwise direction. The detecting circuit 32 outputs pulses Pa of the number proportional to an angle changed when the listener 23 changes the head direction, i.e., one pulse Pa each time when the angle of the head of the listener is changed by each 2°.

The signal Sd is supplied to a count direction input terminal U/D of an up/down counter 33, and the pulse Pa is supplied to a clock input (count input) terminal CK of the up/down counter 33. An output indicative of a counted result of the up/down counter is converted to a digital address signal indicating the direction and magnitude of the head movement of listener 23. The digital address signal is supplied through an address control circuit 34 to the memories 6, 8, 10 and 12 as an address signal.

The impulse responses, which are previously digitally recorded in the memories 6, 8, 10 and 12, from the virtual sound source positions with respect to the reference direction of the head of the listener 23 to both ears of the listener 23 are read from corresponding addresses of the tables of the memories 6, 8, 10 and 12. At the same time, the impulse responses are subjected by the convolutional integrators 5, 7, 9 and 11 to convolution integral together with the digitized audio signals in the respective channels. Thus, the digitized audio signals are corrected in a real-time fashion with respect to the direction in which the listener 23 turns the head at present.

Figure 3:
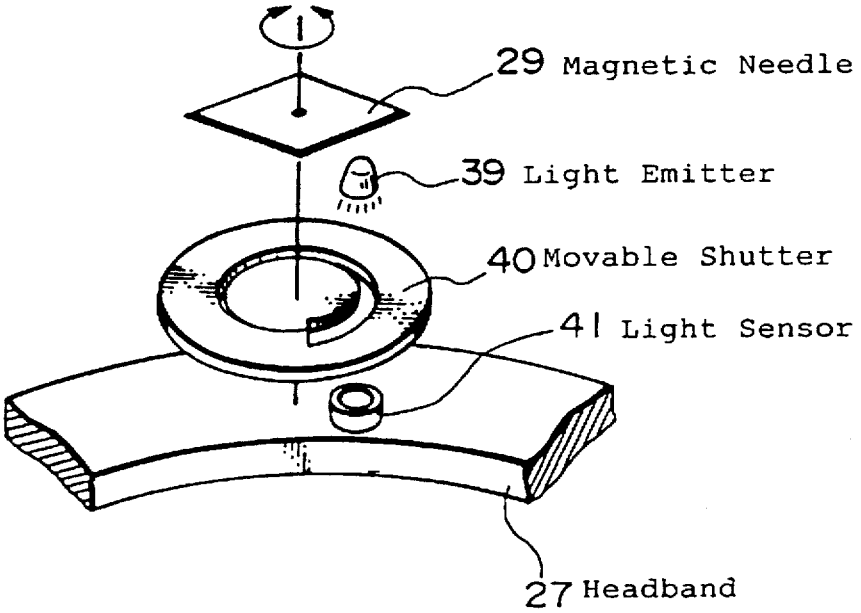
FIG. 3 is a diagram showing an arrangement of an analog angle detector of the audio reproducing apparatus according to the embodiment of the present invention.

On the other hand, reference numeral 38 depicts an analog angle detector. FIG. 3 shows an arrangement of the analog angle detector in detail. In the arrangement shown in FIG. 3, an output signal indicative of a detected angle is output as an analog signal. A photosensor 41 composed of a photosensor element, such as a CDS, a photodiode or the like whose resistance value changes in response to light intensity is disposed on the center portion of the head of the listener 23. A light emitter 39, such as a bulb, a light emitting diode or the like, is disposed so as to be opposed to the photosensor 41. The light emitter 39 radiates light of predetermined intensity on the photosensor 41.

A movable shutter 40 is provided in the light path of light radiated from the light emitter 39, having transmittance of the radiated light which is changed depending upon a rotational angle thereof. The movable shutter 40 is rotated together with the magnetic needle 29. Accordingly, when a constant current flows into the photosensor 41, a voltage across both ends of the photosensor of the photosensor 41 is derived as an analog output representing the head movement of the listener 23 including its direction with reference to the north and south direction indicated by the magnetic needle 29. While the analog angle detector 38 is attached to the headband 27 of the headphone 24 in this embodiment, the analog angle detector may be attached onto an attachment device provided independently of the headband 27.

An analog output from the analog angle detector 38 is amplified by an amplifier 42 and then supplied to an A/D converter 43. A digital output therefrom is supplied through a switcher 44 to the address control circuit 34. The address control circuit 34 generates a digital address signal representing a magnitude of the head movement of the listener 23 with respect to the reference direction including the direction at every constant angle or every predetermined angle and supplies it to the memories 6, 8, 10 and 12 as an address signal.

In FIG. 1, the impulse responses, which are previously digitally recorded in the memories 6, 8, 10 and 12, from the virtual sound source positions with respect to the reference direction of the head of the listener 23 to both ears of the listener 23 are read from corresponding addresses of the tables of the memories 6, 8, 10 and 12. The impulse responses are subjected to convolution integral together with the digitized audio signals in respective channels by the convolution integrators 5, 7, 9 and 11. Thus, the digital signals are corrected in a real-time fashion with respect to the direction in which the listener 23 turns the head at present.

In FIG. 7, the control signals, which are previously digitally recorded in the memory 35, representing differences in time, level and so on between sounds obtained at the ears from the virtual sound source positions with respect to the reference direction of the head of the listener 23 to both ears of the listener 23 are read from corresponding addresses of the table of the memory 35. Based on the control signals, the digitized audio signals in respective channels subjected to convolution integral together with the impulse responses by the convolution integrators 5, 7, 9 and 11 and the memories 6, 8, 10 and 12 associated respectively therewith are corrected by the control apparatus 50, 51, 52 and 53 with respect to the direction in which the listener 23 turns the head at present in a real-time fashion through a wireless transmission. In the arrangement shown in FIG. 8, the same correction as that carried out in the arrangement shown in FIG. 7 is carried out.

Figure 5:
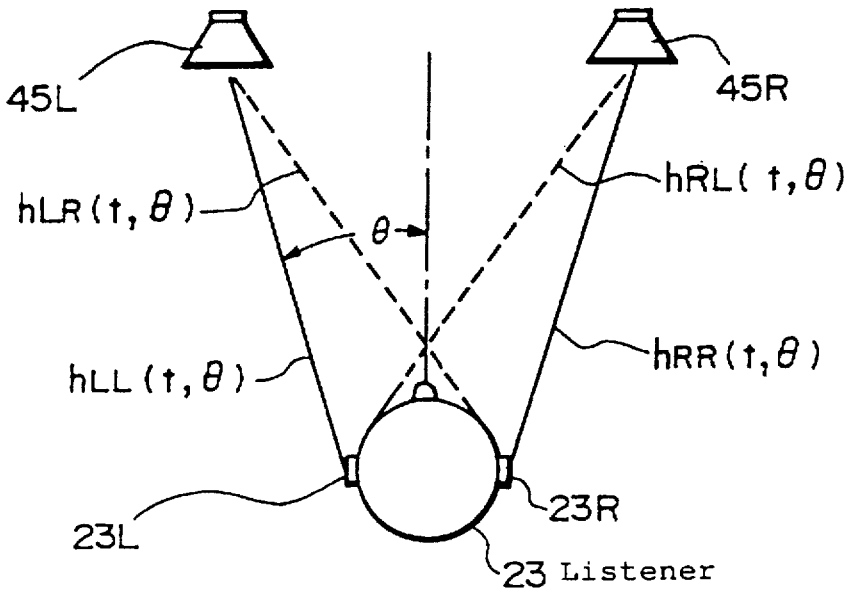
FIG. 5 is a diagram used to explain measurement of the impulse response of the audio reproducing apparatus according to the embodiment of the present invention.

FIG. 4 shows a table data stored in the memories 6, 8, 10 and 12. Specifically, when front left and right speakers 45L, 45R are positioned in front of the listener 23 as shown in FIG. 5, if the impulse responses from positions of the left and right speakers 45L, 45R to both ears of the listener 23 are represented by Equation 1

$$h_{LL}(t,\Theta) = 1/2\pi \int_{-\infty}^{\infty} H_{LL}(\omega,\Theta) \cdot \exp(j\omega t)d\omega$$

Equation 2

$$h_{LR}(t,\Theta) = 1/2\pi \int_{-\infty}^{\infty} H_{LR}(\omega,\Theta) \cdot \exp(j\omega t)d\omega$$

Equation 3

$$h_{RL}(t,\Theta) = 1/2\pi \int_{-\infty}^{\infty} H_{RL}(\omega,\Theta) \cdot \exp(j\omega t)d\omega$$

Equation 4

$$h_{RR}(t,\Theta) = 1/2\pi \int_{-\infty}^{\infty} H_{RR}(\omega,\Theta) \cdot \exp(j\omega t)d\omega$$

then the impulse responses representing the above equations are digitally recorded in the memories 6, 8, 10 and 12.

In the above table, reference symbol $h_{mn}(t)$ depicts an impulse response from a speaker position m to an ear n, reference symbol $H_{mn}(\omega)$ depicts the transfer function from the speaker position m to the ear n, reference symbol $\omega$ depicts an angular frequency of $2\Pi f$, and reference symbol f depicts a frequency.

FIG. 6 shows an example of control data of the control signals stored in the table in the memory 35. The control data are supplied to the control apparatus shown in FIGS. 7 and 8. Specifically, the difference in time between the sounds respectively obtained at both ears, $\Delta T_{IJ}(\theta)$, and the difference in level bet-ween the sounds respectively obtained at both ears, $\Delta L_{IJ}(\theta)$, are recorded in the table of the control signals stored in the memory 35 (where IJ=LL, LR, RL, RR . . . ). These control signals are supplied to the above-mentioned control apparatus 50 through 54 and 56.

Each of the control apparatus 50 through 54 and 56 may be formed by combining the variable delay apparatus and the variable level controller or the level controller for controlling the level in every frequency band, such as the graphic equalizer having a number of divided bands or the like. Information stored in the memory 35 may be an impulse response representing differences in time, level and so on between sounds obtained at both ears from the virtual sound source positions in the direction in which the listener 23 turns the head with respect to the reference direction of the head to both of the ears. Contents stored in the memory 35 have data structure corresponding to the control apparatus 50 through 54 and 56. In this case, each of the above-mentioned control apparatus 50 through 54 and 56 may be formed of an IIR or FIR variable digital filter.

The speakers may be used as the sound sources used for measuring the control signals representing the difference in time between the sounds obtained at the respective ears and the difference in level therebetween. Positions where sound waves are picked up in the respective ears of the listener 23 may be anywhere from the inlets of the external auditory canals thereof to the ear drums thereof.

However, the positions should be equal to positions used to calculate characteristics of correction for canceling the characteristics inherent in the headphone to be used.

On the assumption of the above-mentioned impulse responses, each of the digitally recorded impulse responses obtained when an angle $\theta$ is changed by a unit angle, e.g., 2° is written in an address of the table of the memory 35. The unit angle is set to be every angle through which the listener 23 can perceive with the left and right ears when he turns the head.

The memory 35 includes three sets of such tables, each of the sets having different data values depending upon a relative positional relationship such as a distance between the screen of the video signal reproducing apparatus 62 and the listener 23, an angle made thereby, the screen size of the screen of the video signal reproducing apparatus 62 and so on. An optimum set of the three sets of tables is selected by switching an address of the address control circuit 34 by switching the switcher 36 thereof.

In FIGS. 1, 7 and 8, reference numeral 37 depicts a center reset switch. When the center reset switch 37 is turned on, values of the up/down counter 33 are reset to "all 0". At this time, an address $\theta$=0 is selected in the table of the memories 6, 8, 10, 12 and 35. Specifically, when the center reset switch 37 is turned on, the direction in which the listener 23 turns the head at present is set to be the forward direction toward the sound sources.

The audio reproduction apparatus according to this embodiment are arranged as described above and operates as follows. Specifically, digital audio signals from the multichannel digital stereophonic signal source 1 or digital audio signals which are converted by the A/D converters 3 from analog signals input to the multichannel analog stereophonic signal source 2 are selected by the switcher 4. In case of the arrangement shown in FIG. 1, the digital signal series, together with the impulse responses read out from the memory 35, are subjected to convolution integral by the convolution integrators 5, 7, 9 and 11 and the memories 6, 8, 10 and 12 in a real-time fashion, and then supplied to the adders 15, 16.

In the arrangement shown in FIG. 7, the digitized audio signals in respective channels previously subjected to convolution integral with the impulse responses by the convolution integrators 5, 7, 9 and 11 and the memories 6, 8, 10 and 12 are corrected and changed by the control apparatus 50, 51, 52 and 53 based on the control signals read from the memory 35, and supplied to the adders 15, 16.

In the arrangement shown in FIG. 8, the two-channel digital signals from the adders 15, 16 are corrected and changed by the control apparatus 54, 56 based on the control signals read from the memory 35. The two-channel digital signals are converted by the D/A converters 19, 20 into the analog signals which are amplified by the power amplifiers 21, 22 and then supplied to the headphone 24.

Thus, the listener 23 wearing the headphone 24 can listen to sounds reproduced from the audio signals. The movement of the head of the listener 23 with respect to the reference direction at every constant or predetermined angle is detected by the digital output vibratory gyroscope 28 and the analog output vibratory gyroscope 30 and converted by the address control circuit 34 into the digital address signal representing the magnitude of the movement including its direction.

The digitally recorded impulse responses or control signals from the virtual sound source positions with respect to the reference direction of the head to both the ears are read from the memory 35 in response to the digital address signal. The convolution integrators 5, 7, 9 and 11 and the memories 6, 8, 10 and 12 or the control apparatus 50, 51, 52, 53, 54 and 56 correct and change the audio signals with the impulse responses or the control signals in a real-time fashion.

The signals are converted by the convolution integrators 5, 7, 9 and 11, the memories 6, 8, 10 and 12 or the control apparatus 50, 51, 52, 53, 54 and 56 and the address 15, 16 into the two-channel digital signals which have spatial information representing the sound field and are supplied to both the ears. The two-channel digital signals are corrected by the correcting circuits 17, 18 with respect to the characteristics of the headphones and sound sources that are used. Then, the two-channel digital signals are amplified by the power amplifiers 21, 22 and supplied to the headphone 24. Thus, it is possible to achieve a reproduction effect in which the listener perceives as if he listened to reproduced sounds from the speakers located in the virtual sound source positions.

While FIGS. 1, 7 and 8 show only arrangements used when a single listener 23 listens to the reproduced sounds, if a plurality of listeners 23 listen to the reproduced sound, then stages succeeding the convolution integrators 5, 7, 9 and 11 shown in FIG. 7 may be branched off by terminals or stages succeeding the address 15, 16 may be branched off by terminals.

In these cases, it is sufficient that the signals are processed in response to the gyration of the head of each listener after corrected and converted by the convolution integrators 5, 7, 9 and 11 and the memories 6, 8, 10 and 12 into the digital signals having the spatial information. Therefore, it is unnecessary to prepare the expensive A/D converters 3 and the convolution integrators 5, 7, 9 and 11 which are as many as the number of the listeners.

Thus, it is sufficient to prepare the headphones 24, the digital angle detectors 28, the signal processing circuits 31 to 35 for detecting angles and the control apparatus 50 to 53, 54 and 56 which are as many as the number of the listeners. It is possible to simultaneously supply the audio signal to a plurality of listeners with inexpensive costs.

In this case, when the listener 23 turns the head, the digital output vibratory gyroscope 28 or the analog output vibratory gyroscope 30 generates the digital signal or the analog signal in response to the direction of the movement of the head. Thus, the signal has a value in response to the direction of the head of the listener 23. The value is supplied through the address control circuit 34 as the address signal to the memory 35.

There are read from the memory 35 the digitally recorded impulse responses, corresponding to the direction of the head of the listener 23, from the virtual sound positions with respect to the reference direction of the head to both the ears among the data corresponding to those stored in the table shown in FIG. 4 or the control signals representing the difference in time between the sounds obtained at both the ears and the difference in level therebetween among the data shown in FIG. 6. The read data are supplied to the convolution integrators 5, 7, 9 and 11 and the memories 6, 8, 10 and 12 or the control apparatus 50, 51, 52, 53, 54 and 56.

When the analog angle detector 38 is used, the output therefrom is amplified by the amplifier 31, then integrated by the analog integrator 32, and converted by the A/D converter 33 into a digital signal in response to the direction of the head of the listener 23. The digital signal is supplied as the address signal through the address control circuit 34 to the memory 35. Similar to the processings of the signal from the digital angle detector 28, there are read from the memory the digitally recorded impulse responses, corresponding to the direction of the head of the listener 23, from the virtual sound positions with respect to the reference direction of the head to both the ears among the data corresponding to those stored in the table or the control signals representing the difference in time between the sounds obtained at the ears and the difference in level therebetween among the data shown in FIG. 6. The read data are supplied to the convolution integrators 5, 7, 9 and 11 and the memories 6, 8, 10 and 12 or the control apparatus 50, 51, 52, 53, 54 and 56.

The correcting circuits 17, 18 have one or both of the correction characteristics used to correct the characteristics inherent in the sound sources used in measurement of the impulse responses or the control signals and the correction characteristics used to correct the characteristics inherent in the headphone to be used. Accordingly, since the correcting circuits 17, 18 can carry out the digital signal processings including the above correction at once, they can carry out the signal processing in a real-time fashion.

Since, as described above, the audio signals L, R to be supplied to the headphone 24 are corrected by using the digitally recorded impulse responses from the virtual sound source positions corresponding to the head direction of the listener 23 with respect to the reference direction of the head to both the ears or the control signals representing the difference in time between the sounds obtained at both the ears and the difference in level therebetween, it is possible to obtain the sound field which allows the listener to feel as if a plurality of speakers were located at the virtual sound source positions and the audio signals were reproduced thereby.

The control signals which are digitally recorded in the table of the memory 35 and represent the difference in time between the sounds obtained at both the ears and the difference in level therebetween are read out therefrom. Since the data of the control signals are purely electronically supplied to the control apparatus in order that the control apparatus 50, 51, 52 and 53 correct the digital signals previously convoluted by the convolution integrators 5, 7, 9 and 11 and the memories 6, 8, 10 and 12, the characteristics of the audio signals can be changed without delay after the listener turns the head. Therefore, the listener 23 is prevented from feeling unnatural.

At this time, reverberation signals generated by reverberation circuits 13, 14 are supplied to the headphone 24 so that such a spacial impression as is obtained in a listening room and a concert hall is added. Therefore, it is possible for the listener to perceive an excellent stereophonic sound field.

While the apparatus is directly connected to the headphone 24 through signal lines in the above-mentioned arrangements, the signals may be transmitted thereto in a wireless transmission by transmitting a signal from a modulator and a transmitter at a stage succeeding the adders 15, 16 and receiving the signal by a receiver and a demodulator.

In each of the above-mentioned arrangements, since a plurality of tables are prepared in the memory 35 and the listener 23 can optionally select one of the tables by using the switcher 36, it is possible to obtain the optimum characteristics regardless of the different shapes of the heads and auricles of the listeners 23 or the characteristics of the headphone 24 to be used.

If change amounts of the digitally recorded control signals representing the difference in time between the sounds obtained at both the ears and the difference in level therebetween obtained when the angle θ is changed are set to be larger or smaller than a standard value by setting a table, then amounts of positional changes of the sound images with respect to the head direction of the listener 23 are different from each other. Therefore, it is possible to change perception of distance from the listener 23 to the sound image and to set the perception in accordance with a screen size.

Since the reverberation signals generated by the reverberation circuits 13, 14 are added to the reproduced sounds and allows the listener to listen to the reproduced sounds as if the sounds were sounds reflected by a wall of a hall or a reverberation sounds, it is possible to obtain the presence which allows the listener to feel as if he listened to the music in a famous concert hall.

Figure 9:
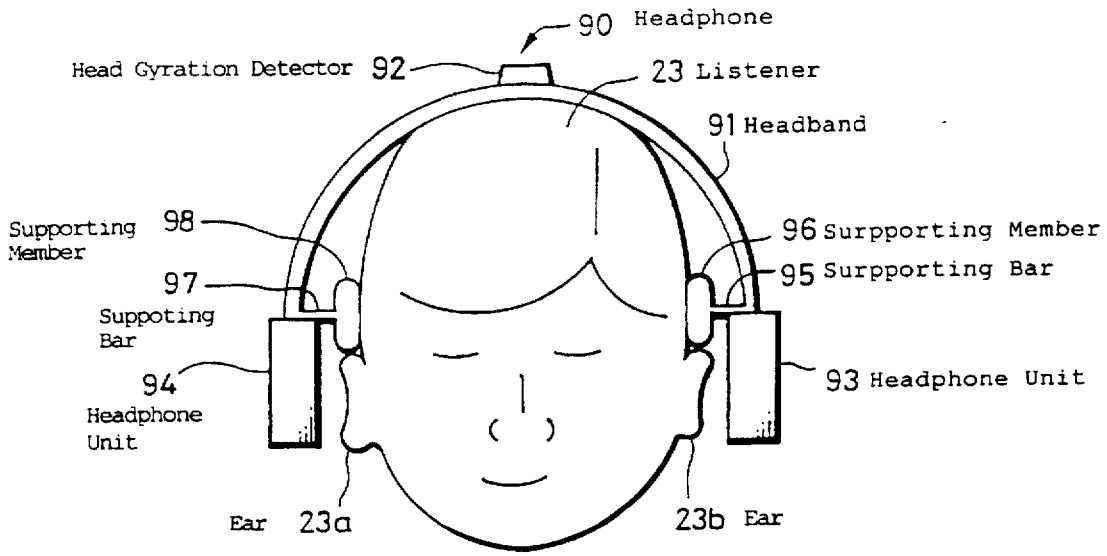
FIG. 9 is a diagram showing a headphone of the audio reproducing apparatus according to the embodiment of the present invention.

FIGS. 9 to 19 show an example of a headphone of the audio reproducing apparatus according to the embodiment of the present invention. FIG. 9 shows the headphone of the audio reproducing apparatus according to the embodiment of the present invention. In FIG. 9, a head gyration detecting unit 92 and headphone units 93, 94 are provided at a headband 91 of a headphone 90. Supporting members 96, 98 are provided in the vicinity of attaching positions of the headphone units 93, 94 to the headband 91, and on the inner sides thereof to be projected from supporting bars 95, 97. With this arrangement, the headphone units 93, 94 can be mounted on the listener 23 at positions away from the ears 23*a*, 23*b* of the listener 23 at a predetermined distance.

According to the above arrangement, since the supporting bars 95, 97 and the supporting members 96, 98 as supporting members provided at the headband 91 as a head mount body of the headphone 90 as audio reproducing means prevent the headphone units 93, 94 as sound generating units from pressing the ears 23*a*, 23*b* of the listener 23 and sound generating characteristics of the headphone units 93, 94 are set approximate to characteristics obtained when the audio signals are picked up, a radiation impedance from inlets of the external auditory canals to the outside is approximate to that obtained when the listener does not put the headphone on the head. Therefore, it is possible to facilitate localization of a reproduced sound image and it is possible for the listener to feel more comfortable when putting the headphone on the head.

Figure 10:
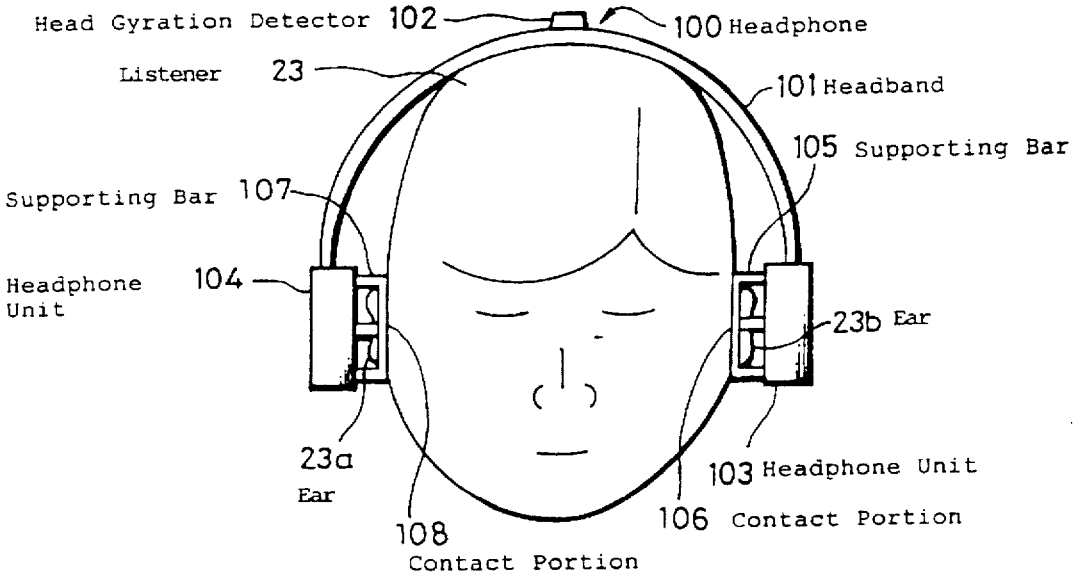
FIG. 10 is a diagram showing the headphone of the audio reproducing apparatus according to the embodiment of the present invention.

FIG. 10 shows the headphone of the audio reproducing apparatus according to the embodiment of the present invention. In FIG. 10, a head gyration detecting unit 102 and headphone units 103, 104 are provided at a headband 101 of a headphone 100. Contact portions 106, 108 are provided inside the headphone units 103, 104 so as to be projected from supporting bars 105, 107. With this arrangement, the listener 23 can put the headphone on the head with the headphone units 103, 104 being placed at positions away from the ears 23*a*, 23*b* of the listener 23 at a predetermined distance.

Figure 11:
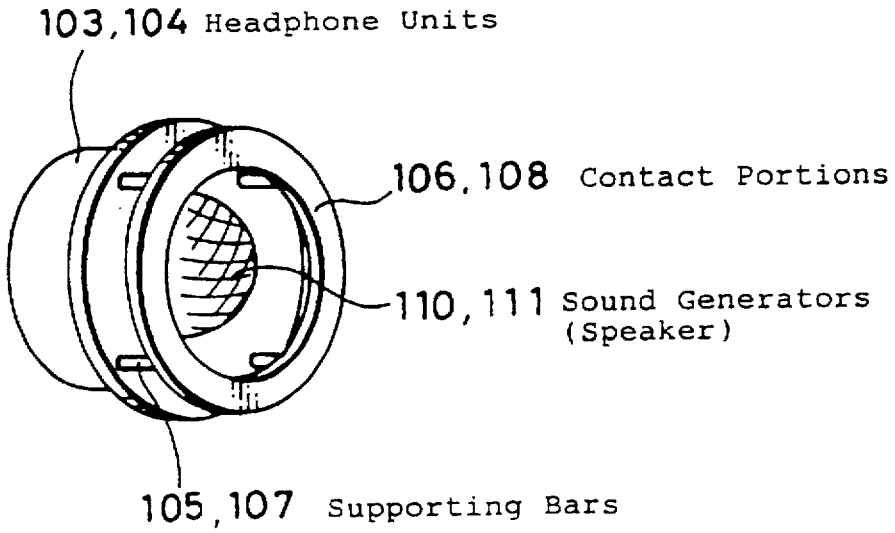
FIG. 11 is a diagram showing an arrangement of a headphone unit of the audio reproducing apparatus according to the embodiment of the present invention.

In this case, as shown in FIG. 11, the contact portions 106, 108 are arranged to be circular-shaped. The ears 23*a*, 23*b* of the listener 23 are put in hollow portions of the contact portions and opposed to sound generating units ( speakers) 110, 111. With this arrangement, the contact portions 106, 108 press the listener 23 at the temple portions and the headphone units 93, 94 are worn by the listener 23 with being placed at positions away from the ears 23*a*, 23*b* of the listener at a predetermined distance. It is needless to say that the contact portions 106, 108 are not limited to the circular-shaped ones and may be oval-shaped or the like.

According to the above arrangement, since the supporting bars 105, 107 and the supporting bodies 106, 108 as the supporting members provided at the headband 101 as the head mount body of the headphone 100 as the audio reproducing means prevent the headphone units 103, 104 as the sound generating units from pressing the ears 23*a*, 23*b* of the listener 23 and the sound generating characteristics of the headphone units 103, 104 are set approximate to characteristics obtained when the audio signals are picked up, the radiation impedance from the inlets of the external auditory canals thereof to the outside becomes approximate to that obtained when the listener does not put the headphone on the head. Therefore, it is possible to facilitate the localization of the reproduced sound image and it is possible for the listener to feel more comfortable when putting the headphone on the head.

Figure 12A:
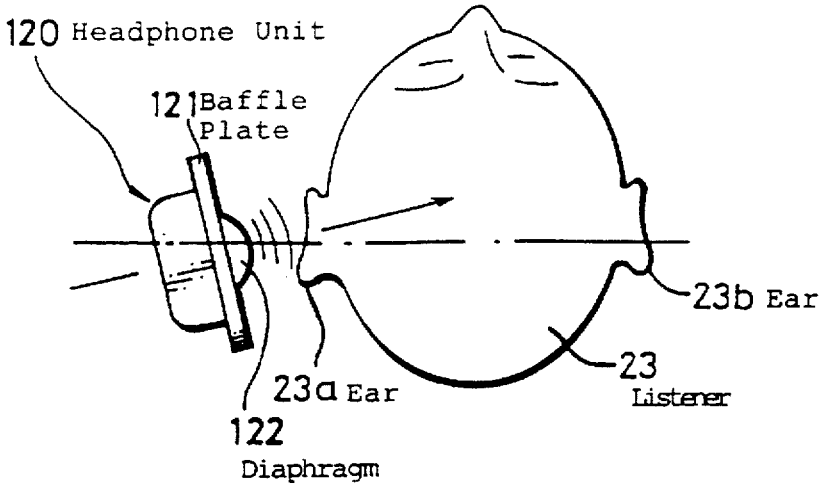
FIG. 12 is a diagram showing an arrangement in which the headphone unit can be moved in the forward and backward directions in the audio reproducing apparatus according to the embodiment of the present invention.

FIG. 12 shows an arrangement in which the headphone units as the sound generating units can be moved in the forward and backward directions in the audio reproducing apparatus according to the embodiment of the present invention. FIG. 12A shows an arrangement in which an angle of a plane of a baffle plate 121 as a fixed portion of a headphone unit 120 and a diaphragm 122 as a vibrating unit of a sound generating unit relative to a straight line passing through ears 23*a*, 23*b* of the listener 23 is set to not a right angle but an angle at which the plane is inclined forward. This arrangement reduces the influence of such an unnecessary reflection that a sound wave once radiated from the diaphragm 122 is reflected by an auricle portion of the ear 23*a* and further reflected by the baffle plate 121 and the diaphragm 122. Moreover, it becomes easy for an external sound from a forward side to arrive at the ear. In this case, it becomes easy to localize the sound image in front of the listener.

Figure 12B:
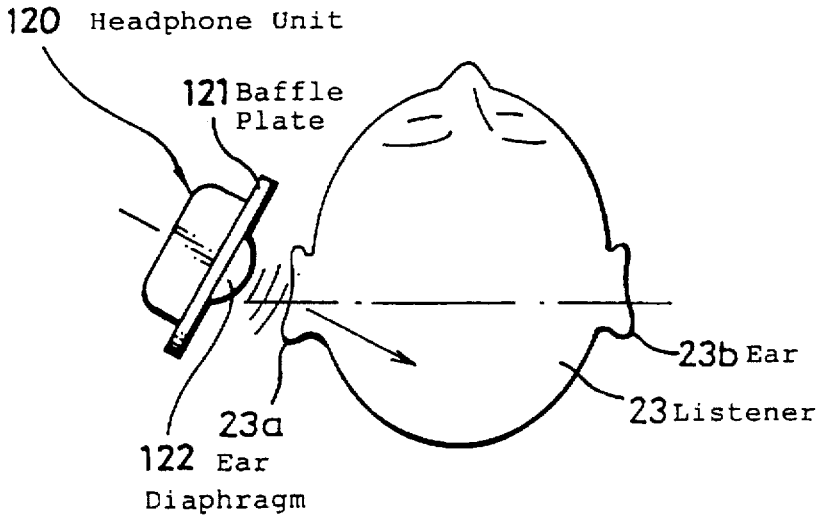

FIG. 12B shows an arrangement in which an angle of the plane of the baffle plate 121 as the fixed portion of the headphone unit 120 and the diaphragm 122 as the vibrating unit of the sound generating unit relative to the straight line passing through the ears 23*a*, 23*b* of the listener 23 is set to not a right angle but an angle at which the plane is inclined backward. This arrangement is clearly effective particularly in localization of the sound image in front of the listener and reduces the influence of such an unnecessary reflection that the sound wave once radiated from the diaphragm 122 is reflected by the auricle portion of the ear 23*a* and further reflected by the baffle plate 121 and the diaphragm 122. Moreover, it becomes easy for an external sound from a backward side to arrive at the left ear 23*a*.

Figure 12C:
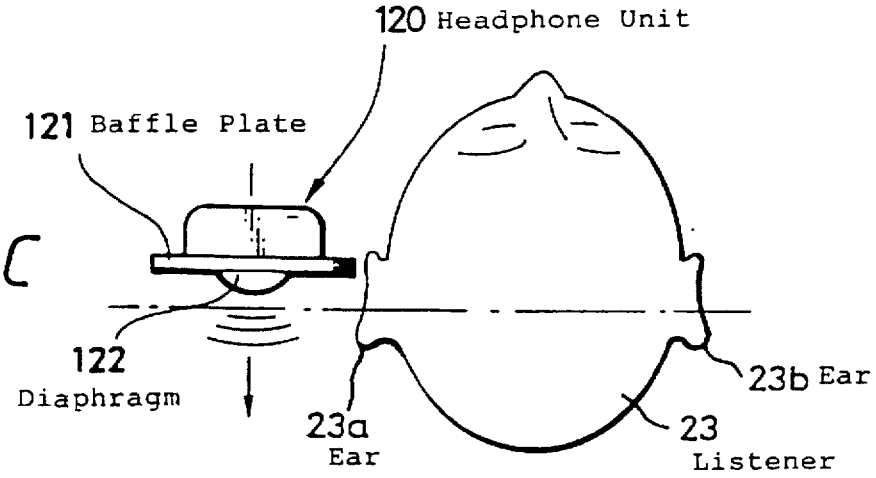

FIG. 12C shows an arrangement in which an angle of the plane of the baffle plate 121 as the fixed portion of the headphone unit 120 and the diaphragm 122 as the vibrating unit of the sound generating unit relative to the straight line passing through the t ears 23*a*, 23*b* of the listener 23 is set to an angle of 0°. This arrangement reduces the influence of such an unnecessary reflection that the sound wave once radiated from the diaphragm 122 is reflected by the auricle portion of the ear 23*a* and further reflected by the baffle plate 121 and the diaphragm 122. Moreover, it becomes easy for an external sound from a backward side to arrive at the left ear 23*a*.

According to the above arrangements, since the headphone unit 120 as the sound generating unit is disposed so as to be opposed to each of the left and right ears 23*a*, 23*b* of the listener 23 and the plane of the headphone unit 120 opposing to each of the left and right ears 23*a*, 23*b* of the listener 23 is provided with being inclined at a predetermined angle in the forward or backward direction so as not to be at the right angle relative to the straight line passing through centers of both the left and right ears 23*a*, 23*b* of the listener 23, it is possible to reduce the sound wave supplied from the diaphragm 122 of the headphone unit 120 and reflected by the ear 23*a* of the listener 23 and a side portion of the head thereof and to emphasize the sound wave arriving from a direction in which the plane of the headphone unit is inclined. Particularly if the plane of the headphone unit is inclined backward, then it is possible to facilitate the localization of the sound image in front of the listener. If the plane of the headphone unit is inclined forward, then the sound wave reflected by the auricle portion is reduced. Therefore, it is possible to facilitate the correction and to pick up the sound of an external field in front of the listener.

FIG. 13 shows arrangements in which a headphone unit as a sound generating unit of the audio reproducing apparatus according to the embodiment of the present invention can be moved in the vertical direction. FIG. 13A shows an arrangement in which an angle of a plane of a baffle plate 131 as a fixed portion of a headphone unit 130 and a diaphragm 132 as a vibrating unit of a sound generating unit relative to a straight line passing the ears 23*a*, 23*b* of the listener 23 is set to not a right angle but an angle at which the plane is inclined in the diagonally downward direction.

Figure 13A:
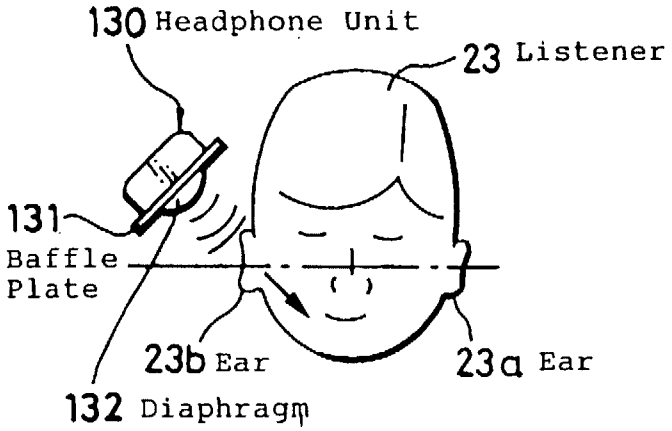
FIG. 13 is a diagram showing an arrangement in which the headphone unit can be moved in the upward and downward directions in the audio reproducing apparatus according to the embodiment of the present invention.
Figure 13B:
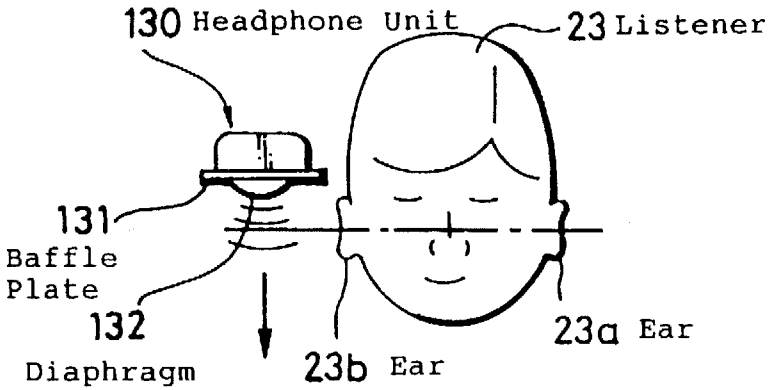

FIG. 13B shows an arrangement in which the angle of the plane of the baffle plate 131 as the fixed portion of the headphone unit 130 and the diaphragm 132 as the vibrating unit of the sound generating unit relative to the straight line passing through the ears 23*a*, 23*b* of the listener 23 is set to an angle of 0° and the plane is faced downward.

Figure 13C:
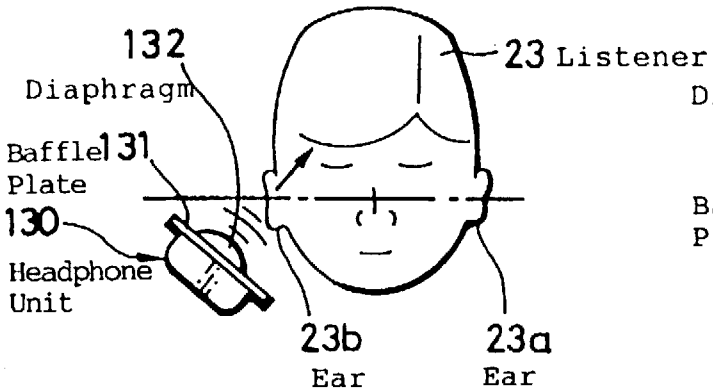

FIG. 13C shows an arrangement in which the angle of the plane of the baffle plate 131 as the fixed portion of the headphone unit 130 and the diaphragm 132 as the vibrating unit of the sound generating unit relative to the straight line passing through the ears 23*a*, 23*b* of the listener 23 is set to not the right angle but an angle at which the plane is inclined in the diagonally upward direction.

Figure 13D:
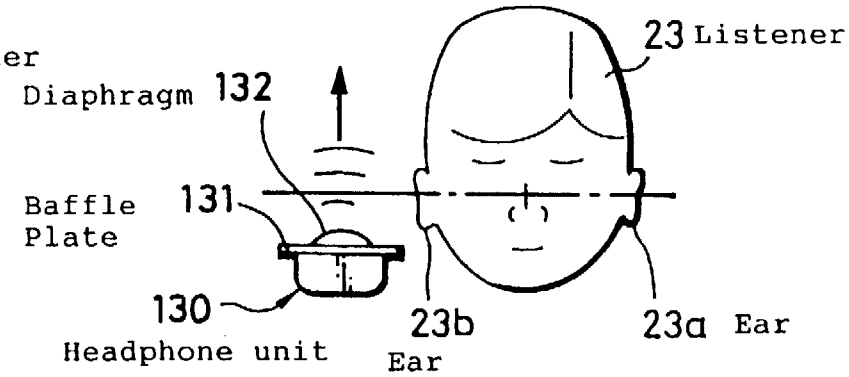

FIG. 13D shows an arrangement in which the angle of the plane of the baffle plate 131 as the fixed portion of the headphone unit 130 and the diaphragm 132 as the vibrating unit of the sound generating unit relative to the straight line passing through the ears 23*a*, 23*b* of the listener 23 is set to an angle of 0 and the plane is faced upward.

According to the above arrangements, since the headphone unit 130 as the sound generating unit is disposed so as to be opposed to each of the left and right ears 23*a*, 23*b* of the listener 23 and the plane of the baffle plate 131 and the diaphragm 132 opposing to each of the left and right ears 23*a*, 23*b* of the listener 23 is provided with being inclined at a predetermined angle in the upward or downward direction so as not to be at the right angle relative to the straight line passing through the centers of both left and right ears 23*a*, 23*b* of the listener 23, it is possible to reduce the sound wave supplied from the diaphragm 132 and reflected by the ear 23*b* of the listener 23 and the side portion of the head thereof and to emphasize the sound wave arriving from a direction in which the plane of the headphone unit is inclined.

Figure 14:
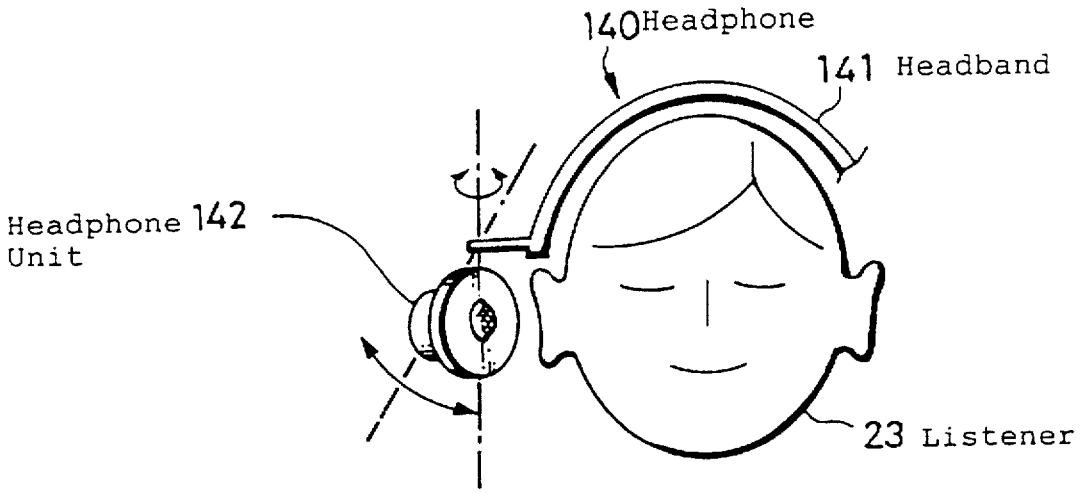
FIG. 14 is a diagram showing an arrangement in which the headphone unit can be adjusted at an optional angle in the audio reproducing apparatus according to the embodiment of the present invention.
Figure 15:
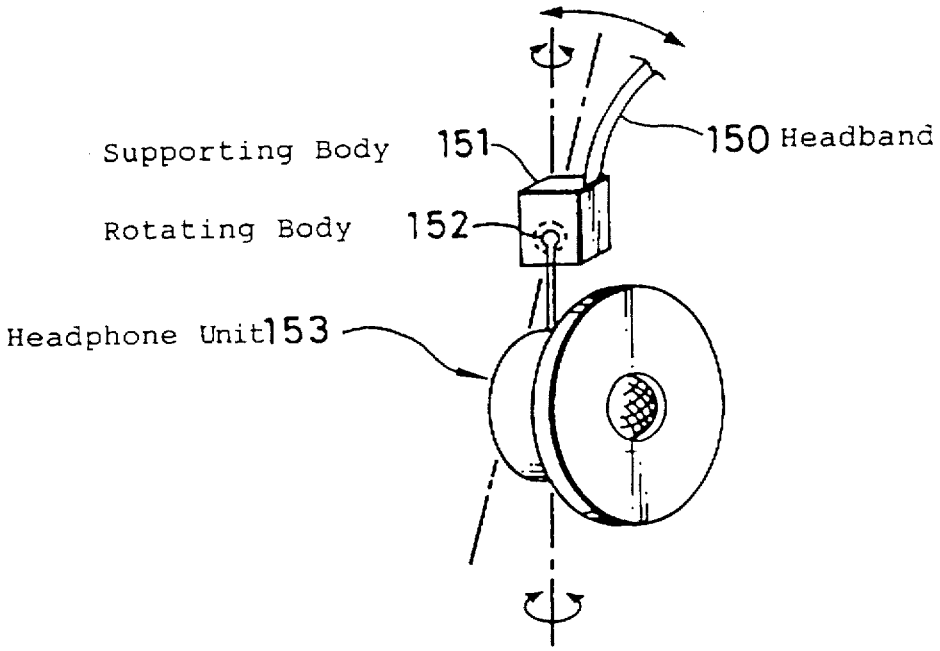
FIG. 15 is a diagram showing an arrangement in which the headphone unit can be adjusted at an optional angle in the audio reproducing apparatus according to the embodiment of the present invention.

FIG. 14 shows an arrangement in which a headphone unit as a sound generating unit of the audio reproducing apparatus according to the embodiment of the present invention can be adjusted to be rotated at an arbitrary angle. In this arrangement, a headphone unit 142 can be adjusted so as to be rotated at an arbitrary angle relative to a headband 141 of the headphone 140. In this case, as shown in FIG. 15, a headphone unit 153 can be rotated relative to a supporting body 151 provided at an end portion of a headband 150 with a rotating body 152 being slidably in contact with a hollow portion, whose inner side has a spherical shape, of the supporting body.

Figure 16A:
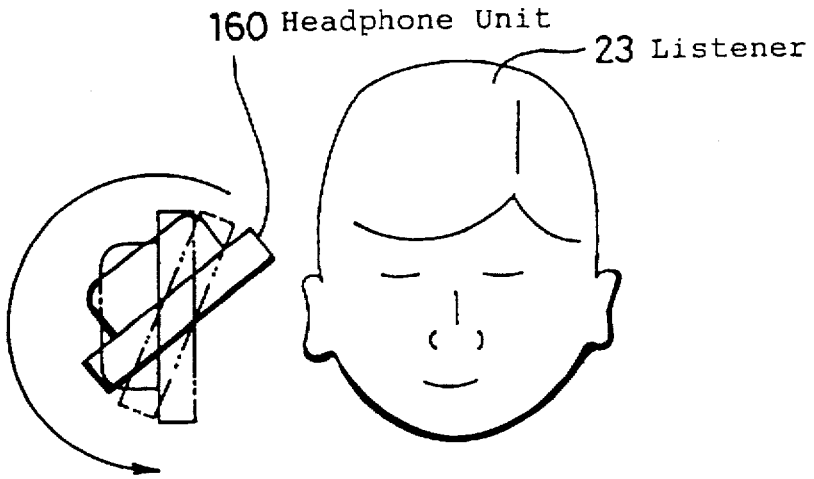
FIG. 16 is a diagram used to explain operation of the arrangement in which the headphone unit can be adjusted at an optional angle in the audio reproducing apparatus according to the embodiment of the present invention.
Figure 16B:
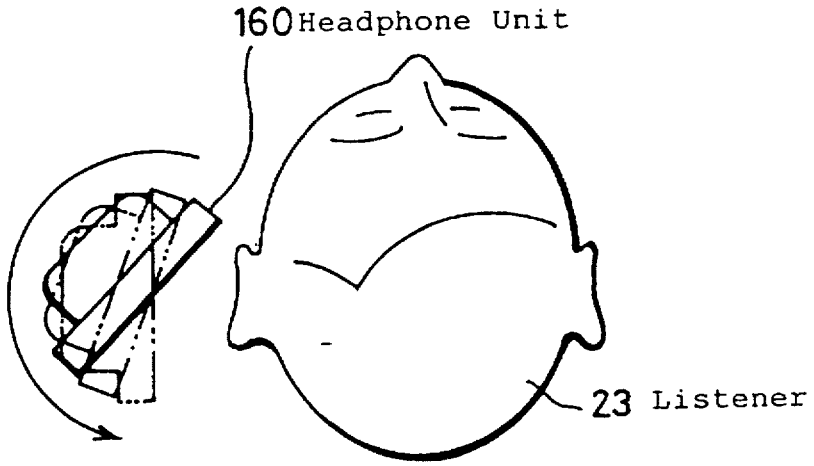

This arrangement allows a headphone unit 160 to be rotated in the vertical direction relative to the listener 23 as shown in FIG. 16A and allows the headphone unit 160 to be rotated in the forward and backward direction relative to the listener 23 as shown in FIG. 16B.

According to the above arrangements, since each of the headphone units 140, 150 and 160 as the sound generating units is disposed so as to be opposed to each of the left and right ears 23*a*, 23*b* of the listener 23 and the planes of the headphone units 140, 150 and 160 opposing to the left and right ears 23*a*, 23*b* of the listener 23 can be inclined at an arbitrary angle relative to the straight line passing through the centers of both left and right ears 23*a*, 23*b* of the listener 23, it is possible to reduce the sound waves supplied from the headphone units 140, 150 and 160 and reflected by the ear of the listener 23 and the side portion of the head thereof and to emphasize the sound wave arriving from a direction toward which the plane of the headphone unit is inclined. Moreover, it is possible to avoid an influence caused by difference among shapes of the auricles of the listeners 23 and so on.

Figure 17A:
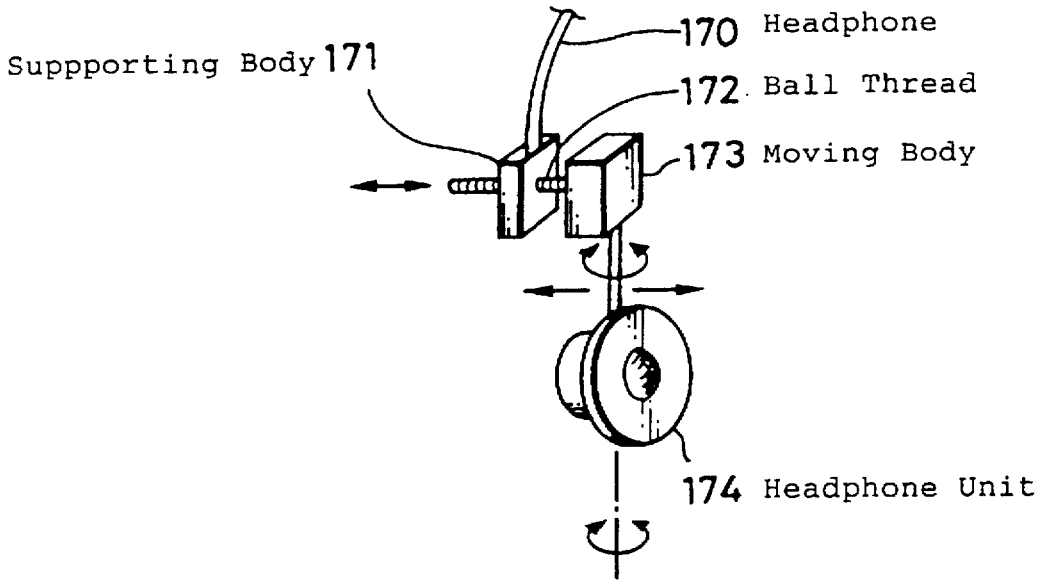
FIG. 17 is a diagram showing an arrangement in which the headphone unit can be moved in the horizontal direction in the audio reproducing apparatus according to the embodiment of the present invention.
Figure 17B:
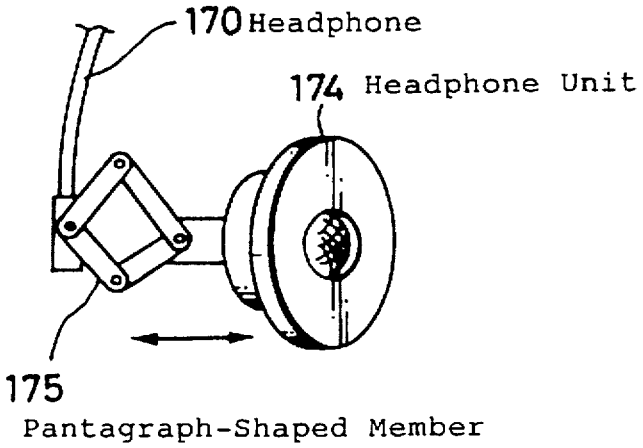

FIG. 17 shows an arrangement in which a headphone unit as a sound generating unit of the audio reproducing apparatus according to the embodiment of the present invention can be moved in the horizontal direction. FIG. 17A shows an arrangement in which a headphone unit 174 provided at a moving body 173 can be moved in the horizontal direction by a ball thread 172 provided at a supporting body 171 provided at an end portion of a headband 170. FIG. 17B shows an arrangement in which an end portion of a pantagraph-shaped member 175 is provided at the end portion of the headband 170 and the headphone unit 174 provided at the other end portion of the pantagraph-shaped member can be moved in the horizontal direction by an operation of extending or contracting the pantagraph-shaped member 175.

According to the above arrangements, it is possible to move the plane of the headphone unit 170 as the sound generating unit opposed to each of the left and right ears 23*a*, 23*b* of the listener 23 close to or away from each of the left and right ears 23*a*, 23*b* of the listener 23. Therefore, it is possible to avoid the influence caused by the difference among the shapes of the auricles of the individual listeners 23 and so on.

Figure 18A:
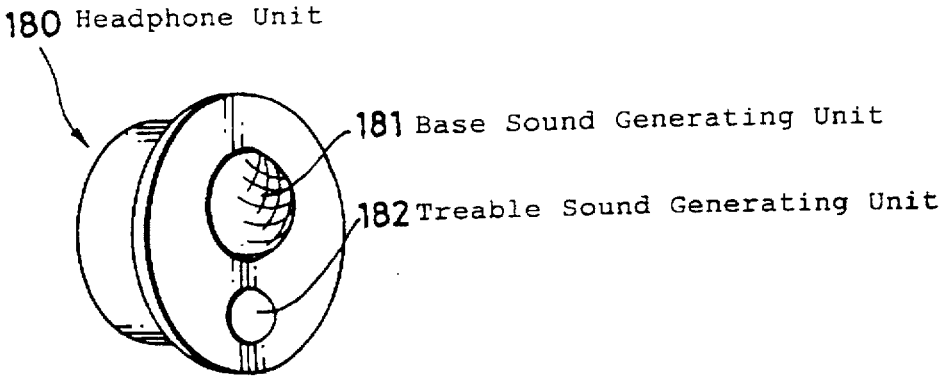
FIG. 18 is a diagram showing an arrangement in which the headphone unit is formed of a plurality of units in the audio reproducing apparatus according to the embodiment of the present invention.
Figure 18B:
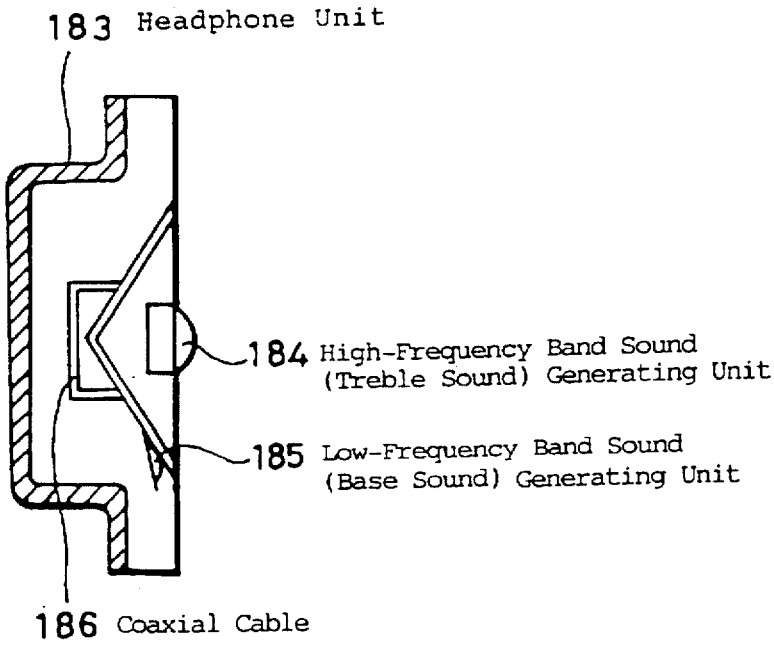

FIG. 18 shows arrangements in which a headphone unit as a sound generating unit of the audio reproducing apparatus according to the embodiment of the present invention is formed of a plurality of units. FIG. 18A shows an arrangement in which a headphone unit 180 is formed of a bass sound generator unit 181 and a treble sound generator unit 182 as sound generators. FIG. 18B shows an arrangement in which a headphone unit 183 is formed of a low-frequency band sound (bass sound) generator unit 185 and a high-frequency band sound (treble sound) generator unit 184 as a sound generator which is provided on the former and audio signals are supplied through a coaxial cable 186.

According to the above arrangements, a band of an audio signal is divided into a plurality of bands, each of the headphone units 180, 183 has a plurality of sound generating units 181, 182 and 184, 185 corresponding to a plurality of divided bands, and the plurality of sound generator units 181, 182 and 184, 185 emanate the sounds. Therefore, it is possible to clarify the characteristics of the audio signals and to correct the audio signals easily.

Figure 19:
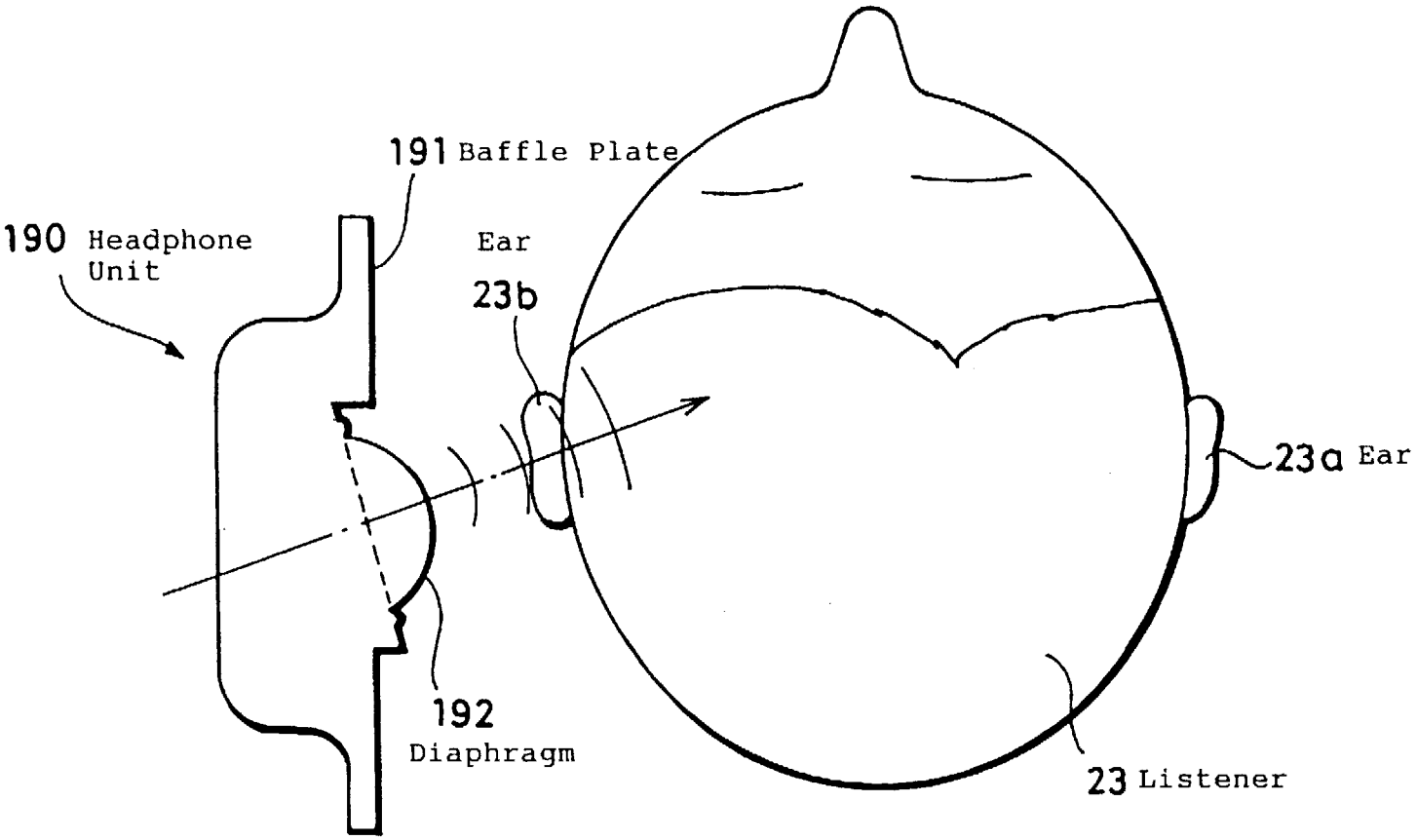
FIG. 19 is a diagram showing an arrangement in which angles of a baffle plate and a diaphragm are changed in the audio reproducing apparatus according to the embodiment of the present invention.

FIG. 19 shows an arrangement in which an angle made by a baffle plate and a diaphragm of a headphone unit as a sound generating unit of the audio reproducing apparatus according to the embodiment of the present invention is changed. In this case, an angle of a plane of a baffle plate 191 as a fixed portion of a headphone unit 190 relative to the straight line passing through the ears 23*a*, 23*b* of the listener 23 is set to a right angle and an angle of a plane of a diaphragm 192, which is a sound generating unit as a vibrating unit of the headphone unit 190, relative to the above straight line is set to not the right angle but an angle at which the plane of the diaphragm is inclined.

According to the above arrangement, since the diaphragm 192 is provided so as to be inclined relative to the baffle plate 191 attached to the headphone unit 190 as the sound generating unit and an angle of inclination of the diaphragm 192 is changed, it is possible to reduce the sound wave supplied from the diaphragm 192 and reflected by the ear 23*b* of the listener 23 and the side portion of the head thereof and to change an effect of picking up the sound.

Further, data shown in FIG. 4 can be obtained as follows. Specifically, impulse sound sources and dummy-head microphones of necessary channel number are disposed at predetermined positions in a suitable room such that a preferable reproduced sound field should be obtained when the sound is reproduced by the headphone 24. In this case, the speakers may be used as sound sources used to measure the impulses.

Positions where sound waves are picked up in each of the ears of the dummy head may be anywhere from the inlets of the external auditory canal thereof to the eardrum thereof. However, the positions should be equal to the positions used to obtain the correction characteristics for canceling the characteristics inherent in the headphone to be used.

The control signals can be measured by radiating impulse sounds from the speakers in the respective channels and picking up the radiated impulse sounds with microphones provided in the ears of the dummy head at every constant angle $\Delta\theta$. Accordingly, since one set of impulse responses is obtained per channel at a certain angle θ1, if the signal sources has five channels, then five sets of control signals, i.e., ten control signals can be obtained per angle. Accordingly, the control signals representing the difference in time between the sounds obtained at the left and right ears and the difference in level therebetween are obtained from the impulse responses.

The correction characteristics for canceling the characteristics inherent in the headphone which is used are calculated in such a manner that the same dummy-head microphones as those used to obtain impulse responses of a sound field are used, headphones to be used are mounted on the dummy head, and impulse responses having inverted characteristics of impulse responses between the microphones in the respective ears of the dummy head are calculated from inputs from the headphone.

Alternatively, the correction characteristics may be directly calculated by using adaptive processings such as an LMS algorithm or the like. Specific correction of characteristics inherent in the headphone can be realized by either subjecting the digital audio signals to the convolution integral with the impulse responses representing the calculated correction characteristics in view of a processing in a time domain or filtering the analog signal obtained by the D/A conversion by an analog filter having inverted characteristics in view of an analog signal processing at any time from a time when the audio signals are input to a time when the audio signals are supplied to the headphone.

While only the direction of the head of the listener 23 in a horizontal plane is described in the above-mentioned arrangements, the directions thereof in a vertical plane and planes perpendicular to both the vertical and horizontal planes can be processed similarly.

Even if one set of the tables in the memory 35 is prepared and designation of the addresses in the table is changed by the address control circuit 34, the control data can be obtained similarly to a case where the memory has plural sets of tables.

The data stored in the table may be limited to a range of a general direction of the head of the listener 23. The angle θ may be changed at different intervals depending upon the direction of the head such that the angle θ is set to be changed at an interval of 0.5° in the vicinity of θ=0 and to be changed at an interval of 3° in the range of $|\theta \geqq 45°|$. As described above, the angle may be set to be the angle through which the listener can perceive that he turns the head. Moreover, speakers disposed near the respective ears of the listener 23 may be substituted for the headphone 24.

In each of the above-mentioned arrangements, the input audio signals may be digitally recorded signals or signals recorded in an analog fashion both of which are picked up in a multichannel stereophonic mode or the like. The angle detection means for detecting the movement of the head of the listener 23 may output a digital signal or an analog signal.

When the characteristics of audio signals supplied to the headphone 24 are changed in synchronism with the movement of the head of the listener 23, the characteristics are changed not continuously in response to the movement of the head of the listener 23 but by reading data from the tables of the memory 35 at either of every constant unit angle and every predetermined angle which are necessary and sufficient for human beings to recognize in accordance with human auditory characteristics. Therefore, the same effect as that achieved when the characteristics of the audio signals are continuously changed can be achieved only by calculation with respect to necessary and sufficient changes in the movement of the head of the listener 23. Accordingly, the storage capacity of the memory 35 can be saved and highspeed calculations more than required becomes unnecessary in view of a processing speed of calculations.

Since binaural characteristics from fixed sound sources in the fixed direction are constantly obtained regardless of the gyration of the head of the listener 23, the listener obtains a highly natural localization.

Since the digital signals previously subjected to the convolution integral with the impulse responses by the convolution integrators 5, 7, 9 and 11 and the memories 6, 8, 10 and 12 are controlled by purely electronic correction using the characteristics represented by the digitally recorded control signals representing the difference in time between the sounds obtained at the respective ears and the difference in level therebetween, the characteristics are prevented from being largely deteriorated. Since the characteristics of the audio signals are changed without delay after the listener turns the head, the listener is prevented from feeling such unnaturalness as he feels when using a conventional system.

Since a plurality of tables are prepared in the memory 35 and the listener 23 can optionally select one of them by using the switcher 36, it is possible to obtain the optimum characteristics regardless of the different shapes of the heads and auricles of the listeners 23, the different characteristics of the headphone 24 and so on.

Since the change amounts of the control signals representing the difference in time between the sounds obtained at the respective ears and the difference in level therebetween obtained when the angle θ is changed are set to be larger or smaller than the standard value depending upon the tables, then amounts of positional changes of the sound images with respect to the head direction of the listener 23 are different from each other. Therefore, it is possible to change perception of distance from the listener 23 to the sound image.

Since the suitable reverberation signals generated by the reverberation circuits 13, 14 are added to the reproduced sounds if necessary, it is possible to obtain the presence which allows the listener to feel as if he listened to the music in a famous concert hall.

According to the embodiment, since the signals are corrected in response to the respective gyrations of the head of a plurality of listeners 23 by using the control signals representing the difference in time between the sounds obtained at the respective ears and the difference in level therebetween, the signals can be reproduced by a plurality of headphones 24 simultaneously and it is unnecessary to prepare the expensive A/D converters 3 and the expensive convolution integrators 5, 7, 9 and 11 which are as many as the number of the listeners 23. Therefore, the apparatus can be arranged with considerably inexpensive costs.

In the above embodiment, the vibratory gyroscope may be used as the head gyration angle detector. With this arrangement, it is possible for a head gyration detection unit to be small and light, to have low consumption of power and long lifetime, and further to be easy to handle and inexpensive.

Moreover, since the vibratory gyroscope does not utilize an inertial force but is operated by a Coriolis force, it is unnecessary to dispose the vibratory gyroscope in the vicinity of the center of the gyration of the head of the listener 23 and hence the vibratory gyroscope may be attached to any portion of the gyration detection unit. Therefore, it is possible to simplify its arrangement and fabrication.

According to the present invention, since the supporting members provided in the head mount body of the audio reproducing means prevent the sound generating units from against the ears of the listener and the sound generating characteristics of the sound generating units are set approximate to the characteristics obtained when the audio signals are picked up, the radiation impedance from the inlets of the external auditory canals thereof to the outside becomes approximate to that obtained when the listener does not put the headphone on the head. Therefore, it is possible to facilitate the localization of the reproduced sound image and it is possible for the listener to feel more comfortable when putting the headphone on the head.

According to the present invention, since the sound generating units are disposed so as to be opposed to both the left and right ears of the listener and the plane of the sound generating unit opposing to each of the left and right ears of the listener is provided with being inclined at a predetermined angle in the forward or backward direction so as not to be at the right angle relative to the straight line passing through the centers of the left and right ears of the listener, it is possible to reduce the sound waves supplied from the sound generating units and reflected by the ears of the listener and the side portions of the head and to emphasize the sound wave arriving from the direction in which the plane of the sound generating unit is inclined. Particularly if the plane of the sound generating unit is inclined forward, then it is possible to localize the sound image behind the listener. If the plane of the sound generating unit is inclined backward, then the sound waves reflected by the auricle portions are reduced. Therefore, it is possible to facilitate the correction and to pick up the sound of the external field in front of the listener.

According to the present invention, since the sound generating units are disposed so as to be opposed to both the left and right ears of the listener and the plane of the sound generating unit opposing to each of the left and right ears of the listener is provided with being inclined at a predetermined angle in the upward or downward direction so as not to be at the right angle relative to the straight line passing through the centers of both left and right ears of the listener, it is possible to reduce the sound waves supplied from the sound generating units and reflected by the ears of the listener and the side portions of the head thereof and to emphasize the sound wave arriving from the direction in which the plane of the sound generating unit is inclined.

According to the present invention, since the sound generating units are disposed so as to be opposed to both the left and right ears of the listener and the plane of the sound generating unit opposing to each of the left and right ears of the listener can be inclined at an optional angle relative to the straight line passing through the centers of both left and right ears of the listener, it is possible to reduce the sound waves supplied from the sound generating units and reflected by the ears of the listener and the side portions of the head thereof and to emphasize the sound wave arriving from the direction in which the plane of the sound generating unit is inclined. Moreover, it is possible to avoid the influence caused by the difference among the shapes of the auricles of the individual listeners and so on.

According to the present invention, since it is possible to move the planes of the sound generating units corresponding to both the left and right ears of the listener close to or away from the left and right ears of the listener, it is possible to avoid the influence caused by the difference among the shapes of the auricles of the individual listeners and so on.

According to the present invention, since the band of the audio signal is divided into a plurality of bands, each of the sound generating units has a plurality of sound generator units corresponding to the plurality of divided bands, and the plurality of sound generator units emanate the sounds, it is possible to clarify the characteristics of the audio signals and to correct the audio signals easily. According to the present invention, the diaphragm is provided so as to be inclined relative to the baffle plate attached to the sound generating unit and an angle of inclination of the diaphragm is fixed or changed, so that it is possible to reduce the sound wave supplied from the diaphragm and reflected by the ears of the listener and the side portions of the head thereof and to change the effect of picking up the sound.

An audio reproducing apparatus according to another embodiment of the present invention will hereinafter be described in detail with reference to FIGS. 20 to 33.

According to the audio reproducing apparatus according to the embodiment of the present invention, when audio signals are reproduced by a headphone, the listener can perceive the localization, the sound field and so on equivalent to those perceived when the audio signals are reproduced by speakers located in a predetermined positional relationship in which the speakers should be located even when the audio signals are reproduced by the headphone. Particularly, sound generating units of the headphone which the listener wears on the head have opening portions and are disposed apart from the listener's ears to thereby cancel an unnecessary reflected wave. Thus, the localization is facilitated and audio signals are corrected so as to have reproduction characteristics approximate to the characteristics obtained when the sound is picked up.

Specifically, the audio reproducing apparatus according to the embodiment of the present invention is used in a system in which multichannel audio signals picked up in a stereophonic fashion or the like are reproduced by a headphone. Particularly, when digitized audio signals to be recorded in or transmitted to respective channels for localizing respective sound images in a predetermined positional relationship (e.g., at forward right, forward left and center of the listener and other positions) are reproduced through the headphone or the like, the sound generating units provided at optimum attachment positions of the headphone so as to be able to be inclined and having the opening portions enable the listener to feel more comfortable when putting the headphone on the head, clarify the characteristics of the headphone to thereby facilitate the correction, and enable the audio signals to be reproduced substantially in a state obtained when the listener does not put the headphone on the head.

The headphone according to the embodiment of the present invention is used in the audio reproducing apparatus shown in FIGS. 1 to 8. Arrangement and operation of the audio reproducing apparatus are the same as those of the above audio reproducing apparatus and hence need not be described in detail. Characteristic arrangement and operation of the audio reproducing apparatus according to the embodiment of the present invention will hereinafter be described.

Figure 20:
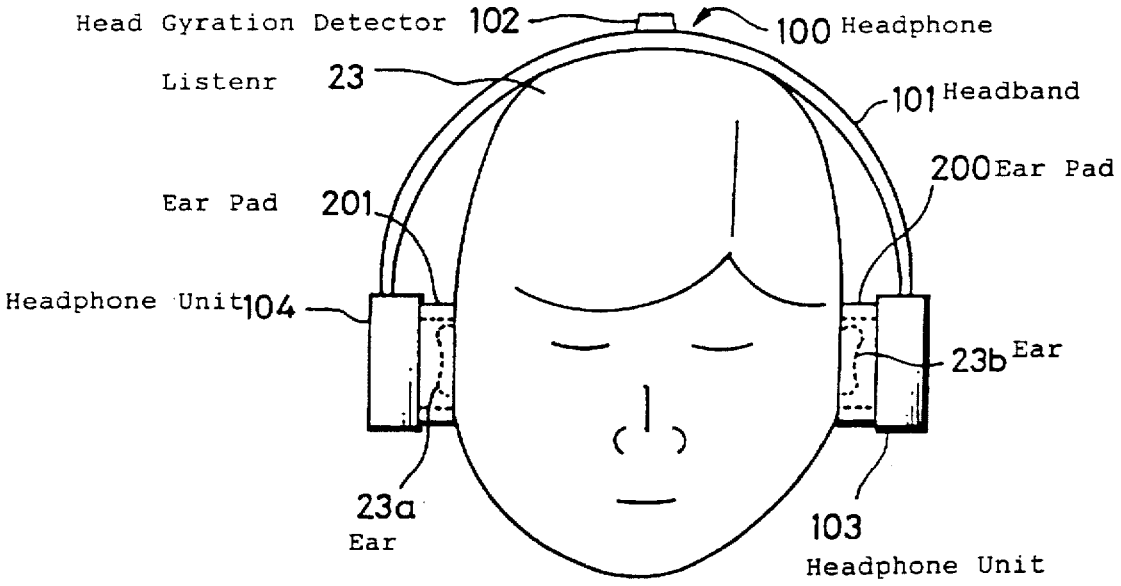
FIG. 20 is a diagram showing the headphone of the audio reproducing apparatus according to the embodiment of the present invention.

FIG. 20 shows a headphone of the audio reproducing apparatus according to the embodiment of the present invention. As shown in FIG. 20, the head gyration detecting unit 102 and the headphone units 103 and 104 are provided in the headband 101 of the headphone 100. Ring-shaped ear pads 200, 201 are provided on the inner sides of the headphone units 103, 104 so as to cover the ears 23*a*, 23*b*. With this arrangement, the listener 23 can put the headphone on the head with the headphone units 103, 104 being placed at positions away from the ears 23*a*, 23*b* of the listener 23 at a predetermined distance.

Figure 21:
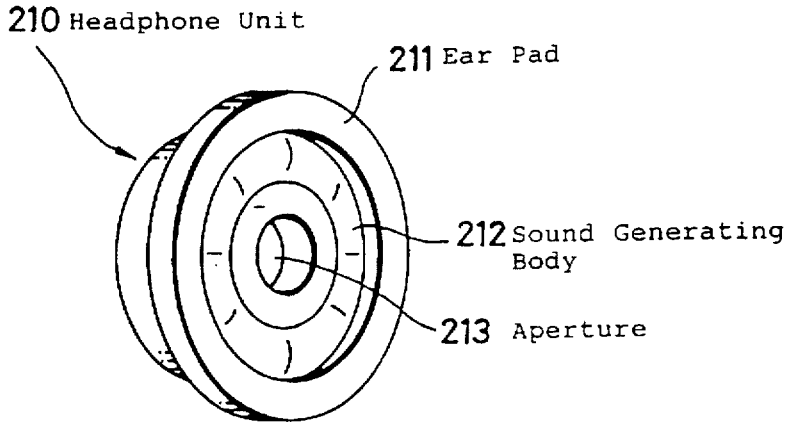
FIG. 21 is a perspective view showing an arrangement of the headphone unit of the audio reproducing apparatus according to the embodiment of the present invention.

In this case, a sound generating body 212 (speaker) of a headphone unit 210 is arranged as shown in FIG. 21 such that the sound generating body is ring-shaped and each of the earholes of the ears 23*a*, 23*b* of the listener 23 is opposed to an aperture 213. With this arrangement, it is possible to prevent an unnecessary reflection where the sound wave once radiated from the sound generating body 212 is reflected by the ears 23*a*, 23*b* of the listener 23, further reflected by the sound generating body 212, and then arrived at the ears 23*a*, 23*b* of the listener 23.

Figure 22:
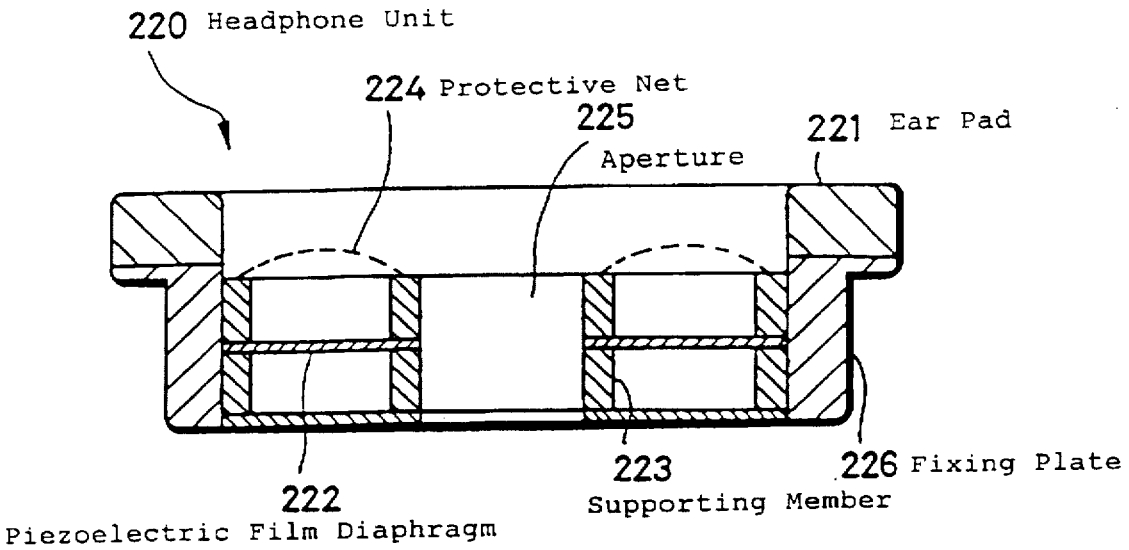
FIG. 22 is a cross-sectional view showing an arrangement of the headphone unit of the audio reproducing apparatus according to the embodiment of the present invention.
Figure 23:
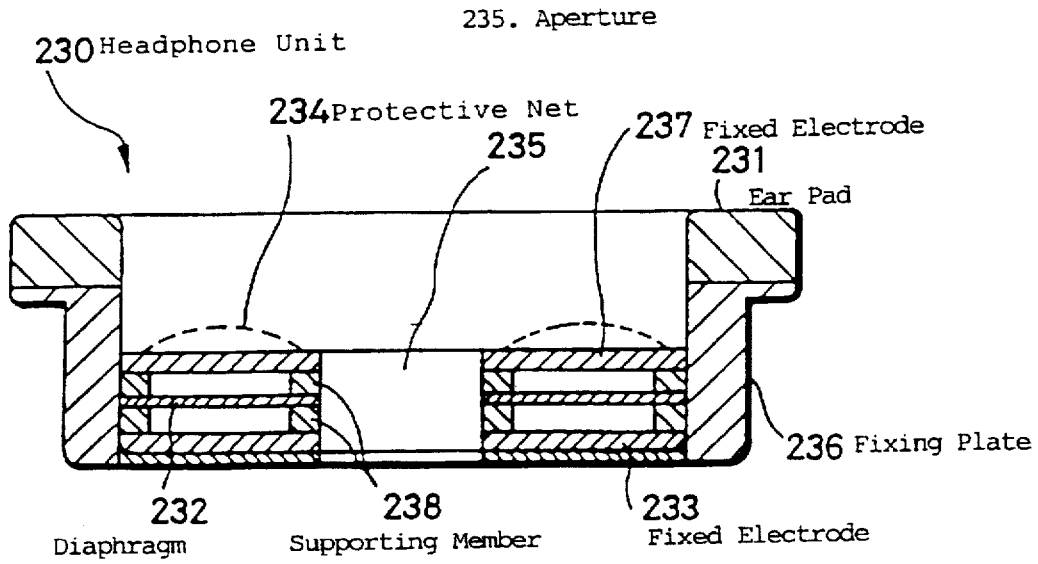
FIG. 23 is a cross-sectional view showing an arrangement of the headphone unit of the audio reproducing apparatus according to the embodiment of the present invention.

FIGS. 22 and 23 show a detailed arrangement of the headphone unit. FIG. 22 shows a piezoelectric type headphone unit. A piezoelectric film diaphragm 222 having an aperture 225 defined at its center is fixed by a supporting member 223 to an inner-side lower end portion of a fixing plate 226 shaped such that a circular dish-shaped body is hollowed at its center portion. Reference numeral 224 depicts a protective net which protects a vibrating 23*a*, 23*b* operation of the piezoelectric film diaphragm 222 and is provided so as to be curved slightly outwardly. A ring-shaped ear pad having a size larger than an outer periphery of the piezoelectric film diaphragm 222 is provided so as to be projected from an upper end surface of the fixing plate 226 beyond an upper surface of the protective net 224. With this arrangement, it is possible for the ear pad 221 to cover the ears 23*a*, 23*b* of the listener 23 and to prevent the protective net 224 from being in direct contact with the ears 23*a*, 23*b* of the listener 23.

FIG. 23 shows an electrostatic type headphone unit. A diaphragm 232 having an aperture 235 defined at its center is fixed by a supporting member 228 to an inner-side lower end portion of a fixing plate 236 shaped such that a center portion of a circular dish-shaped body is hollowed, with being sandwiched by fixed electrodes 233, 237. Reference numeral 234 depicts a protective net which protects a vibrating operation of the diaphragm 232 and is provided so as to be slightly curved outwardly. A ring-shaped ear pad having a size larger than an outer periphery of the diaphragm 232 is provided so as to be projected from an upper end surface of the fixing plate 236 beyond an upper surface of the protective net 234. With this arrangement, it is possible for the ear pad 231 to cover the ears 23*a*, 23*b* of the listener 23 and to prevent the protective net 234 from being in direct contact with the ears 23*a*, 23*b* of the listener 23.

Figure 24:
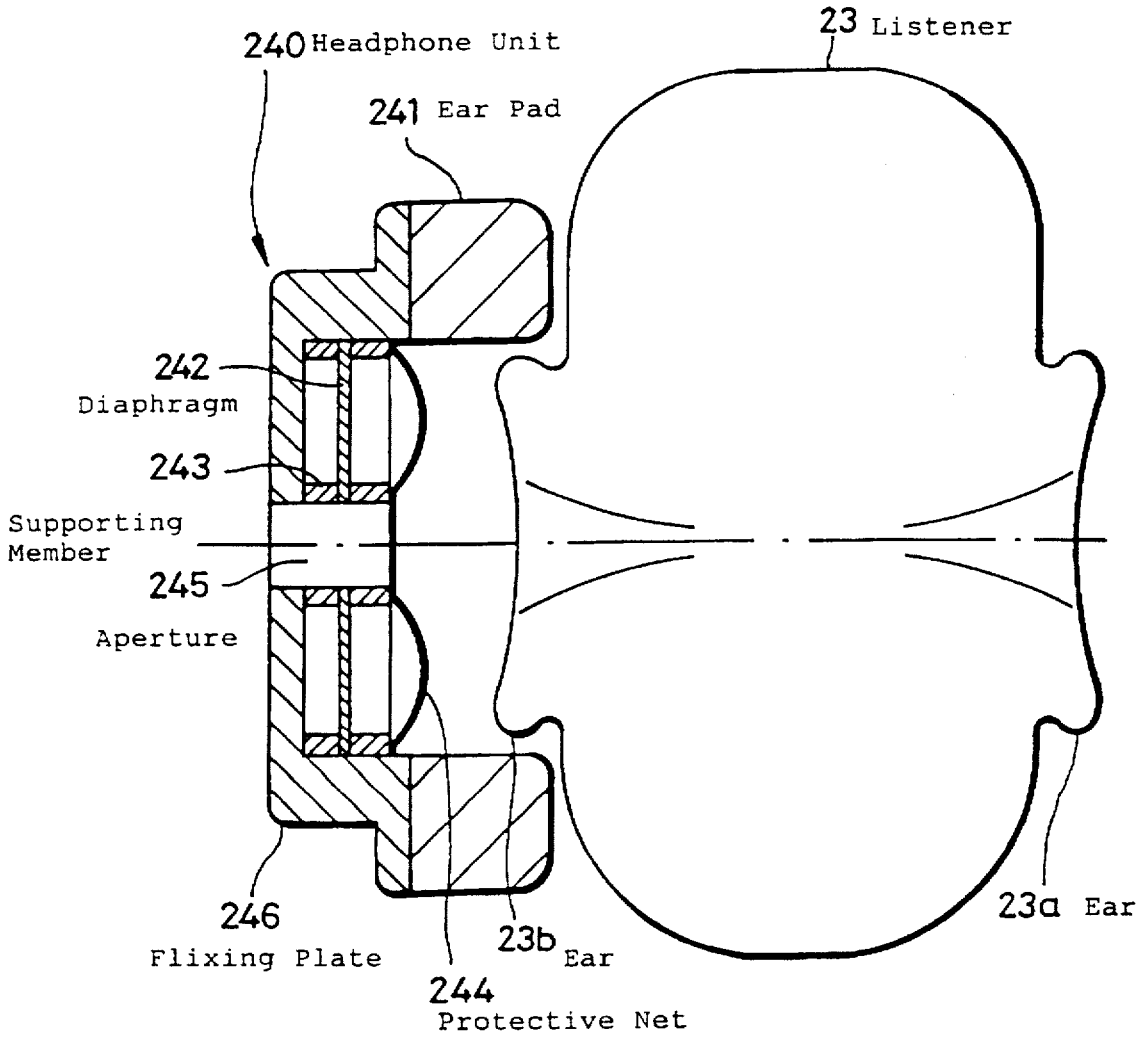
FIG. 24 is a partially cross-sectional view showing a used state of the headphone unit of the audio reproducing apparatus according to the embodiment of the present invention.
Figure 25:
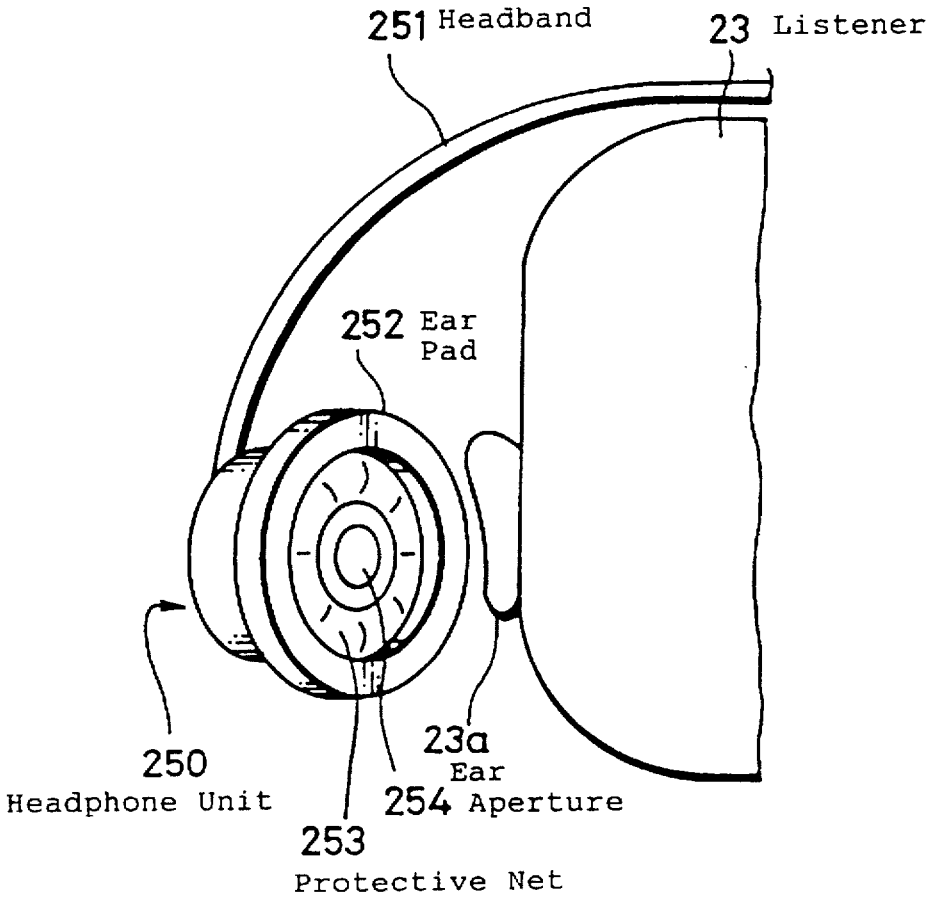
FIG. 25 is a diagram showing a used state of the headphone unit of the audio reproducing apparatus according to the embodiment of the present invention.

FIGS. 24 and 25 show used states of the headphone unit. As shown in FIG. 24, a diaphragm 242 is fixed by a supporting member 243 to an inner-side lower end portion of a fixing plate 246 of a headphone unit 240. A protective net 244 is provided so as to be slightly curved outwardly in order to protect a vibrating operation of the diaphragm 242. A ring-shaped ear pad having a size larger than an outer periphery of the diaphragm 242 is provided on an upper end portion of the fixing plate 246 so as to be projected from an upper surface of the protective net 244.

With this arrangement, since the ear pad 241 presses against the side portion of the head of the listener 23, it is possible to cover the ears 23*a*, 23*b* and to prevent the protective net 244 and the ears 23*a*, 23*b* from being in direct contact with each other. Moreover, since apertures 245 at the center portions of the headphone units 240 are provided on the straight line passing through the opening portions of the ears 23*a*, 23*b* of the listener 23 so as to be opposed to the opening portions of the ears 23*a*, 23*b*, it is possible to release the unnecessary reflected sound and for the listener to feel more comfortable when putting on the headphone.

As shown in FIG. 25, a headphone unit 250 provided at a headband 251 may be provided at a position away from a face of the listener 23 by using a supporting body as shown in FIG. 9. In this case, it is needless to say that an aperture 254 of the headphone unit 250 is provided so as to be opposed to the opening portions of the ears 23*a*, 23*b* of the listener 23.

According to the above embodiment, since the opening portions 213, 225, 235, 245 and 254 provided through the sound generating units 93, 103, 210, 220, 230, 240 and 250 of the sound reproducing means 24, 90 and 100 so as to be opposed to at least the positions of the ears of the listener 23 make the sound generating characteristics of the sound generating units 93, 203, 210, 220, 230, 240 and 250 approximate to the characteristics obtained when the audio signals are picked up, the radiation impedance from the inlets of the external auditory canals to the outside becomes approximate to that obtained when the listener does not wear the headphone. Therefore, it is possible to facilitate the localization of the reproduced sound image and for the listener to feel more comfortable when putting on the headphone.

Figure 26A:
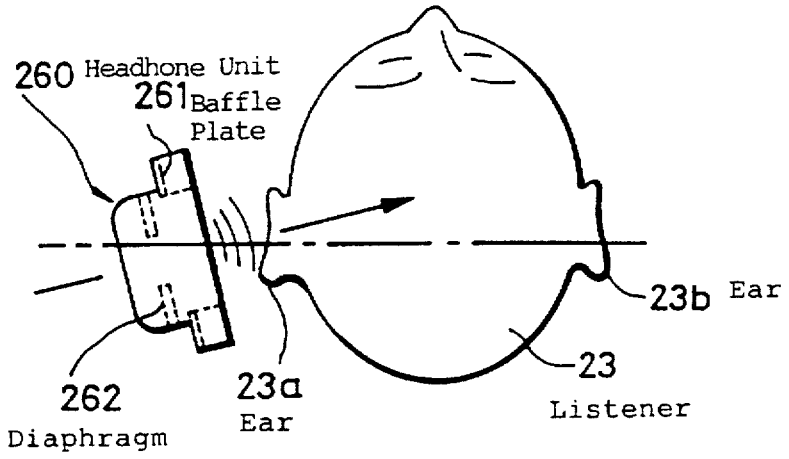
FIG. 26 is a diagram showing an arrangement in which the headphone unit can be adjusted in the forward and backward directions in the audio reproducing apparatus according to the embodiment of the present invention.

FIG. 26 shows an arrangement in which the headphone units as the sound generating units can be moved in the forward and backward directions in the audio reproducing apparatus according to the embodiment of the present invention. FIG. 26A shows an arrangement in which an angle of a plane of a baffle plate 261 as a fixed portion of a headphone unit 260 and a diaphragm 262 as a vibrating unit of a sound generating unit thereof relative to a straight line passing through the ears 23*a*, 23*b* of the listener 23 is set to not a right angle but an angle at which the plane is inclined forward.

This arrangement reduces an influence of such an unnecessary reflection that a sound wave once radiated from the diaphragm 262 is reflected by an auricle portion of the ear 23*a* and further reflected by the baffle plate 261 and the diaphragm 262. Moreover, it becomes easy for an external sound from a forward side to arrive at the ear. In this case, it becomes easy to localize the sound image behind the listener.

Figure 26B:
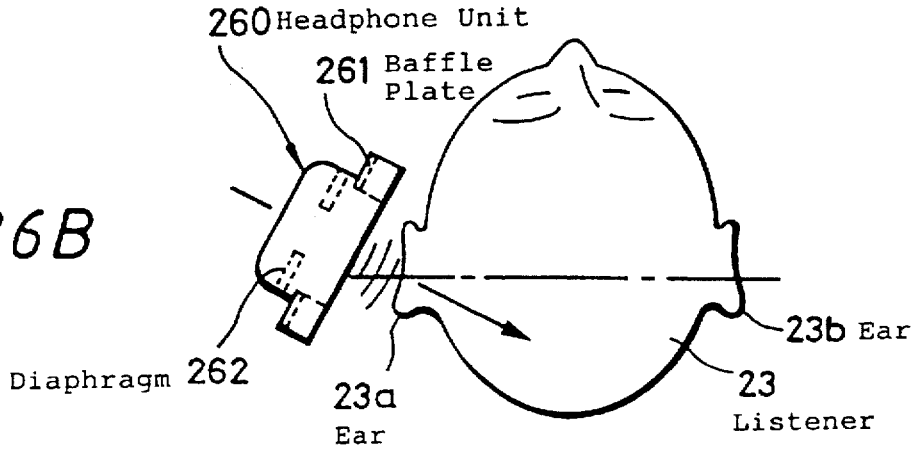

FIG. 26B shows an arrangement in which an angle of the plane of the baffle plate 261 as the fixed portion of the headphone unit 260 and the diaphragm 262 as the vibrating unit of the sound generating unit relative to the straight line passing through the ears 23*a*, 23*b* of the listener 23 is set to not a right angle but an angle at which the plane is slightly inclined backward. This arrangement is clearly effective particularly in localization of the sound image in front of the listener and reduces an influence of such an unnecessary reflection that the sound wave once radiated from the diaphragm 262 is reflected by the auricle portion of the left ear 23*a* and further reflected by the baffle plate 261 and the diaphragm 262. Moreover, it becomes easy for an external sound from a backward side to arrive at the ear.

Figure 26C:
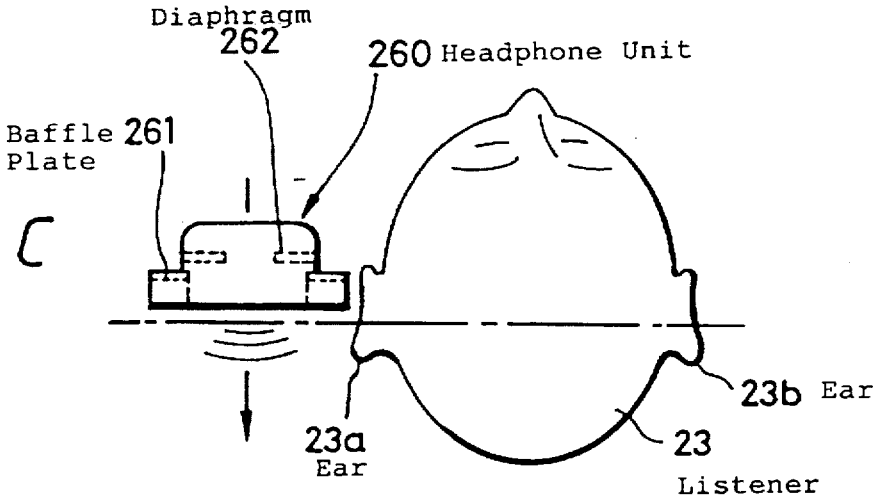

FIG. 26C shows an arrangement in which an angle of the plane of the baffle plate 261 as the fixed portion of the headphone unit 260 and the diaphragm 262 as the vibrating unit of the sound generating unit relative to the straight line passing through the ears 23*a*, 23*b* of the listener 23 is set to an angle of 0°. This arrangement reduces an influence of an unnecessary reflection where the sound wave once radiated from the diaphragm 262 is reflected by the auricle portion of the ear 23*a* and further reflected by the baffle plate 261 and the diaphragm 262. Moreover, it becomes easy for an external sound from a backward side to arrive at the ear.

According to the above arrangements, since the headphone unit 260 as the sound generating unit is disposed so as to be opposed to each of the left and right ears 23*a*, 23*b* of the listener 23 and the plane of the headphone unit 260 opposing to each of the left and right ears 23*a*, 23*b* of the listener 23 is provided with being inclined at a predetermined angle in the forward or backward direction so as not to be at the right angle relative to the straight line passing through the centers of both left and right ears 23*a*, 23*b*, it is possible to reduce the sound wave supplied from the diaphragm 262 of the headphone unit 260 and reflected by the ear 23*a* of the listener 23 and the side portion of the head thereof and to emphasize the sound wave arriving from a direction in which the plane of the headphone unit is inclined. Particularly if the plane of the headphone unit is inclined backward, then it is possible to facilitate the localization of the sound image in front of the listener. If the plane of the headphone unit is inclined forward, then the sound wave reflected by the auricle portion is reduced. Therefore, it is possible to facilitate the correction and to pick up the sound of the external field in front of the listener.

FIG. 27 shows arrangements in which a headphone unit as a sound generating unit of the audio reproducing apparatus according to the embodiment of the present invention can be moved in the vertical direction. FIG. 27A shows an arrangement in which an angle of a plane of a baffle plate 271 as a fixed portion of a headphone unit 270 and a diaphragm 272 as a vibrating unit of a sound generating unit relative to a straight line passing through the ears 23*a*, 23*b* of the listener 23 is set to not a right angle but an angle at w23*a*, 23*b* which the plane is inclined in the diagonally downward direction.

Figure 27A:
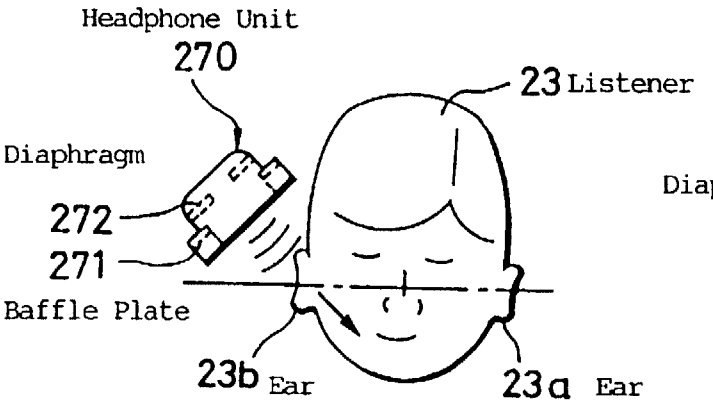
FIG. 27 is a diagram showing an arrangement in which the headphone unit can be moved in the upward and downward directions in the audio reproducing apparatus according to the embodiment of the present invention.
Figure 27B:
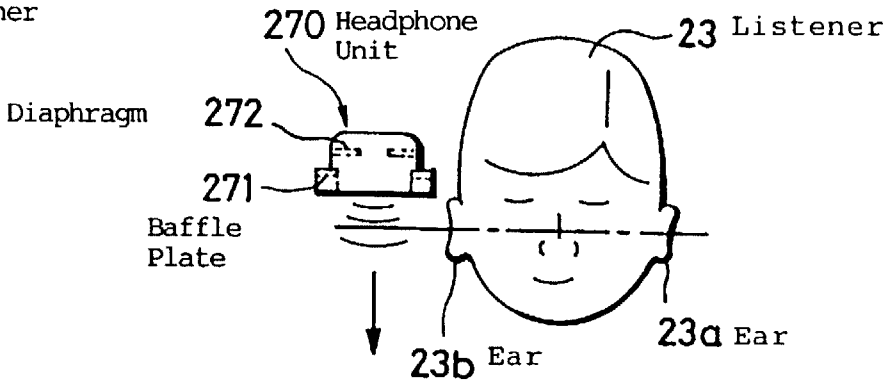

FIG. 27B shows an arrangement in which the angle of the plane of the baffle plate 271 as the fixed portion of the headphone unit 270 and the diaphragm 272 as the vibrating unit of the sound generating unit relative to the straight line passing through the ears 23*a*, 23*b* of the listener 23 is set to an angle of 0° and the plane is faced downward.

Figure 27C:
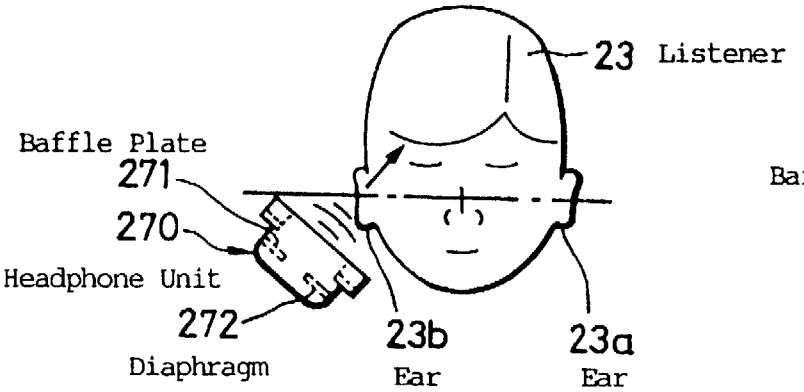
Figure 27D:
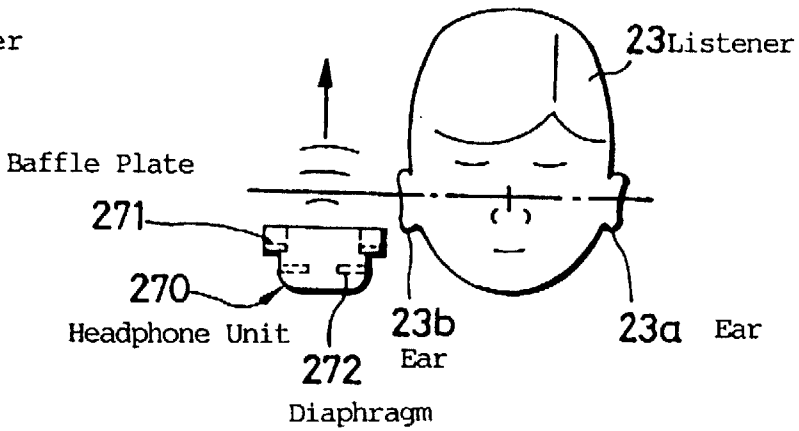

FIG. 27C shows an arrangement in which the angle of the plane of the baffle plate 271 as the fixed portion of the headphone unit 270 and the diaphragm 272 as the vibrating unit of the sound generating unit relative 23*a*, 23*b* to the straight line passing through the ears 23*a*, 23*b* of the listener 23 is set to not the right angle but an angle at which the plane is inclined in the diagonally upward direction FIG. 27D shows an arrangement in which the angle of the plane of the baffle plate 271 as the fixed portion of the headphone unit 270 and the diaphragm 272 as the vibrating unit of the sound generating unit relative to the straight line passing through the ears 23*a*, 23*b* of the listener 23 is set to an angle of 0° and the plane is faced upward.

According to the above arrangements, since the headphone unit 270 as the sound generating unit is disposed so as to be opposed to each of the left and right ears 23*a*, 23*b* of the listener 23 and the plane of the baffle plate 271 and the diaphragm 272 opposing to each of the left and right ears 23*a*, 23*b* of the listener 23 is provided with being inclined at a predetermined angle in the upward or downward direction so as not to be at the right angle relative to the straight line passing through the centers of both left and right ears 23*a*, 23*b* of the listener 23, it is possible to reduce the sound wave supplied from the diaphragm 272 and reflected by the ear 23*b* of the listener 23 and the side portion of the head thereof and to emphasize the sound wave arriving from a direction in which the plane of the headphone unit is inclined.

Figure 28:
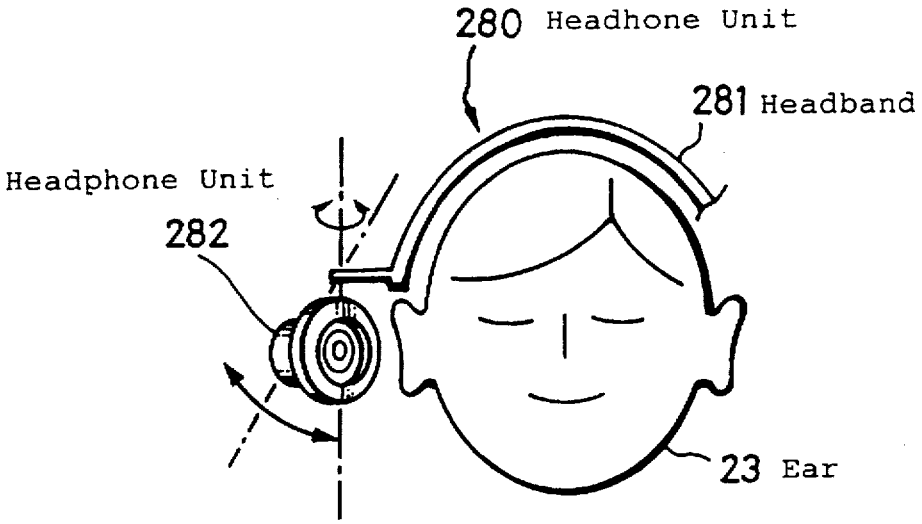
FIG. 28 is a diagram showing an arrangement in which the headphone unit can be adjusted at an optional angle in the audio reproducing apparatus according to the embodiment of the present invention.
Figure 29:
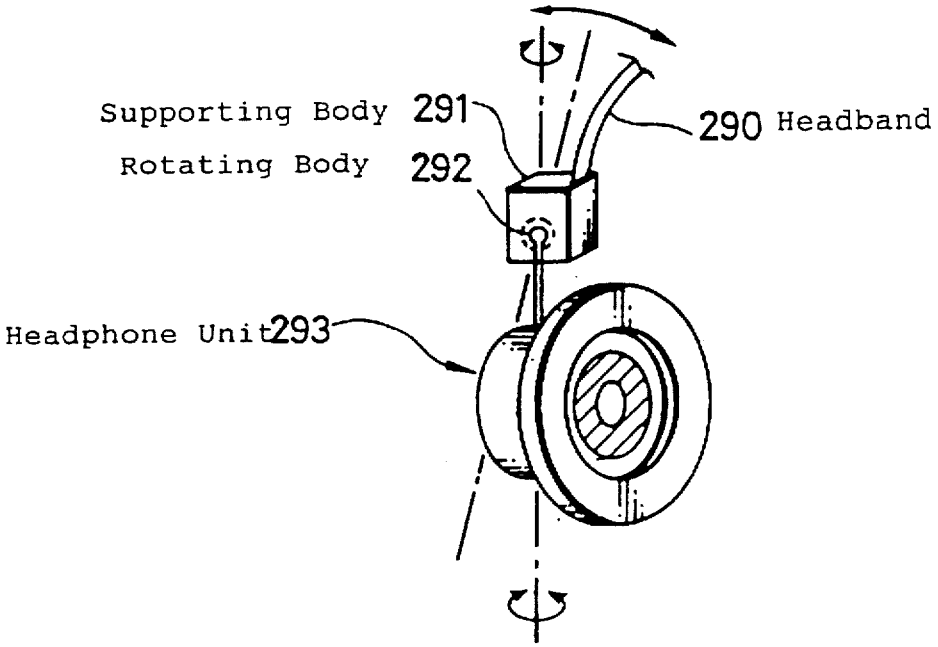
FIG. 29 is a diagram showing an arrangement in which the headphone unit can be adjusted at an optional angle in the audio reproducing apparatus according to the embodiment of the present invention.

FIG. 28 shows an arrangement in which a headphone unit as a sound generating unit of the audio reproducing apparatus according to the embodiment of the present invention can be adjusted to be rotated at an arbitrary angle. In this arrangement, a headphone unit 282 can be adjusted so as to be rotated at an arbitrary angle relative to a headband 281 of a headphone 28023*a*, 23*b* . In this case, as shown in FIG. 29, a headphone unit 293 can be rotated relative to a supporting body 291 provided at an end portion of a headband 290 with a rotating body 292 being slidably in contact with a hollow portion, whose inner surface has a spherical shape, of the supporting body.

Figure 30A:
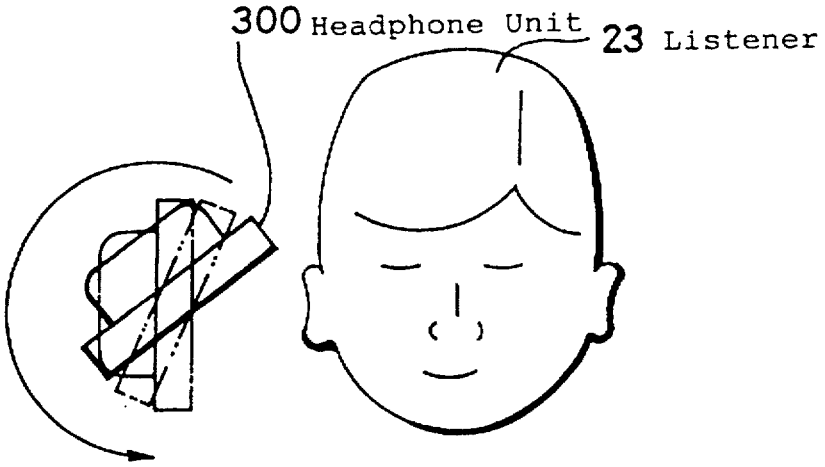
FIG. 30 is a diagram used to explain operation of the arrangement in which the headphone unit can be adjusted at an optional angle in the audio reproducing apparatus according to the embodiment of the present invention.
Figure 30B:
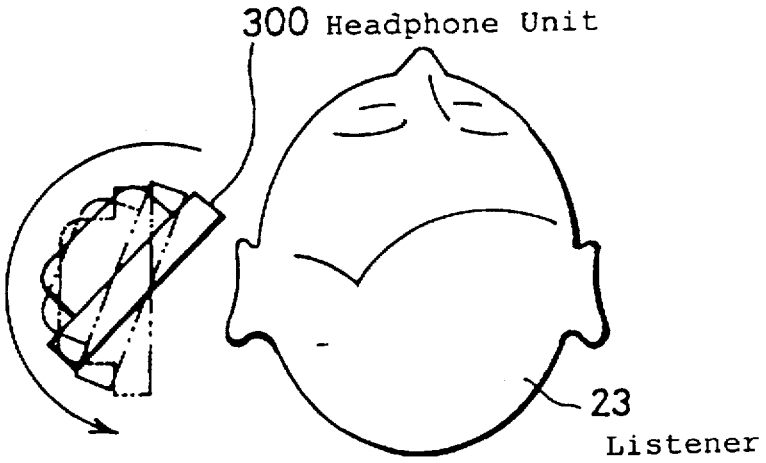

This arrangement allows a headphone unit 300 to be rotated in the vertical direction relative to the listener 23 as shown in FIG. 30A and allows the headphone unit 300 to be rotated in the forward and backward direction relative to the listener 23 as shown in FIG. 30B.

According to the above arrangements, since each of the headphone units 282, 293 and 300 as the sound generating units is disposed so as to be opposed to each of the left and right ears 23*a*, 23*b* of the listener 23 and the planes of the headphone units 282, 293 and 300 opposing to the left and right ears 23*a*, 23*b* of the listener 23 can be inclined at an arbitrary angle relative to the straight line passing through the centers of both left and right ears 23*a*, 23*b* of the listener 23, it is possible to reduce the sound waves supplied from the headphone units 280, 290 and 300 and reflected by the ear of the listener 23 and the side portion of the head thereof and to emphasize the sound wave arriving from a direction toward which the plane of the headphone unit is inclined. Moreover, it is possible to avoid an influence caused by the difference among the shapes of the auricles of the listeners 23 and so on.

Figure 31A:
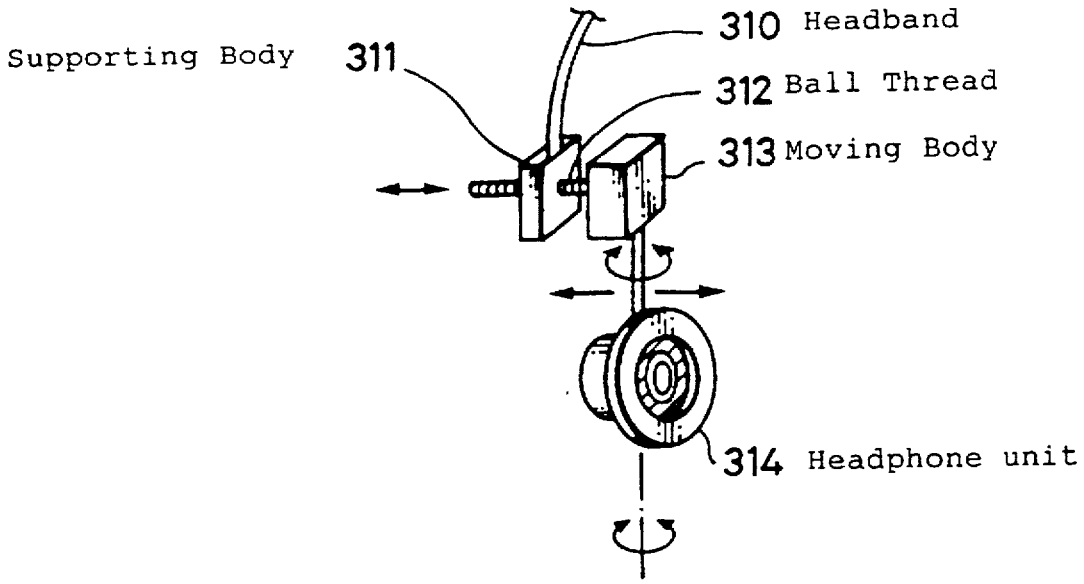
FIG. 31 is a diagram showing an arrangement in which the headphone unit can be moved in the horizontal direction in the audio reproducing apparatus according to the embodiment of the present invention.
Figure 31B:
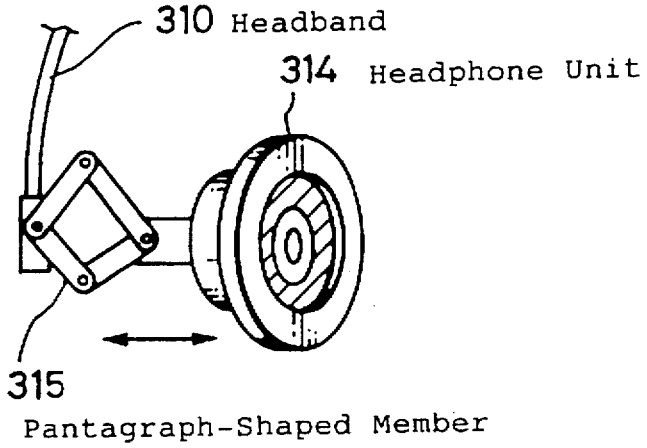

FIG. 31 shows an arrangement in which a headphone unit as a sound generating unit of the audio reproducing apparatus according to the embodiment of the present invention can be moved in the horizontal direction. FIG. 31A shows an arrangement in which a headphone unit 314 provided at a moving body 313 can be moved in the horizontal direction by a ball thread 312 provided at an end portion of a headband 310. FIG. 31B shows an arrangement in which an end portion of a pantagraph-shaped member 315 is provided at the end portion of the headband 310 and the headphone unit 314 provided at the other end portion of the pantagraph-shaped member can be moved in the horizontal direction by an operation of extending or contracting the pantagraph-shaped member 315.

According to the arrangements, it is possible to move the plane of the headphone unit 314 as the sound generating unit opposed to each of the left and right ears 23*a*, 23*b* of the listener 23 close to or away from each of the left and right ears 23*a*, 23*b* of the listener 23. Therefore, it is possible to avoid the influence caused by the difference among the shapes of the auricles of the individual listeners 23 and so on.

Figure 32A:
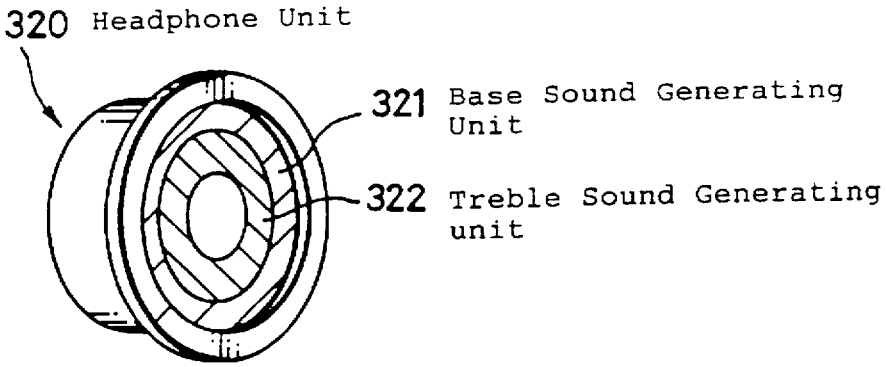
FIG. 32 is a diagram showing an arrangement in which the headphone unit is formed of a plurality of units in the audio reproducing apparatus according to the embodiment of the present invention.
Figure 32B:
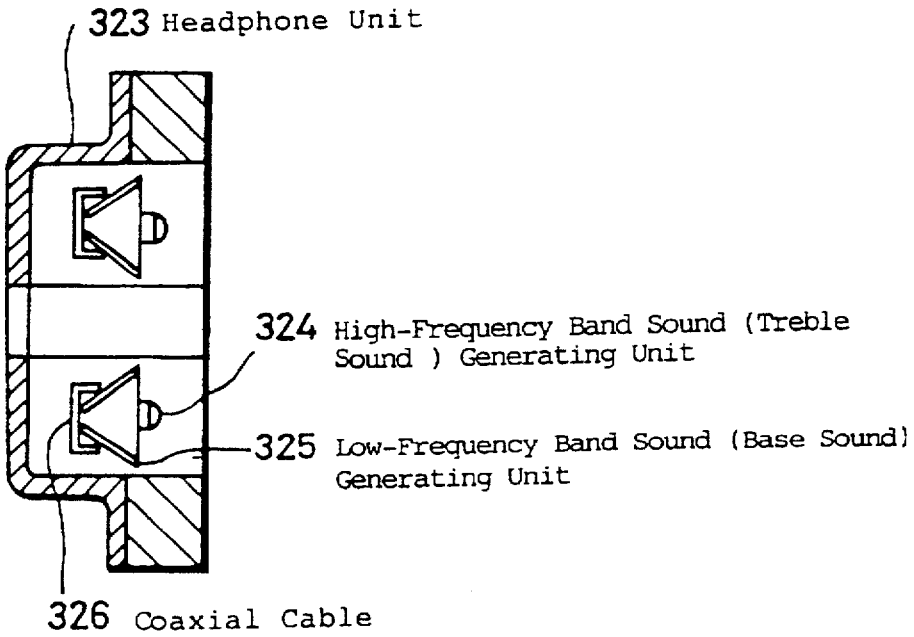

FIG. 32 shows arrangements in which a headphone unit as a sound generating unit of the audio reproducing apparatus according to the embodiment of the present invention is formed of a plurality of units. FIG. 32A shows an arrangement in which a headphone unit 320 is formed of a bass sound generator unit 321 and a treble sound generator unit 322 as the sound generators. FIG. 32s shows an arrangement in which a headphone unit 323 is formed of a low-frequency band sound (bass sound) generator unit 325 and a high-frequency band sound (treble sound) generator unit 324 as the sound generator which is provided on the former and audio signals are supplied thereto through a coaxial cable 326 to be reproduced.

According to the above arrangements, a band of an audio signal is divided into a plurality of bands, each of the headphone units 320, 323 has a plurality of sound generator units 321, 322 and 324, 325 corresponding to a plurality of the divided bands, and the plurality of sound generator units 321, 322 and 324, 325 emanate the sounds. Therefore, it is possible to clarify the characteristics of the audio signals and to correct the audio signals easily.

Figure 33:
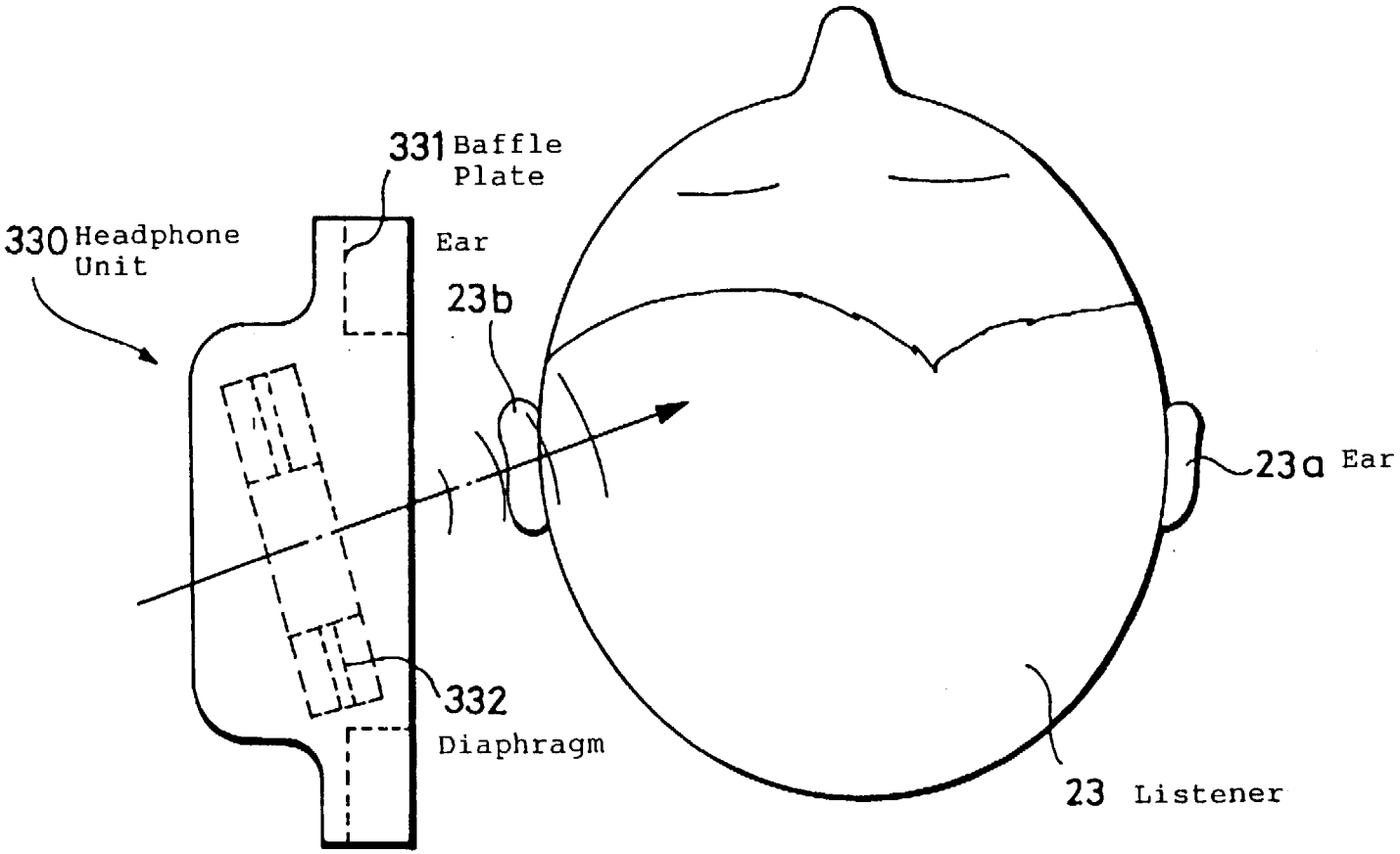
FIG. 33 is a diagram showing an arrangement in which angles of a baffle plate and a diaphragm of the headphone unit are changed in the audio reproducing apparatus according to the embodiment of the present invention.

FIG. 33 shows an arrangement in which an angle made by a baffle plate and a diaphragm of a headphone unit as a sound generating unit of the audio reproducing apparatus according to the embodiment of the present invention is changed. In this case, an angle of a plane of a baffle plate 331 as a fixed portion of a headphone unit 330 relative to the straight line passing through the ears 23*a*, 23*b* of the listener 23 is set to a right angle and an angle of a plane of a diaphragm 232, which is a vibrating unit of a sound generating unit of the headphone unit 330, relative to the above straight line is set to not the right angle but an angle at which the plane of the diaphragm is inclined.

According to the above arrangement, the diaphragm 332 is provided so as to be inclined relative to the baffle plate 331 attached to the headphone unit 330 as the sound generating unit and an angle of inclination of the diaphragm 332 is fixed or changed, it is possible to reduce the sound wave supplied from the diaphragm 232 and reflected by the ear 23*b* of the listener 23 and the side portion of the head thereof and to change an effect of picking up the sound.

According to the present invention, since the opening portions provided through the sound generating unit of the audio reproducing means so as to be opposed to at least the ear position of the listener allow the sound generating characteristics of the sound generating units to be set approximate to the characteristics obtained when the audio signals are picked up, the radiation impedance from the inlets of the external auditory canals thereof to the outside becomes approximate to that obtained when the listener does not put the headphone on the head. Therefore, it is possible to facilitate the localization of the reproduced sound image and it is possible for the listener to feel more comfortable when putting the headphone on the head.

According to the present invention, since the supporting members provided in the head mount body of the audio reproducing means prevent the sound generating units from against the ears of the listener and the sound generating characteristics of the sound generating units are set approximate to the characteristics obtained when the audio signals are picked up, the radiation impedance from the inlets of the external auditory canals thereof to the outside becomes approximate to that obtained when the listener does not put the headphone on the head. Therefore, it is possible to facilitate the localization of the reproduced sound image and it is possible for the listener to feel more comfortable when putting the headphone on the head.

According to the present invention, since the sound generating units are disposed so as to be opposed to both the left and right ears of the listener and the plane of the sound generating unit opposing to each of the left and right ears of the listener is provided with being inclined at a predetermined angle in the forward or backward direction so as not to be at the right angle relative to the straight line passing through the centers of both left and right ears of the listener, it is possible to reduce the sound waves supplied from the sound generating units and reflected by the ears of the listener and the side portions of the head thereof and to emphasize the sound wave arriving from the direction in which the plane of the sound generating unit is inclined. Particularly if the plane of the sound generating unit is inclined backward, then it is possible to facilitate the localization of the sound image in front of the listener. If the plane of the sound generating unit is inclined forward, then the sound waves reflected by the auricle portions are reduced. Therefore, it is possible to facilitate the correction and to pick up the sound of the external field in front of the listener.

According to the present invention, since the sound generating units are disposed so as to be opposed to both the left and right ears of the listener and the plane of the sound generating unit opposing to each of the left and right ears of the listener is provided with being inclined at a predetermined angle in the upward or downward direction so as not to be at the right angle relative to the straight line passing through the centers of both left and right ears of the listener, it is possible to reduce the sound waves supplied from the sound generating units and reflected by the ears of the listener and the side portions of the head thereof and to emphasize the sound wave arriving from the direction in which the plane of the sound generating unit is inclined.

According to the present invention, since the sound generating units are disposed so as to be opposed to both the left and right ears of the listener and the plane of the sound generating unit opposing to each of the left and right ears of the listener can be inclined at an optional angle relative to the straight line passing through the centers of both left and right ears of the listener, it is possible to reduce the sound waves supplied from the sound generating units and reflected by the ears of the listener and the side portions of the head thereof and to emphasize the sound wave arriving from the direction in which the plane of the sound generating unit is inclined. Moreover, it is possible to avoid the influence caused by the difference among the shapes of the auricles of the individual listeners and so on.

According to the present invention, since it is possible to move the planes of the sound generating units corresponding to both the left and right ears of the listener close to or away from both the left and right ears of the listener, it is possible to avoid the influence caused by the difference among the shapes of the auricles of the individual listeners and so on.

According to the present invention, since the band of the audio signal is divided into a plurality of bands, each of the sound generator units provided in the audio signal reproducing means has a plurality of sound generator units corresponding to a plurality of divided bands, and the plurality of sound generator units emanate the sounds, it is possible to clarify the characteristics of the audio signals and to correct the audio signals easily.

According to the present invention, the diaphragm is provided so as to be inclined relative to the baffle plate to which attached is the sound generating unit and an angle of inclination of the diaphragm is fixed or changed, it is possible to reduce the sound wave supplied from the diaphragm and reflected by the ears of the listener and the side portions of the head thereof and to change the effect of picking up the sound.

An audio reproducing apparatus according to another embodiment of the present invention will subsequently be described in detail with reference to FIGS. 34 to 41.

According to the audio reproducing apparatus according to the embodiment of the present invention, when audio signals are reproduced by the headphone, the listener can perceive the localization, the sound field and so on equivalent to those perceived when the audio signals are reproduced by the speakers located in a predetermined positional relationship in which the speakers should be located even when the audio signals are reproduced by the headphones. Particularly, the audio signals are corrected by removing any difference from among the shapes of the ears of the individual listeners, any noise and so on by an adaptive processing.

Specifically, the audio reproducing apparatus according to the embodiment of the present invention is used in a system in which multichannel audio signals picked up in a stereophonic fashion or the like are reproduced by the headphone. Particularly, when digitized audio signals to be recorded in or transmitted to respective channels for localizing respective sound images in a predetermined positional relationship (e.g., at right, left and center positions in front of the listener and other positions) are reproduced through the headphone or the like, the headphone is provided with a sound pickup microphone with which characteristics including the noise and so on are measured. The audio signals are corrected by removing the noise and so on by the adaptive processing for generating inverse characteristics thereof.

Audio reproducing apparatus shown in FIGS. 34, 35 and 36 respectively correspond to the audio reproducing apparatus shown in FIGS. 1, 7 and 8. The audio reproducing apparatus shown in FIGS. 34, 35 and 36 are respectively the same as the audio reproducing apparatus shown in FIGS. 1, 7 and 8 except that the correcting circuits 17, 18 in the audio reproducing apparatus shown in FIGS. 1, 7 and 8 are replaced with adaptive processing filters 340, 341. Accordingly, arrangement and operation of the audio reproducing apparatus shown in FIGS. 34, 35 and 36 are the same as those of the audio reproducing apparatus shown in FIGS. 1, 7 and 8 except the above point and hence need not be described in detail. Characteristic arrangement and operation of the former will hereinafter be described.

In the audio reproducing apparatus shown in FIG. 34, the two-channel digital signals added by the adders 15, 16 as described with reference to FIG. 1 are corrected by the adaptive processing filters 340, 341 in order to remove the difference among the shapes of the ears of the individual listeners, the noise, the characteristics inherent in the sound source and headphone to be used, and so on. The digital signals are converted by the D/A converters 19, 20 into the analog signals. The analog signals are amplified by the power amplifiers 21, 22 and then supplied to the headphone 24.

In the audio reproducing apparatus shown in FIG. 35, the two-channel digital signals given spatial information by the control apparatus 50, 51, 52 and 53 and added by the adders 15, 16 as described with reference to FIG. 7 are corrected by the adaptive processing filters 340, 341 with respect to the difference among the shapes of the ears of the individual listeners, the noise, the characteristics inherent in the sound source and headphone to be used, and so on. The digital signals given change with respect to the head movement are converted by the D/A converters 19, 20 to the analog signals. The analog signals are amplified by the power amplifiers 21, 22 and then supplied to the headphone 24.

In the audio reproducing apparatus shown in FIG. 36, the two-channel digital signals added by the adders 15, 16 as described with reference to FIG. 8 are given spatial information by the control apparatus 54 and 56 and corrected by the adaptive processing filters 340, 341 with respect to the difference among the shapes of the ears of the individual listeners, the noise, the characteristics inherent in the sound source and headphone to be used, and so on. The digital signals given change with respect to the head movement are converted by the D/A converters 19, 20 into the analog signals. The analog signals are amplified by the power amplifiers 21, 22 and then supplied to the headphone 24.

In this case, the adaptive processing filters 340, 341 for correcting the difference among the shapes of the ears of the individual listeners, the noise, and the characteristics inherent in the sound source and headphone to be used may process signals in an analog or digital fashion. If the headphone is of a wireless type, then the adaptive processing filters may be provided in a main body of the headphone. The adaptive processing filters 340, 341 may not necessarily be housed in the main body of the headphone, but may be provided in cords of the headphone, for example, or may be provided in connector units for connecting the apparatus main body and the headphone or a subsequent stage thereof. Moreover, the adaptive processing filters may be provided in the control apparatus of the apparatus main body or a subsequent stage thereof.

The audio reproducing apparatus according to the embodiment is arranged as described above and operated as follows.

In the arrangement shown in FIG. 34, the audio signals are converted by the convolutional integrators 5, 7, 9 and 11, the memories 6, 8, 10 and 12, and the adders 15, 16 into the two-channel digital signals which have the same spatial information as the sound field to both the ears. The two-channel digital signals are corrected by the adaptive processing filters 340, 341 with respect to the difference among the shapes of the ears of the individual listeners 23, the noise, the characteristics inherent in the sound source and headphone to be used, and so on. The signals are amplified by the power amplifiers 21, 22 and then supplied to the headphone 24. Therefore, it is possible to realize a reproduction effect which allows the listener to perceive as if he listened to reproduced sounds from the speakers located in the virtual sound source positions.

In the arrangement shown in FIG. 35, the audio signals are converted by the convolutional integrators 5, 7, 9 and 11, the memories 6, 8, 10 and 12 or the control apparatus 50, 51, 52 and 53 and the adders 15, 16 into the two-channel digital signals which have the same spatial information as the sound field to both the ears. The two-channel digital signals are corrected by the adaptive processing filters 340, 341 with respect to the difference among the shapes of the ears of the individual listeners 23, the noise, the characteristics inherent in the sound source and headphone to be used, and so on. The signals are amplified by the power amplifiers 21, 22 and then supplied to the headphone 24. Therefore, it is possible to realize the reproduction effect which allows the listener to perceive as if he listened to reproduced sounds from the speakers located in the virtual sound source positions.

In the audio reproducing apparatus shown in FIG. 36, the digital signals added by the convolutional integrators 5, 7, 9 and 11, the memories *623a*, *23b*, *823a*, *23b*, 10 and 12 and the adders 15, 16 are converted by the control apparatus 54 and 56 into the two-channel digital signals which have the same spatial information as the sound field to both the ears. The two-channel digital signals are corrected by the adaptive processing filters 340, 341 with respect to the difference among the shapes of the ears of the individual listeners 23, the noise, the characteristics inherent in the sound source and headphone to be used, and so on. The signals are amplified by the power amplifiers 21, 22 and then supplied to the headphone 24. Therefore, it is possible to realize the reproduction effect which allows the listener to perceive as if he listened to reproduced sounds from the speakers located in the virtual sound source positions.

The adaptive processing filters 340, 341 have one of, combination of or all of the correction characteristics used to correct the characteristics inherent in the sound sources used in measurement of the impulse responses or the control signals and the correction characteristics used to correct the difference among the shapes of the ears of the individual listeners, the noise and the characteristics inherent in the sound source and headphone to be used. Accordingly, since the adaptive processing filters can carry out the digital signal processings including the above correction at once, they can carry out the signal processing in a real-time fashion.

Adaptive processing FIR filters which are programmable digital filters may be used as the adaptive processing filters 340, 341. In this case, initially, reproduction characteristics are calculated based on the reproduced sounds picked up by the microphones provided at the headphone units so as to be opposed to the earholes of the ear 23L, 23R of the listener 23. Subsequently, the adaptive processing filters generate the inverse characteristics for smoothing the reproduction characteristics. When the audio signals are passed through the adaptive processing FIR filters in which the inverse characteristics are set, the adaptive processing filters remove any characteristics caused by the difference in the shapes of the ears of the individual listeners 23, the noises and the characteristics inherent in the sound source and headphone to be used from the supplied audio signals.

According to the above arrangement, since the adaptive processing FIR filters are employed as the adaptive processing filters 340, 341, it is possible to form the digital filters by programs under the desired conditions and to process the audio signals in a digital signal fashion.

While the apparatus is directly connected to the headphone 24 through the signal lines in the above-mentioned arrangements, the signals may be transmitted thereto in a wireless transmission by providing a modulator and a transmitter at a stage succeeding the convolutional integrators 5, 7, 9 and 11 shown in FIG. 35 and a receiver and a demodulator on the headphone 24 side and receiving a transmitted signal by the receiver and the modulator or by providing a modulator and a transmitter at a stage succeeding the adders 15, 16 shown in FIG. 36 and a receiver and a demodulator on the headphone 24 side and receiving a transmitted signal by the receiver and the modulator.

According to the above embodiments, based on the signal supplied from the digital angle detector and the analog angle detector 28, 38 as the angle detecting means and corresponding to the angle, the addresses of the memories 6, 8, 10, 12 and 35 are designated by the address signal from the address control circuit 34 as the address signal converting means to thereby read out the impulse response or the control signal stored in the memory 35. The audio signals are corrected by the convolutional integrators 5, 7, 9 and 11 and the control apparatus 50, 51, 52, 53, 54 and 56 based on the impulse response or the control signal. The audio signals are corrected thereby with respect to the head movement of one or a plurality of listeners 23 in a real-time fashion. By smoothing the reproduction characteristics, the adaptive processing filters 340, 341 correct the audio signals in respective channels corrected by the memories 6, 8, 10 and 12, the convolutional integrators 5, 7, 9 and 11, and the control apparatus 50, 51, 52, 53, 54 and 56. Thus, it is possible to reproduce the audio signals by the headphones 24, 90 and 100 as the audio reproducing means.

Figure 37:
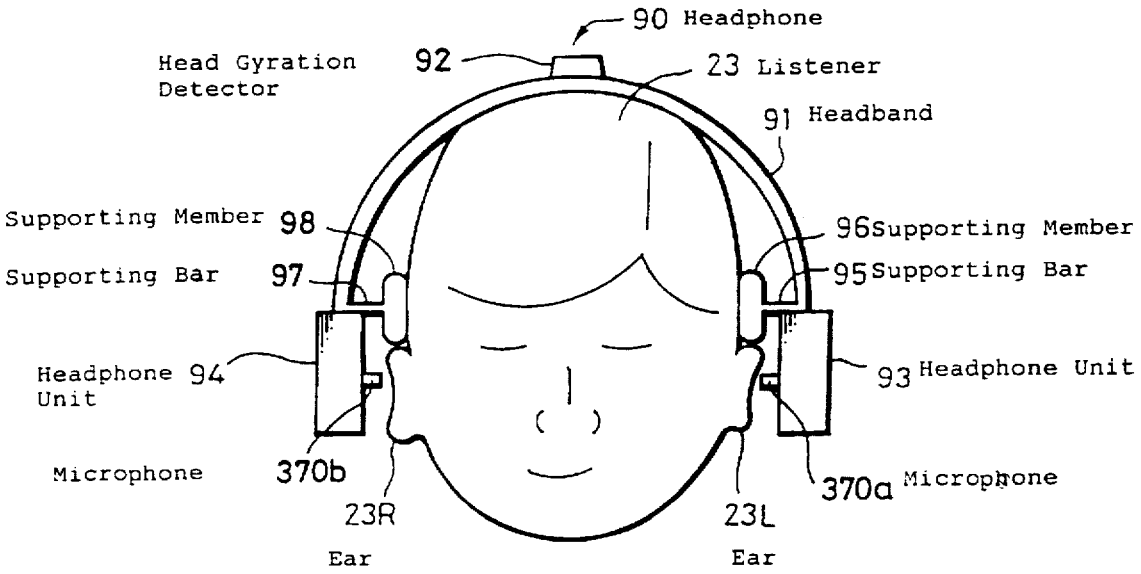
FIG. 37 is a diagram showing the headphone of the audio reproducing apparatus according to the embodiment of the present invention.

FIGS. 37 to 41 show examples of the headphones and microphone attachment positions of the audio reproducing apparatus according to the embodiment of the present invention. FIG. 37 shows a headphone of the audio reproducing apparatus according to the embodiment of the present invention. In an arrangement shown in FIG. 37, the head gyration detecting unit 92 and the headphone units 93, 94 are provided at the headband 91 of the headphone 90. The supporting bodies 96, 98 are provided in the vicinity of the positions, where the headphone units 93, 94 are attached to the headband 91, and on the inner side of the headband with being projected from the supporting bars 95, 97. With this arrangement, the listener 23 can put the headphone on the head with the headphone units 93, 94 being placed at positions away from the ears 23L, 23R of the listener 23 at a predetermined distance. At this time, the headphone units 93, 94 are provided with microphones 370*a*, 370*b* opposed to the ears 23L, 23R of the listener 23. Thus, it is possible to measure the reproduction characteristics.

According to the above arrangement, since the supporting bars 95, 97 and the supporting bodies 96, 98 as supporting members provided at the headband 91 as the head mount body of the headphone 90 as audio reproducing means prevent the headphone units 93, 94 as the sound generating units from pressing against the ears 23*a*, 23*b* of the listener 23 and the sound generating characteristics of the headphone units 93, 94 are set approximate to the characteristics obtained when the audio signals are picked up, the radiation impedance from the inlets of the external auditory canals thereof to the outside becomes approximate to that obtained when the listener does not put the headphone on the head. Therefore, it is possible to facilitate the localization of the reproduced sound image and it is possible for the listener to feel more comfortable when putting the headphone on the head.

Figure 38:
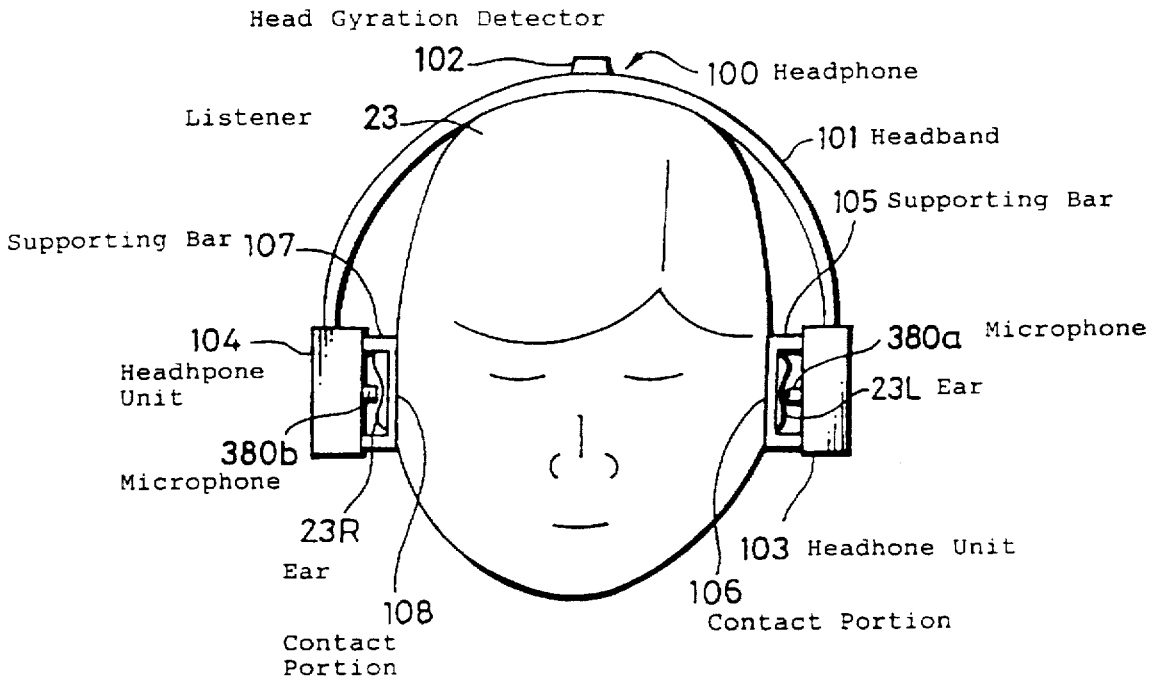
FIG. 38 is a diagram showing the headphone of the audio reproducing apparatus according to the embodiment of the present invention.

FIG. 38 shows a headphone of the audio reproducing apparatus according to the embodiment of the present invention. In the arrangement shown in FIG. 38, the head gyration detecting unit 102 and the headphone units 103, 104 are provided at the headband 101 of the headphone 100. The contact portions 106, 108 are provided on the inner sides of the headphone units 103, 104 so as to be projected from the supporting bars 105, 107. With this arrangement, the listener 23 can put the headphone on the head with the headphone units 103, 104 being placed at positions away from the ears 23L, 23R of the listener 23 at a predetermined distance. At this time, the headphone units 93, 94 are provided with microphones 380*a*, 380*b* opposed to the ears 23L, 23R of the listener 23. Thus, it is possible to measure the reproduction characteristics.

According to the above arrangement, since the supporting bars 105, 107 and the contact portions 106, 108 as the supporting members provided at the headband 101 as the head mount body of the headphone 100 prevent the headphone units 103, 104 as the sound generating units from pressing against the ears of the listener 23 and the sound generating characteristics of the headphone units 103, 104 are set approximate to characteristics obtained when the audio signals are picked up, the radiation impedance from the inlets of the external auditory canals thereof to the outside becomes approximate to that obtained when the listener does not put the headphone on the head. Therefore, it is possible to facilitate the localization of the reproduced sound image and it is possible for the listener to feel more comfortable when putting the headphone on the head.

Figure 39:
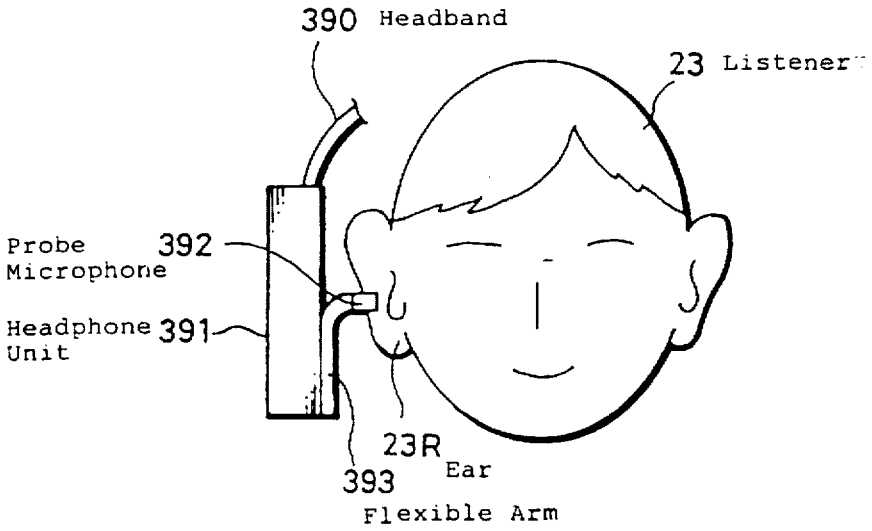
FIG. 39 is a diagram showing an attachment position of a microphone in the audio reproducing apparatus according to the embodiment of the present invention.
Figure 40:
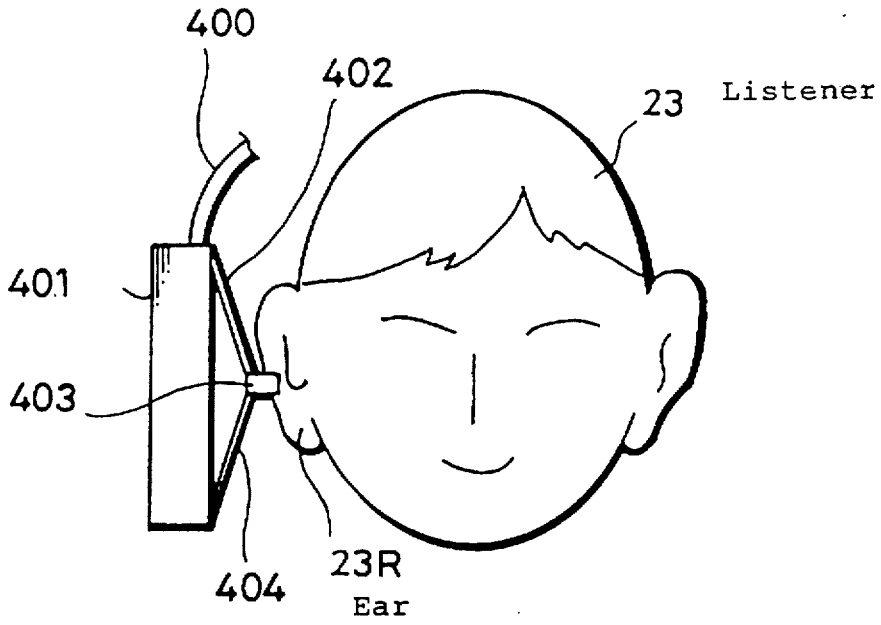
FIG. 40 is a diagram showing the attachment position of the microphone in the audio reproducing apparatus according to the embodiment of the present invention.
Figure 41:
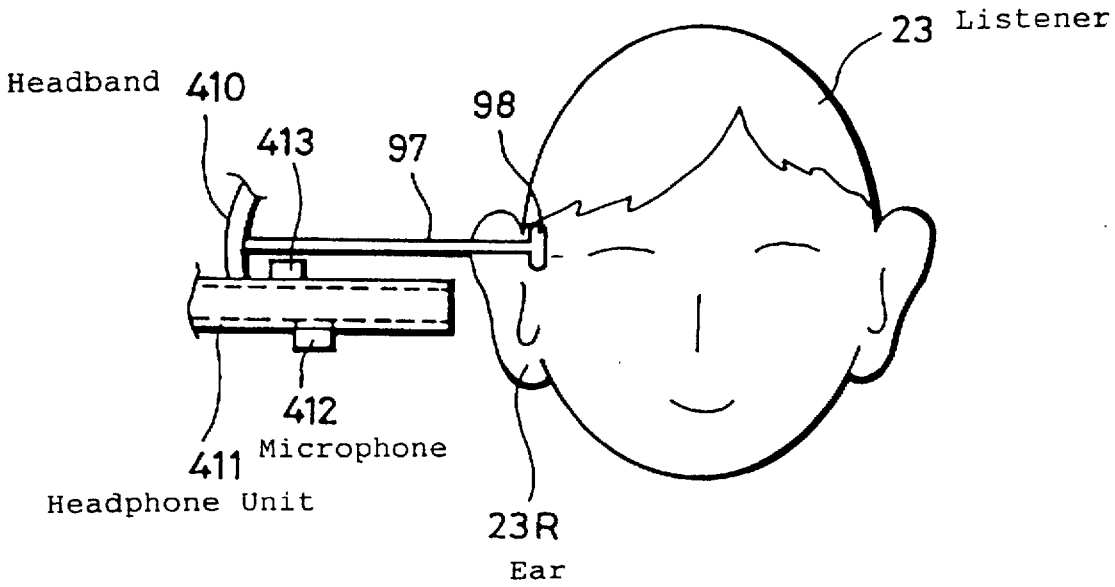
FIG. 41 is a diagram showing the attachment position of the microphone in the audio reproducing apparatus according to the embodiment of the present invention.

In this case, specific positions where the microphones are attached are shown in FIGS. 39 to 41. In the arrangement shown in FIG. 39, a microphone 392 is flexibly provided at a headphone unit 391 provided at an end portion of a headband 390 through a flexible arm 393 so as to be opposed to an earhole of the right ear 23R of the listener 23.

According to the above embodiment, since the microphones 370*a*, 370*b*, 380*a*, 380*b*, and 392 provided in the headphones 24, 90, 100 so as to be opposed to the ears of the listener 23 are probe microphones opposed to the earhole of the listener 23 by the flexible arm 393 as a flexible supporting member, it is possible to reliably measure a noise, such as a reflected wave entering the earhole of the listener 23 or the like , through an actual measurement by moving the probe microphone with fine adjustment. Thus, it is possible for the adaptive processing filters to correct the signals based on the inverse characteristics.

In an arrangement shown in FIG. 40, a microphone 403 is fixed through arms 402, 404 to a headphone unit 401 provided at an end portion of a headband 400 so as to be opposed to the earhole of the right ear 23R of the listener 23.

According to the above arrangement, since the microphones 370*a*, 370*b*, 380*a*, 380*b*, 392 and 403 provided in the headphones 24, 90 and 100 so as to be opposed to the ears of the listener 23 are microphones fixed to the headphone through the arms 402, 404 as the supporting members so as to be opposed to the earholes of the listener 23, it is possible to reliably measure the noise, such as the reflected wave entering the earhole of the listener 23 or the like, through an actual measurement. Thus, it is possible for the adaptive processing filters to correct the signals based on the inverse characteristics.

In an arrangement shown in FIG. 41, a microphone 412 is provided at an end portion of a hollow-cylinder-shaped headphone unit 411 provided at an end portion of a headband 410 such that a tip end portion of the microphone is projected toward an inside of the hollow-cylinder-shaped headphone unit. The hollow-cylinder-shaped headphone unit is fixed such that a tip end portion thereof is opposed to the earhole of the right ear 23R of the listener 23. In this case, similarly to the arrangement shown in FIG. 9, the supporting bar 97 and the supporting member 98 keep clearance between the headphone unit 411 and the auricle at a predetermined interval.

In the arrangement shown in FIG. 41, a speaker unit 413 and the microphone 412 are attached to a side surface of the headphone unit 411. Therefore, the speaker unit 413 is supplied with the corrected audio signals and the noise caused by the reflected wave entering the earhole is measured by the microphone 412.

According to the above arrangements, noise characteristics of audio signals are measured by the microphones 370*a*, 370*b*, 380*a*, 380*b*, 392, 403 and 412 provided in the headphones 24, 90 and 100 so as to be opposed to the ears of the listener 23 and the adaptive processing filters generate inverse characteristics of the measured noise characteristics to correct the audio signals in respective channels corrected by the memories 6, 8, 10 and 12, the convolutional integrators 5, 7, 9 and 11, and the control apparatus 50, 51, 52, 53, 54 and 56 based on the inverse characteristics of the noise characteristics. Therefore, it is possible to reproduce the audio signals under the same conditions by removing any noises caused by difference among the shapes of the ears of the listeners 23 and smoothing the characteristics.

According to the present invention, based on the signal supplied from the angle detecting means and corresponding to the angle, the address of the storage means is designated by the address signal from the address signal converting means. The impulse response or the control signal stored in the storage means is read out therefrom. The audio signals are corrected by the control means based on the impulse response or the control signal. The audio signals are corrected with respect to the head movements of one or a plurality of listeners in a real-time fashion. The adaptive processing filters correct the audio signals in respective channels corrected by the control means by smoothing the reproduction characteristics. Thus, it is possible to reproduce the audio signals by the audio reproducing means.

According to the present invention, since the supporting members provided in the head mount body of the audio reproducing means prevent the sound generating units from pressing against the ears of the listener and the sound generating characteristics of the sound generating units are set approximate to the characteristics obtained when the audio signals are picked up, the radiation impedance from the inlets of the external auditory canals thereof to the outside becomes approximate to that obtained when the listener does not put the headphone on the head. Therefore, it is possible to facilitate the localization of the reproduced sound image and it is possible for the listener to feel more comfortable when putting the headphone on the head.

According to the present invention, since the reflected wave of the audio signal and the noise characteristics are measured by the microphone provided in the audio reproducing means so as to be opposed to the ear of the listener and the adaptive processing filters generate the inverse characteristics of the noise characteristics and correct the audio signals in respective channels corrected by the control means based on the inverse characteristics of the noise characteristics, it is possible to reproduce the audio signals under the same condition by removing the noise, such as the reflected wave or the like, caused by the difference among the shapes of the ears of the individual listeners and by smoothing the characteristics.

According to the present invention, since the adaptive processing FIR filters are employed as the adaptive processing filters, it is possible to form the digital filters by programs under the desired conditions and to process the audio signals in a digital signal fashion.

According to the present invention, since the microphones provided in the audio reproducing means so as to be opposed to the ears of the listener are microphone fixed to the headphone through the supporting members so as to be opposed to the earholes of the listener, it is possible to reliably measure the noise entering the earhole of the listener through an actual measurement. Thus, it is possible for the adaptive processing filters to correct the digital signals based on the inverse characteristics. According to the present invention, since the microphone provided in the audio reproducing means so as to be opposed to the ears of the listener is the probe microphone opposed to the earhole of the listener by the flexible supporting member, it is possible to reliably measure the noise entering the earhole of the listener through an actual measurement by moving the probe microphone with fine adjustment. Thus, it is possible for the adaptive processing filters to correct the digital signals based on the inverse characteristics.

According to the present invention, since the adaptive processing filters set predetermined target values and correct the characteristics inherent in the audio reproducing means such that the values of the characteristics become approximate to the target values, it is possible to constantly reproduce the sound approximate to the sound from the sound source even if the audio reproducing means is replaced with another one.

According to the present invention, since the adaptive processing filters set predetermined target values and correct the characteristics inherent in the audio reproducing means by making the values of the characteristics approximate to the target values such that the sound field becomes approximate to a predetermined sound field, it is possible to reproduce optional sound fields such as a specific theater, a specific concert hall or the like.

An audio reproducing apparatus according to another embodiment of the present invention will subsequently be described in detail with reference to FIGS. 42 to 48.

According to the audio reproducing apparatus according to the embodiment of the present invention, when the audio signals are reproduced by the headphone, the listener can perceive the localization, the sound field and so on equivalent to those perceived when the audio signals are reproduced by the speakers located in a predetermined positional relationship in which the speakers should be located even when the audio signals are reproduced by the headphones. Particularly, a nonreflection type headphone having hollow-cylinder-shaped headphone units canceling the sound wave reflected by the listener's ear is used, and further the audio signals are subjected to the correction for removing the noise and so on by the adaptive processing.

Specifically, the audio reproducing apparatus according to the embodiment of the present invention is used in a system in which the multichannel audio signals picked up in a stereophonic fashion or the like are reproduced by the headphone. Particularly, when digitized audio signals to be recorded in or transmitted to respective channels for localizing respective sound images in a predetermined positional relationship (e.g., at right, left and center positions in front of the listener and other positions) are reproduced through the headphone or the like, the non-reflection type headphone is provided with the sound pickup microphone with which characteristics including the sound wave reflected by the ear, the noise and so on are measured. The audio signals are subjected to correction for removing the noise and so on by the adaptive processing for generating inverse characteristics thereof.

Audio reproducing apparatus shown in FIGS. 34, 35 and 36 which are commonly used in this embodiment and the above embodiment respectively correspond to the audio reproducing apparatus shown in FIGS. 1, 7 and 23*a*, 23*b* 8. The audio reproducing apparatus shown in FIGS. 34, 35 and 36 are respectively the same as the audio reproducing apparatus shown in FIGS. 1, 7 and 8 except that the correcting circuits 17, 18 in the audio reproducing apparatus shown in FIGS. 1, 7 and 8 are replaced with adaptive processing filters 340, 341. Accordingly, arrangement and operation of the audio reproducing apparatus shown in FIGS. 34, 35 and 36 are the same as those of the audio reproducing apparatus shown in FIGS. 1, 7 and 8 except the above point and hence need not be described in detail. Characteristic arrangement and operation of the former will hereinafter be described.

In the audio reproducing apparatus shown in FIG. 34, as described with reference to FIG. 1, the two-channel digital signals added by the adders 15, 16 are corrected by the adaptive processing filters 340, 341 with respect to the difference among the shapes of the ears of the individual listeners, the noise, the characteristics inherent in the sound source and headphone to be used, and so on. The digital signals are converted by the D/A converters 19, 20 into the analog signals. The analog signals are amplified by the power amplifiers 21, 22 and then supplied to the headphone 24.

In this arrangement, the headphone 24 is the nonreflection type headphone having the left sound generator 26 and the right sound generator 25 as the hollow-cylinder-shaped headphone units and the headband 27.

In the audio reproducing apparatus shown in FIG. 35, as described with reference to FIG. 7, the two-channel digital signals given spatial information by the control apparatus 50, 51, 52 and 53 and added by the adders 15, 16 are corrected by the adaptive processing filters 340, 341 with respect to the difference among the shapes of the ears of the individual listeners, the noise, the characteristics inherent in the sound source and headphone to be used, and so on. The digital signals given change with respect to the head movement are converted by the D/A converters 19, 20 into the analog signals. The analog signals are amplified by the power amplifiers 21, 22 and then supplied to the headphone 24.

In this arrangement, the headphone 24 is the nonreflection type headphone having the left sound generator 26 and the right sound generator 25 as the hollow-cylinder-shaped headphone units and the headband 27.

In the audio reproducing apparatus shown in FIG. 36, as described with reference to FIG. 8, the two-channel digital signals added by the adders 15, 16 are given spatial information by the control apparatus 54 and 56 and corrected by the adaptive processing filters 340, 341 with respect to the difference among the shapes of the ears of the individual listeners, the noise, the characteristics inherent in the sound source and headphone to be used, and so on. The digital signals given change with respect to the head movement are converted by the D/A converters 19, 20 into the analog signals. The analog signals are amplified by the power amplifiers 21, 22 and then supplied to the headphone 24.

In this arrangement, the headphone 24 is the non-reflection type headphone having the left sound generator 26 and the right sound generator 25 as the hollow-cylinder-shaped headphone units and the headband 27.

In this case, the adaptive processing filters 340, 341 for correcting the difference among the shapes of the ears of the individual listeners, the noise, and the characteristics inherent in the sound source and headphone to be used may process signals in an analog or digital fashion. If the headphone is of a wireless type, then the adaptive processing filters may be provided in a main body of the headphone. The adaptive processing filters 340, 341 may not necessarily be housed in the main body of the headphone, but may be provided in cords of the headphone, for example, or may be provided in connector units for connecting the apparatus main body and the headphone or a subsequent stage thereof. Moreover, the adaptive processing filters may be provided in the control apparatus of the apparatus main body or a subsequent stage thereof.

The audio reproducing apparatus according to the embodiment is arranged as described above and operated as follows.

In the arrangement shown in FIG. 34, the audio signals are converted by the convolutional integrators 5, 7, 9 and 11, the memories 6, 8, 10 and 12, and the adders 15, 16 into the two-channel digital signals which have the same spatial information as the sound field and are supplied to both ears. The two-channel digital signals are corrected by the adaptive processing filters 340, 341 with respect to the difference among the shapes of the ears of the individual listeners, the noise, the characteristics inherent in the sound source and headphone to be used, and so on. The signals are amplified by the power amplifiers 21, 22 and then supplied to the headphone 24. Therefore, it is possible to realize the reproduction effect which allows the listener to perceive as if he listened to reproduced sounds from the speakers located in the virtual sound source positions.

In this arrangement, since the headphone 24 is the non-reflection type headphone having the left sound generator 26 and the right sound generator 25 as the hollow-cylinder-shaped headphone units and the headband 27, the reproduced sound is prevented from being reflected by the ears of the listener 23.

In the arrangement shown in FIG. 35, the audio signals are converted by the convolutional integrators 5, 7, 9 and 11, the memories 6, 8, 10 and 12 or the control apparatus 50, 51, 52 and 53 and the adders 15, 16 into the two-channel digital signals which have the same spatial information as the sound field and are supplied to both ears. The two-channel digital signals are corrected by the adaptive processing filters 340, 341 with respect to the difference among the shapes of the ears of the individual listeners, the noise, the characteristics inherent in the sound source and headphone to be used, and so on. The signals are amplified by the power amplifiers 21, 22 and then supplied to the headphone 24. Therefore, it is possible to realize the reproduction effect which allows the listener to perceive as if he listened to reproduced sounds from the speakers located in the virtual sound source positions.

In this arrangement, since the headphone 24 is the non-reflection type headphone having the left sound generator 26 and the right sound generator 25 as the hollow-cylinder-shaped headphone units and the headband 27, the reproduced sound is prevented from being reflected by the ears of the listener 23.

In the audio reproducing apparatus shown in FIG. 36, the digital signals added by the convolutional integrators 5, 7, 9 and 11, the memories 6, 8, 10 and 12 and the adders 15, 16 are converted by the control apparatus 54 and 56 into the two-channel digital signals which have the same spatial information as the sound field and are supplied to both ears. The two-channel digital signals are corrected by the adaptive processing filters 340, 341 with respect to the difference among the shapes of the ears of the individual listeners, the noise, the characteristics inherent in the sound source and headphone to be used, and so on. The signals are amplified by the power amplifiers 21, 22 and then supplied to the headphone 24. Therefore, it is possible to realize the reproduction effect which allows the listener to perceive as if he listened to reproduced sounds from the speakers located in the virtual sound source positions.

In this arrangement, since the headphone 24 is the non-reflection type headphone having the left sound generator 26 and the right sound generator 25 as the hollow-cylinder-shaped headphone units and the headband 27, the reproduced sound is prevented from being reflected by the ears of the listener 23.

According to the above embodiments, since the reflected wave of the audio signal and the noise characteristics are measured by the microphone provided in the headphone 24 so as to be opposed to the ear of the listener 23 and the adaptive processing filters 340, 341 generate the inverse characteristics of the characteristics of the sound wave reflected by the ear and the noise and correct the audio signals in respective channels corrected by the memories 6, 8, 10, 12 and 35, the convolutional integrators 5, 7, 9 and 11 and the control apparatus 50, 51, 52, 53, 54 and 56 based on the inverse characteristics of the characteristics of the sound wave reflected by the ear and the noise, it is possible to reproduce the audio signals under the same condition with respect to the wave reflected by the ear of the listener and the noise by removing the reflected wave and the noise and by smoothing the characteristics.

According to the above embodiments, based on the signal supplied from the digital angle detector and the analog angle detector 28, 38 as the angle detecting means and corresponding to the angle, the address of the memory 6, 8, 10, 12 or 35 is designated by the address signal from the address control circuit 34 as the address signal converting means to thereby read out the impulse response or the control signal stored in the memory 6, 8, 10, 12 or 35. The audio signals are corrected by the convolutional integrators 5, 7, 9 and 11 and the control apparatus 50, 51, 52, 53, 54 and 56 based on the impulse response or the control signal. The audio signals are corrected thereby with respect to the head movement of one or a plurality of listeners in a real-time fashion. By smoothing the reproduction characteristics, the adaptive processing filters 340, 341 correct the audio signals in respective channels corrected by the memories 6, 8, 10, 12 and 35, the convolutional integrators 5, 7, 9 and 11, and the control apparatus 50, 51, 52, 53, 54 and 56. Thus, it is possible to reproduce the audio signals by the hollow-cylinder-shaped sound generating units 25, 26, 93, 94, 103 and 104 of the audio reproducing means 24, 90 and 100 such that the waves reflected by the ears 23L, 23R of the listener 23 are canceled.

Figure 42:
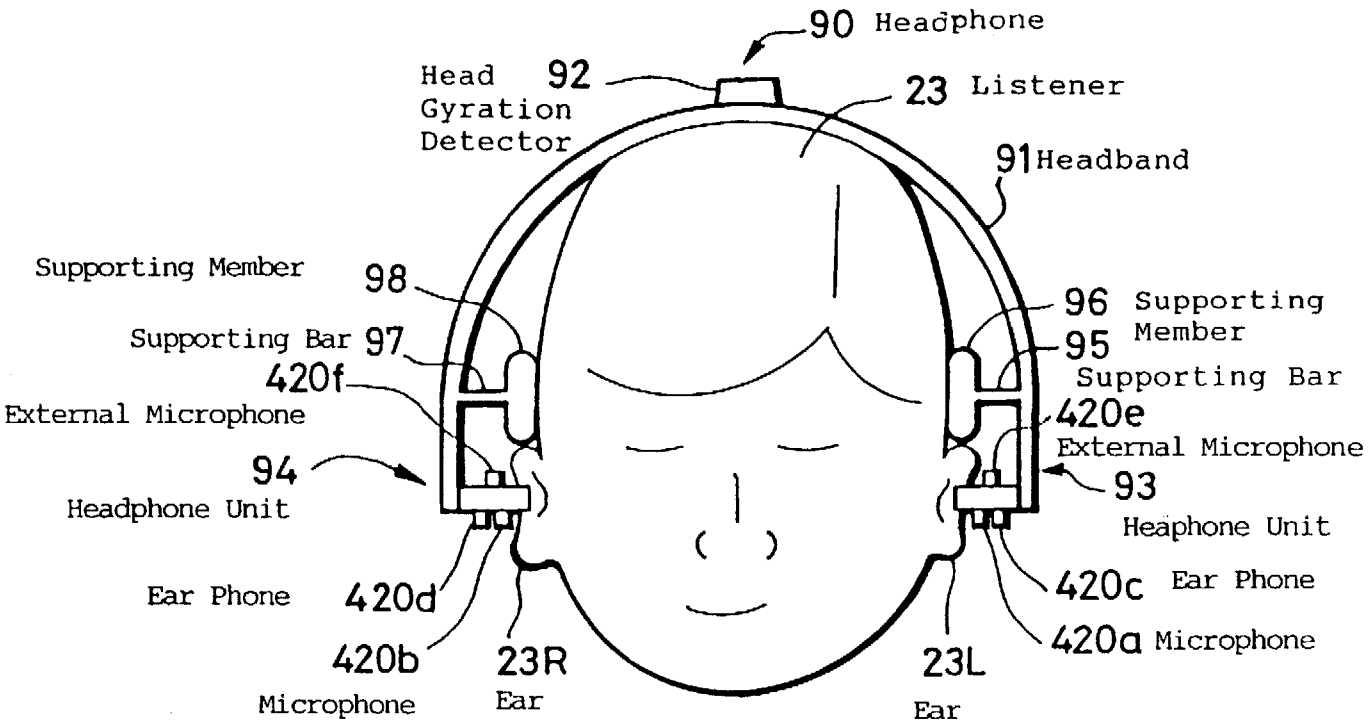
FIG. 42 is a diagram showing a non-reflection type headphone of the audio reproducing apparatus according to the embodiment of the present invention.

FIGS. 42 to 46 show examples of the headphones and microphone attachment positions of the audio reproducing apparatus according to the embodiment of the present invention. FIG. 42 shows the non-reflection type headphone of the audio reproducing apparatus according to the embodiment of the present invention. In an arrangement shown in FIG. 42, the head gyration detecting unit 92 and the hollow-cylinder-shaped headphone units 93, 94 are provided at the headband 91 of the headphone 90. Outer diameters of the headphone units 93, 94 are substantially the same as the diameters of the earholes of the ears 23L, 23R of the listener 23 and the headphone units are provided so as to be opposed to the earholes. The supporting bodies 96, 98 are provided in the vicinity of the positions, where the headphone units 93, 94 are attached to the headband 91, and on the inner side of the headband with being projected from the supporting bars 95, 97. With this arrangement, the listener 23 can put the headphone on the head with the headphone units 93, 94 being placed apart from the ears 23L, 23R of the listener 23 at a predetermined distance. At this time, the headphone units 93, 94 are provided with microphones **420*a*, 420*b* and earphones 420*c*, 420*d* which are opposed to the inner peripheral surfaces of the hollow-cylinder-shaped headphone units. Thus, the reproduction characteristics are measured thereby. External sounds picked up by external microphones 420*e*, 420*f* are added as signals output from the external microphones 420*e*, 420*f* to signals supplied to the earphones 420*c*, 420*d***, which allows the listener to listen to the external sound.

According to the above arrangement, since the headphone 90 as the audio reproducing means is provided with the headband 91 as the head mount body which can be mounted on the heads of one or a plurality of listeners and the headband 91 is provided with the supporting bars 95, 97 and the supporting bodies 96, 98 as the supporting members for supporting the headphone units 93, 94 as the sound generating units such that the open ends of the headphone units are located away from the ears of the listener 23 at an interval so as not to press against the ears, the radiation impedance from the inlets of the external auditory canals thereof to the outside becomes approximate to that obtained when the listener does not put the headphone on the head. Therefore, it is possible to facilitate the localization of the reproduced sound image and it is possible for the listener to feel more comfortable when putting the headphone on the head.

Figure 43:
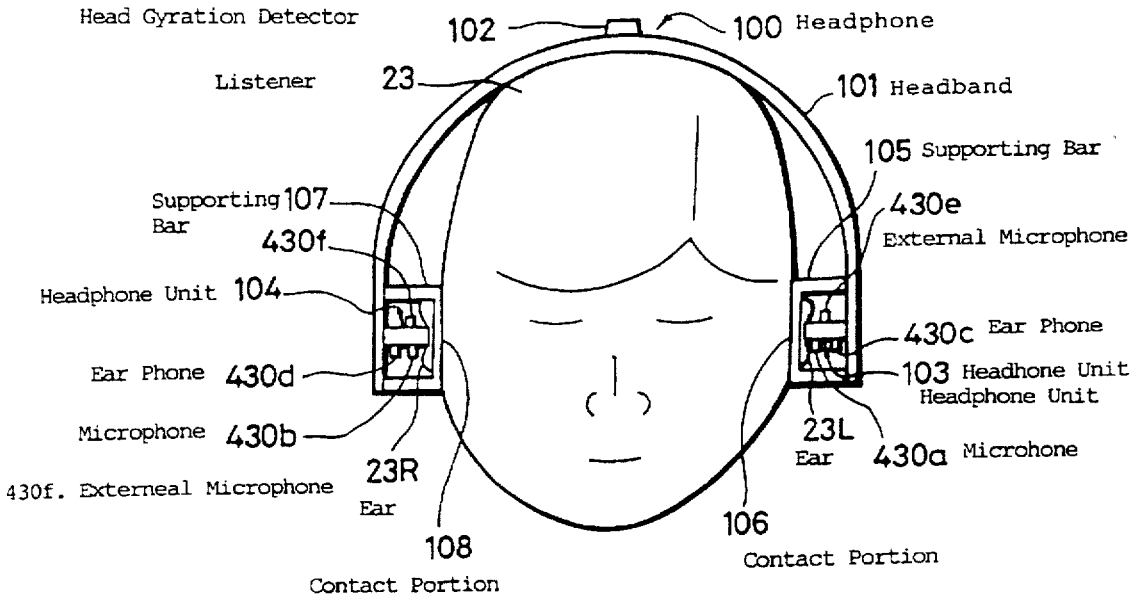
FIG. 43 is a diagram showing the non-reflection type headphone of the audio reproducing apparatus according to the embodiment of the present invention.

FIG. 43 shows a non-reflection type headphone of the audio reproducing apparatus according to the embodiment of the present invention. In the arrangement shown in FIG. 43, the head gyration detecting unit 102 and the hollow-cylinder-shaped headphone units 103, 104 are provided at the headband 101 of the headphone 100. Outer diameters of the headphone units 103, 104 are substantially the same the diameters of the earholes of the ears 23L, 23R of the listener 23 and the headphone units are provided so as to be opposed to the earholes. The ring-shaped contact portions 106, 108 are provided on the inner sides of the headphone units 103, 104 so as to be projected from the supporting bars 105, 107. With this arrangement, the listener 23 can put the headphone on the head with the headphone units 103, 104 being placed apart from the ears 23L, 23R of the listener 23 at a predetermined distance. At this time, the headphone units 103, 104 are provided with microphones 430*a*, 430*b* and earphones 430*c* and 430*d* which are opposed to inner peripheral surface of the hollow-cylinder-shaped headphone units. Thus, the reproduction characteristics can be measured thereby. Also, external microphones 430*e* and 430*f* are provided therein, so that the listener can listen to the external sound. The head gyration detectors 92, 102 are the digital angle detectors 28 or the analog angle detectors 38.

According to the above arrangement, since the headphone 100 as the audio reproducing means is provided with the headband 101 as the head mount body which can be mounted on the head of one or a plurality of listeners and the headband 101 is provided with the supporting bars 105, 107 and the contact portions 106, 108 as the supporting members for supporting the headphone units 103, 104 as the sound generating units such that open ends of the headphone units are kept away from the ears 23L, 23R of the listener 23 at an interval enough so as not to press against the earholes of the listener, the radiation impedance from the inlets of the external auditory canals thereof to the outside becomes approximate to that obtained when the listener does not put the headphone on the head. Therefore, it is possible to facilitate the localization of the reproduced sound image and it is possible for the listener to feel more comfortable when putting the headphone on the head.

Figure 44:
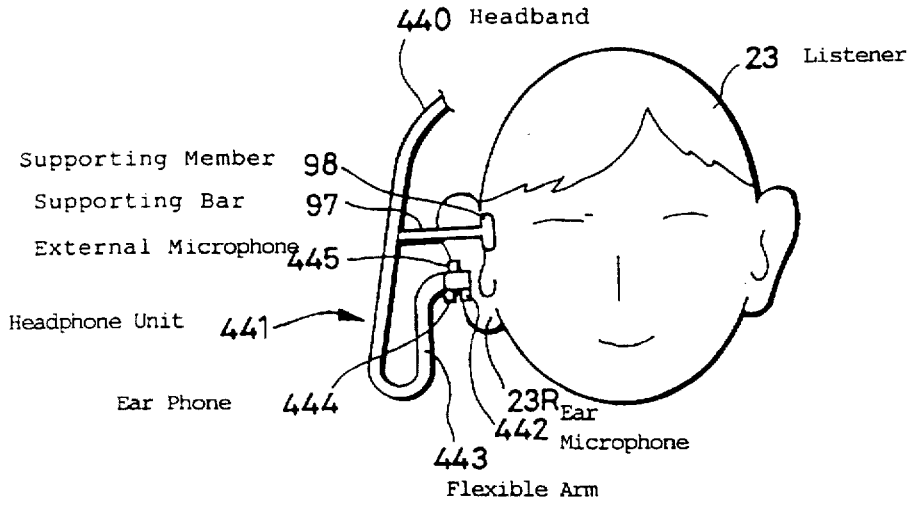
FIG. 44 is a diagram showing the attachment position of the microphone in the audio reproducing apparatus according to the embodiment of the present invention.
Figure 45:
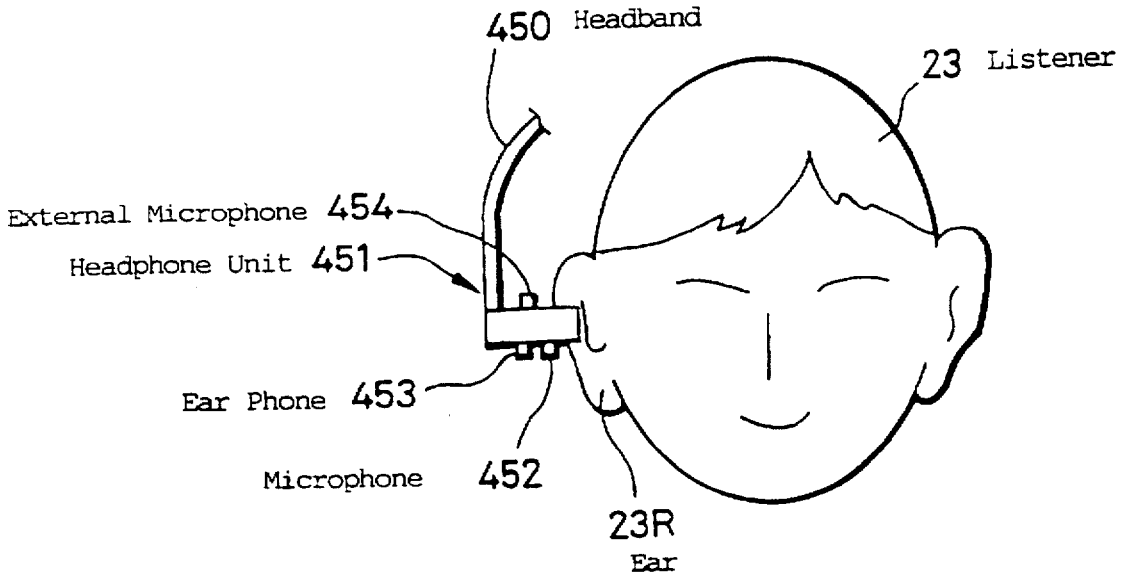
FIG. 45 is a diagram showing the attachment position of the microphone in the audio reproducing apparatus according to the embodiment of the present invention.
Figure 46:
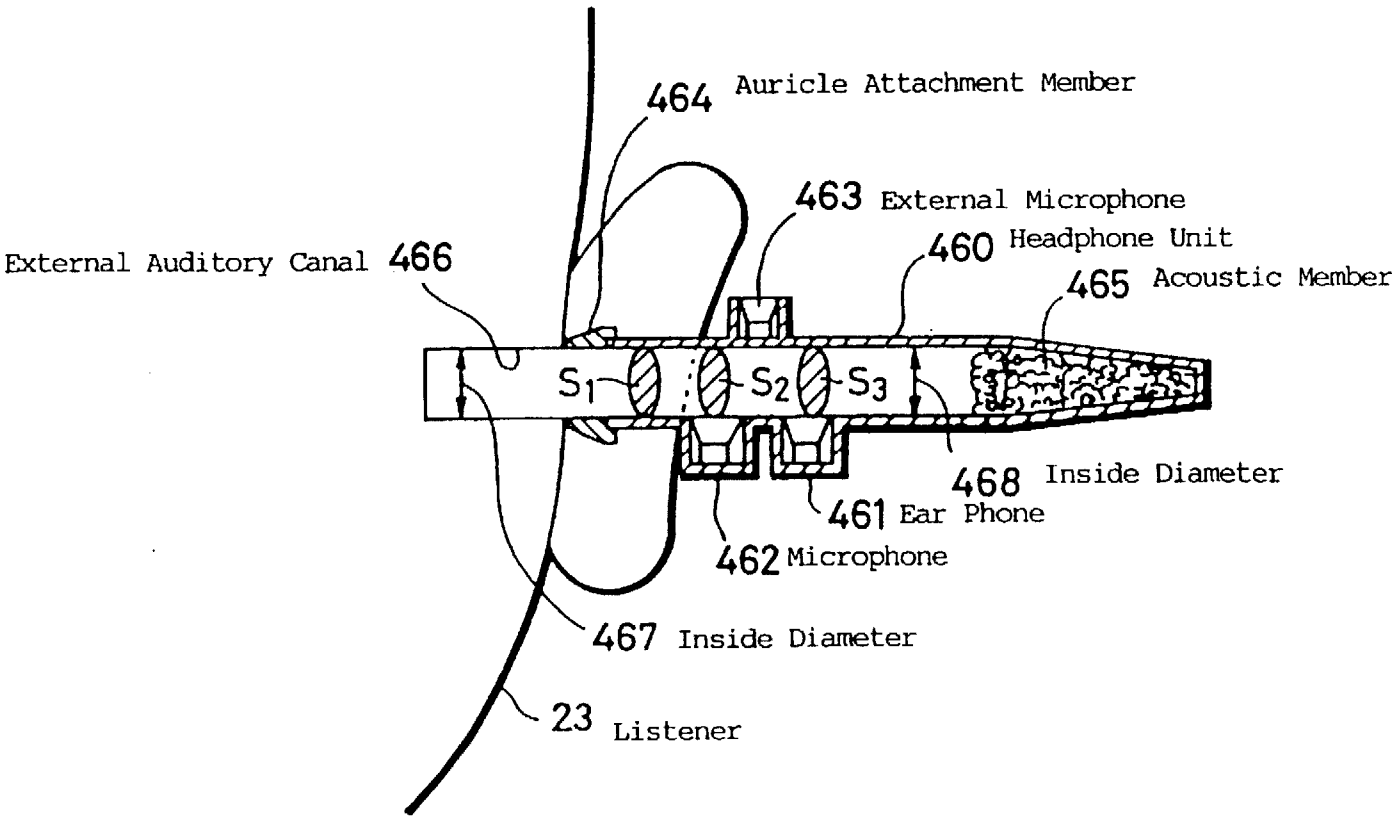
FIG. 46 is a diagram showing the attachment position of the microphone in the audio reproducing apparatus according to the embodiment of the present invention.

In this case, specific positions where the microphones are attached are shown in FIGS. 44 to 46. In the arrangement shown in FIG. 44, a microphone 442 and an earphone 444 are provided through a hollow-cylinder-shaped flexible arm 443 at a hollow-cylinder-shaped headphone unit 441 provided at an end portion of a headband 440 such that the microphone and the earphone are opposed to an inner peripheral surface of the hollow-cylinder-shaped headphone unit. An external sound picked up by an external microphone 445 is added as a signal output from the external microphone 445 to a signal supplied to the earphone 444, so that the listener can listen to the external sound. Also, in this case, as shown in FIG. 9, the supporting bar 97 and the supporting body 98 keep the space between the headphone unit 441 and the auricle at a constant interval.

According to the above embodiment, since the microphone 442 provided in the headphone so as to be opposed to the earhole of the listener 23 is opposed by the hollow-cylinder-shaped flexible arm 443 as the flexible supporting member to the earhole of the listener 23, it is possible to reliably measure the noise, such as the reflected wave entering the earhole of the listener 23 through an actual measurement by moving an open end of the headphone unit with fine adjustment. Thus, it is possible for the adaptive processing filters to correct the digital signals with inverse characteristics.

According to the above embodiment, since a hollow-cylinder-shaped portion of the headphone unit 441 provided at the headphone has the flexible arm 443 as a flexible portion, it is possible to finely adjust a position of the open end of the headphone unit 441 so that the open end should be opposed to a position of the listener's ear which is different every time when the listener puts the headphone or a position of the ear which is different depending upon the individual listeners 23.

In an arrangement shown in FIG. 45, a hollow-cylinder-shaped headphone unit 451 is provided at an end portion of a headband 450. A microphone 452 and an earphone 453 are provided such that diaphragms thereof are parallel to an inner peripheral surface of a hollow-cylinder portion of the headphone unit 451, so that the reproduction characteristics can be measured. An external sound picked up by an external microphone 454 is added as a signal output from the external microphone 454 to a signal supplied to the earphone 453, so that the listener can listen to the external sound.

According to the above arrangement, since the microphone 123 provided in the headphone so as to be opposed to the ears of the listener 23 is a microphone fixed to the arm 122 as the supporting member so as to be opposed to the earholes of the listener 23, it is possible to reliably measure the noise, such as the reflected wave entering the earhole or the like, through an actual measurement. Thus, it is possible for the adaptive processing filters to correct the digital signals with inverse characteristics.

FIG. 46 is a cross-sectional view showing an attachment position of a microphone of the audio reproducing apparatus according to the present invention.

In an arrangement shown in FIG. 46, there is provided a headphone unit 460 which has an inside diameter 468 substantially the same as an inner diameter 467 of an external auditory canal 466 and has an auricle attachment member 464 made of elastic material such as synthetic resin, rubber or the like at its one end side and an acoustical member 465 made of felt or the like at the other end side so that the other end should be a non-reflection end. An earphone 461 and a microphone 462 are provided on a peripheral surface of the headphone unit 460 approximate to each other with their diaphragms facing to an inner surface of the headphone unit.

The headphone unit 460 is a headphone body, has the inner diameter 468 which is uniform or substantially the same as the inside diameter 468 of the external auditory canal 466, and is provided with the acoustical material 465 at the other end side so that the other end should be the end which does not reflect the sound. Thus, an acoustic impedance of the headphone unit 460 is set substantially the same as an impedance of the external auditory canal 466. The headphone unit is formed so as to prevent a so-called lateralization phenomenon.

In order to prevent the above acoustic impedance from being changed, the earphone 461 and the microphone 462 are fitted to the headphone unit 460 such that their diaphragms are parallel to the side surface of the headphone unit 460 and an area of a cross section S1 of the headphone unit 460 is substantially the same as areas of cross sections S2, S3 of portions to which the earphone 461 and the microphone 462 are respectively fitted. An external sound picked up by an external microphone 463 is added as a signal output from the external microphone 463 to a signal supplied to the earphone 461, so that the listener can listen to the external sound.

According to the above embodiment, since the headphone unit 460 has the auricle attachment member 461 at the one end side and the acoustical member 465 at the other end and the earphone 461 and the microphone 462 are provided with their diaphragms being parallel to the inner peripheral surface of the headphone unit 460, it is possible to reliably measure the noise, such as the reflected wave entering the earhole or the like, through an actual measurement. Thus, it is possible for the adaptive processing filters to correct the digital signals with inverse characteristics.

Figure 47:
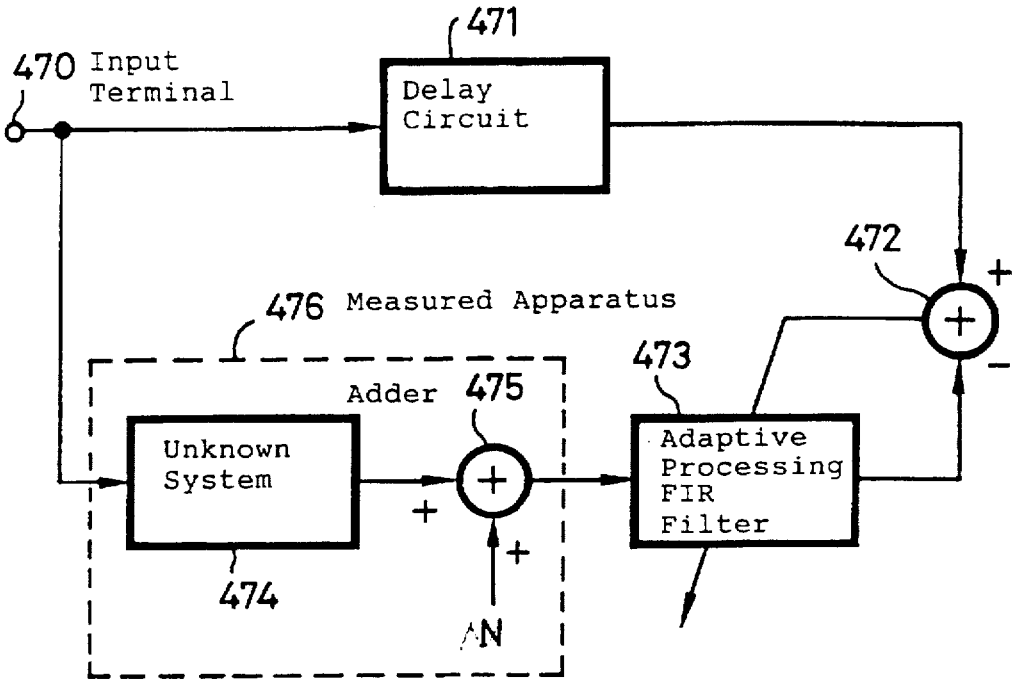
FIG. 47 is a block diagram showing an arrangement using an adaptive processing FIR filter of indirect execution type in the audio reproducing apparatus according to the embodiment of the present invention.
Figure 48:
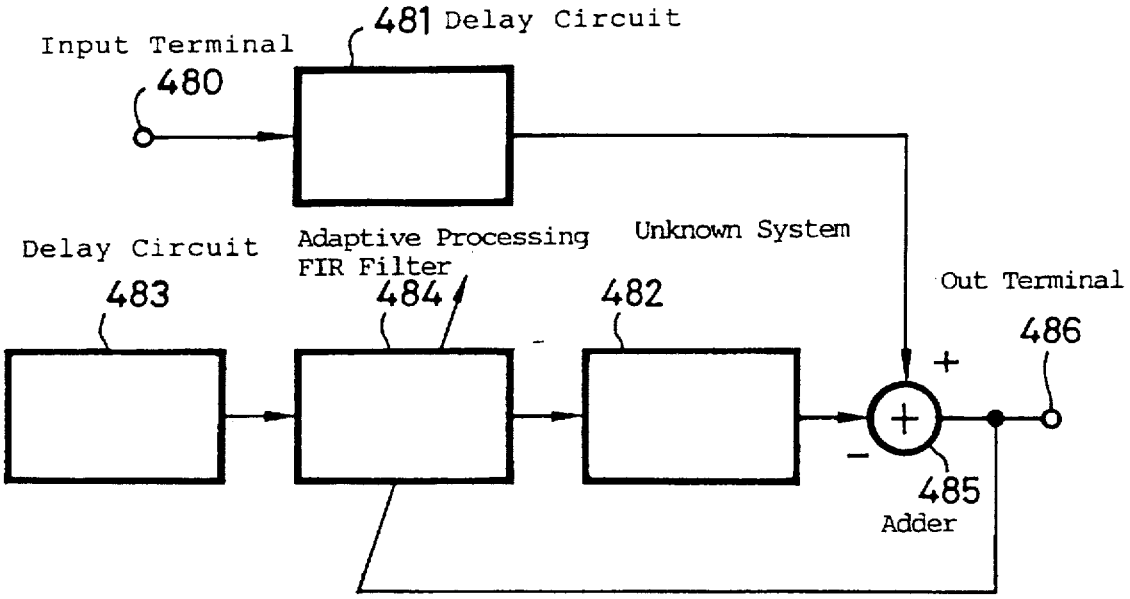
FIG. 48 is a block diagram showing an arrangement using an adaptive processing FIR filter of direct execution type in the audio reproducing apparatus according to the embodiment of the present invention.

FIG. 47 and 48 show block diagrams showing arrangements used to calculate the inverse characteristics by using the adaptive processing filters. FIG. 47 is a block diagram showing an arrangement in which an adaptive processing FIR filter of an indirect execution type is used. In FIG. 47, an input signal is supplied to an input terminal 470. The input signal is supplied to a delay circuit 471 and also to an apparatus 476 to be measured. In the apparatus 476 to be measured, an adder 475 adds a signal supplied thereto from an unknown system 474 and a noise formed of a maximum period sequence signal which is a digitally generated binary pseudo irregular signal. The added signal is supplied therefrom to an adaptive processing FIR filter 473.

An adder 472 adds a minus amount of a signal output from the adaptive processing FIR filter 473 to a signal output from the delay circuit 471. A signal output from the adder 142 is supplied to the adaptive processing FIR filter 473. Thus, the adaptive processing FIR filter 473 adjusts the signal output from the adder 472 so as to converge a value of the signal toward a value of zero. Thus, inverse characteristics of the unknown system 474 are calculated. By using a filter coefficient obtained after the convergence, the fixed adaptive processing FIR filter 473 smooths the characteristics of the unknown system 474.

In this case, the input signal supplied to the input terminal 470 may be the audio signals supplied from the multichannel digital signal source 1 or the multichannel analog signal source 2 shown in each of FIGS. 34, 35 and 36. The noise formed of the maximum period sequence signal which is the digitally generated binary pseudo irregular signal may be used as the input signal in order that the value of the signal output from the adder can promptly become zero. In the audio reproducing apparatus shown in FIGS. 34, 35 and 36, an input to the unknown system 474 is the audio signals applied to the sound generators 25, 26 of the headphone 24 or the headphone units 93, 94, 103, 104, 391, 401 or 411 of the headphone 90, 100, and an output therefrom is the audio signals obtained by picking up sounds by the microphones 370*a*, 370*b*, 380*a*, 380*b*, 392, 403 and 412 shown in FIGS. 37 to 41.

As described above, the inverse characteristics of the characteristics inherent in the headphone are calculated by using the microphones 370*a*, 370*b*, 380*a*, 380*b*, 392, 403 and 412 shown in FIGS. 37 to 41. The adaptive processing FIR filter 473 smooths frequency characteristics of the audio signals to be reproduced by using the coefficient obtained from the impulse responses to the unknown system.

In this case, the input signal supplied to the input terminal 470 may be the audio signals supplied from the multichannel digital signal source 1 or the multichannel analog signal source 2 shown in each of FIGS. 34, 35 and 36. The noise formed of the maximum period sequence signal which is the digitally generated binary pseudo irregular signal may be used as the input signal in order that the value of the signal output from the adder can promptly become zero. In the audio reproducing apparatus shown in FIGS. 34, 35 and 36, an input to the unknown system 474 is the audio signals applied to the sound generators 25, 26 of the headphone 24 or the headphone units 93, 94, 103, 104, 441, 451 and 460 of the headphones 90 and 100, and an output therefrom is the audio signals obtained by picking up sounds by the microphones 420*a*, 420*b*, 430*a*, 430*b*, 442, 452 and 462 shown in FIGS. 42 to 46.

As described above, the inverse characteristics of the characteristics inherent in the headphone are calculated by using the microphones 420*a*, 420*b*, 430*a*, 430*b*, 442, 452 and 462 shown in FIGS. 42 to 46. The adaptive processing FIR filter 473 smooths frequency characteristics of the audio signals to be reproduced by using the coefficient obtained from the impulse responses to the unknown system.

According to the above embodiment, since the adaptive processing filters 340, 341 are those of the indirect execution type which carry out processings based on the inverse characteristics after measurement of the characteristics, it is possible to smooth the characteristics of the unknown system by generating the inverse characteristics thereof based on the measurement of the characteristics.

FIG. 48 is a block diagram showing an arrangement in which an adaptive processing FIR filter of a direct execution type is used. In FIG. 48, an input signal or a measurement noise is supplied to an input terminal 480. The input signal or the added noise is supplied to delay circuits 481 and 483. A signal output from the delay circuit 483 is supplied to an adaptive processing FIR filter 484.

An adder 485 adds a signal output from the delay circuit 481 and a minus amount of a signal supplied from the adaptive processing FIR filter 484 through an unknown system 482. At this time, if an extraneous noise entering the unknown system 482 has no correlation with the input signal, then the characteristics of a system from the audio reproducing means to the microphone are corrected by making the signal from the adaptive processing FIR filter 484 through the unknown system 482 more approximate to the input signal supplied to the input terminal 480. Only the signal is output to an output terminal 486. Accordingly, the extraneous noise entering the unknown system 482 can also be removed.

According to the above arrangement, since the adaptive processing filters 340, 341 are those of the direct execution type which successively carry out the measurement of the characteristics of the unknown system and the processing based on the inverse characteristics thereof, it is possible for the adaptive processing filters to smooth the characteristics while carrying out the measurement of the characteristics and the generation of the inverse characteristics.

According to the above embodiment, since the adaptive processing filters 340, 341 set the predetermined target values and correct the characteristics inherent in the headphones 24, 90 and 100 such that the values of the characteristics becomes approximate to the target values, it is possible to constantly reproduce the sound approximate to the sound from the sound source even if the headphone 24, 90 or 100 is replaced with another one.

Since the proper reverberation signals generated by the reverberation circuits 13, 14 are added to the reproduced sounds if necessary, it is possible to obtain the presence which allows the listener to feel as if he listened to the music in a famous concert hall. Moreover, the adaptive processing filters 340, 341 may set the sound field by setting a target value of the sound field in the adaptive processing filters 340, 341.

According to the above embodiment, since the adaptive processing filters 340, 341 set predetermined target values and correct the characteristics by making values of the characteristics approximate to the target values such that the sound field becomes approximate to a predetermined sound field, it is possible to reproduce optional sound fields such as a specific theater, a specific concert hall or the like According to the present invention, based on the signal supplied from the angle detecting means and corresponding to the angle, the address of the storage means is designated by the address signal from the address signal converting means. The impulse response or the control signal stored in the storage means is read out therefrom. Based on the impulse response or the control signal, the audio signals are corrected by the control means. The audio signals are corrected thereby with respect to the head movement of one or a plurality of listeners in a real-time fashion. The adaptive processing filters correct the audio signals in respective channels corrected by the control means by smoothing the reproduction characteristics of the audio signals. Thus, it is possible to reproduce the audio signals by the hollow-cylinder-shaped sound generating units of the audio reproducing means so that the sound wave reflected by the listener's ear should be canceled.

According to the present invention, since the audio reproducing means is provided with the head mount body which can be mounted on the head of one or a plurality of listeners and the supporting members for supporting the headphone units at the head mount body such that the open end of the sound generating units are kept away from the listener's ears at an interval enough for the open end not to press against the listener's earholes, the radiation impedance from the inlet of the external auditory canal to the outside becomes approximate to that obtained when the listener does not put the audio reproducing means on the head. Therefore, it is possible to facilitate the localization of the reproduced sound image and for the listener to feel more comfortable when putting the audio reproducing means on the head.

According to the present invention, since the characteristics of the wave reflected by the earhole and the noise characteristics are measured by the microphone and the adaptive processing filters generate the inverse characteristics of the characteristics of the wave reflected by the earhole and the noise characteristics and correct the audio signals in respective channels corrected by the control means based on the inverse characteristics of the characteristics of the wave reflected by the earhole and the noise characteristics, it is possible to reproduce the audio signals under the same condition with respect to the reflected wave at the ear and the extraneous noise caused by the difference among the shapes of the ears of the individual listeners by removing the reflected wave and the noise and by smoothing the characteristics.

According to the present invention, since the adaptive processing FIR filters are employed as the adaptive processing filters, it is possible to form the digital filters by programs under the desired conditions and to process the audio signals in a digital signal fashion.

According to the present invention, since the microphone is provided with its diaphragm being parallel to the inner peripheral surface of the hollow-cylinder-shaped tube, it is possible to reliably measure the noise entering the earhole of the listener, through an actual measurement. Thus, it is possible for the adaptive processing filters to correct the digital signals based on the inverse characteristics.

According to the present invention, since the hollow-cylinder-shaped portion of the sound generating unit provided in the audio reproducing means has flexible portion, it is possible to finely adjust a position of the open end of the sound generating unit so that the open end of the sound generating unit should be opposed to the position of the ear which is different every time when the listener puts on the headphone or the position of the ear which is different depending on the individual listeners.

According to the present invention, since the adaptive processing filters set predetermined target values and correct the characteristics inherent in the audio reproducing means such that the values of the characteristics becomes approximate to the target values, it is possible to constantly reproduce the sound approximate to the sound from the sound source even if the audio reproducing means is replaced with another one.

According to the present invention, since the adaptive processing filters set predetermined target values and correct the characteristics inherent in the audio reproducing means by making the values of the characteristics approximate to the target values such that the sound field becomes approximate to a predetermined sound field, it is possible to reproduce optional sound fields such as a specific theater, a specific concert hall or the like.

According to the present invention, since the adaptive processing filters are those of the indirect execution type which carry out processings based on the inverse characteristics after measurement of the characteristics, it is possible to smooth the characteristics of the unknown system by generating the inverse characteristics thereof based on the measurement of the characteristics.

According to the present invention, since the adaptive processing filters are those of the direct execution type which successively carry out the measurement of the characteristics of the unknown system and the processing based on the inverse characteristics thereof, it is possible for the adaptive processing filters to smooth the characteristics while carrying out the measurement of the characteristics and the generation of the inverse characteristics.

INDUSTRIAL APPLICABILITY

The audio reproducing apparatus and the headphone according to the present invention are suitable for reproduction of the audio signal by the headphone. Since they cancel the sound reflected by the ears, smooth the reproduction characteristics and remove the noise caused by the reflected wave, they are particularly suitable for application to the audio reproducing apparatus which reproduces a proper audio signal regardless of an environment.

We claim:

1. An audio reproducing apparatus comprising:

a signal source for supplying recorded audio signals in a plurality of channels;

storage means which, after an impulse response from a virtual sound source position with respect to a reference direction of a listener's head and both ears corresponding to a head movement of the listener is measured, stores the measured impulse response or which, after a difference in time between audio signals from a virtual sound source position with respect to the reference direction of the listener's head and both ears of said listener and a difference in a level therebetween are measured at every angle which the listener can recognize, stores a control signal representing the difference in time between said audio signals and the difference in the level therebetween;

at least one angle detecting means for detecting a head movement of at least one listener with respect to said reference direction at every predetermined angle to output a detection signal;

address signal generating means for converting an angle detected by said angle detecting means into an address signal;

control means for correcting the audio signals in respective channels from said signal source based on the impulse response or the control signal stored in said storage means; and audio signal reproducing means which has a pair of sound generating units, wherein each of said pair of sound generating units includes a baffle plate forming a 90 degrees angle with a straight line passing through said both ears of the listener, and a diaphram forming an angle with said straight line other than 90 degrees, and wherein said pair of sound generating units is disposed at positions opposed to both ears of the listener and supplied with the audio signals provided by said control means for mounting on the listener's head and is provided such that a radiation impedance from an inlet of an external auditory canal of the ear of the listener to the outside becomes approximate to that obtained when the audio reproducing means is not mounted, wherein and address of said storage mean is designated by an address signal output from said address signal generating means based on a detection signal from said angle detecting means, the impulse response or the control signal stored in said storage means is read out therefrom, said control means corrects the audio signals supplied from said signal source with respect to a head movement of said at least one listener in a real-time fashion in response the impulse response or the control signal read out from said storage means, and the radiation impedance of said audio reproducing means from the inlet of the external auditory canal to the outside is set approximate to that obtained when the audio reproducing means is not mounted, thereby sound generation characteristics of said sound generation unit are set approximate to characteristics obtained when said audio signals were recorded.

2. An audio reproducing apparatus according to claim 1, wherein each of said sound generating units have an opening portion defined at least at a position opposed to the listener's ear and the sound generating characteristics of said sound generating units are set approximate to characteristics obtained when said audio signals were recorded.

3. An audio reproducing apparatus according to claim 2, wherein said audio reproducing means comprises a head mount body which can be mounted on the listener's head and supporting means for supporting said respective sound generating units at positions of said head mount body which are away from the listener's ears by a predetermined distance.

4. An audio reproducing apparatus according to claim 3, wherein said pair of sound generating units are disposed so as to be opposed to both the left and right ears of said listener and planes of said respective sound generating units opposed to the listener's left and right ears are inclined at an angle relative to a straight line passing through the centers of both the left and right ears of the listener.

5. An audio reproducing apparatus according to claim 1, wherein said sound generating units are disposed so as to be opposed to both left and right ears of said listener, and planes of said respective sound generating units opposed to the listener's left and right ears being inclined at a predetermined angle relative to a straight line passing through the centers of both the listener's left and right ears so as to be rotated around a line perpendicular to a straight line passing through the centers of said both ears.

6. An audio reproducing apparatus according to claim 5, wherein said sound generating units are disposed so as to be opposed to both left and right ears of said listener, and provided with planes of said respective sound generating units opposed to the listener's left and right ears being inclined at a predetermined angle relative to the straight line passing through centers of said listener's both ears so as to be rotated around a line in the vertical direction of the listener's head and within planes perpendicular to a straight line passing through the centers of the listener's both left and right ears.

7. An audio reproducing apparatus according to claim 5, wherein said sound generating units are disposed so as to be opposed to both left and right ears of said listener, and provided with planes of said respective sound generating units opposed to the listener's left and right ears being inclined at a predetermined angle relative to the straight line passing through centers of said both ears with reference to a line in the direction to a listener's face and within planes perpendicular to a straight line passing through the centers of the listener's both left and right ears.

8. An audio reproducing apparatus according to claim 3, wherein said supporting means comprises a supporting mechanism which moves each respective surface plane of said sound generating units opposed to listener's left and right ears close to or away from the listener's left and right ears.

9. An audio reproducing apparatus according to claim 2, wherein each of said sound generating units is formed of a plurality of sound generator units and said respective sound generator units are supplied with signals obtained by dividing a frequency band of a corrected audio signal to be supplied to said audio reproducing means into a plurality of frequency bands.

10. An audio reproducing apparatus according to claim 2, wherein said audio reproducing means comprises an attachment member for attaching said sound generating units, said sound generating unit being disposed substantially in parallel to a side of a listener's head and said sound generating units being attached to said attachment member with a diaphragm of said sound generating units, respectively, being inclined at a predetermined angle.

11. An audio reproducing apparatus according to claim 1, wherein said audio reproducing means comprises a head mount body which can be mounted on a listener's head and a supporting means for supporting said respective sound generating units at positions located away from the listener's ears by a predetermined distance.

12. An audio reproducing apparatus according to claim 11, wherein said pair of sound generating units are disposed so as to be opposed to both left and right ears of said listener and the surface planes of said respective sound generating units opposed to the listener's left and right ears are inclined at an angle relative to a straight line passing through the centers of both the left and right ears of the listener.

13. An audio reproducing apparatus according to claim 11, wherein said sound generating units are disposed so as to be opposed to the left and right ears of said listener, and surface planes of said respective sound generating units opposed to the listener's left and right ears are inclined at a predetermined angle relative to a straight line passing through the centers of the listener's left and right ears so as to be rotated around a line perpendicular to the straight line passing through the centers of said both ears.

14. An audio reproducing apparatus according to claim 13, wherein said sound generating units are disposed so as to be opposed to both left and right ears of said listener, and the surface planes of said respective sound generating units opposed to the listener's left and right ears are inclined at a predetermined angle relative to the straight line passing through the centers of said both ears with reference to a line in the vertical direction of the listener's head and within planes perpendicular to a straight line passing through the centers of the listener's left and right ears.

15. An audio reproducing apparatus according to claim 13, wherein said sound generating units are disposed so as to be opposed to both left and right ears of said listener, and the surface planes of said respective sound generating units opposed to the listener's left and right ears are inclined at a predetermined angle relative to the straight line passing through the centers of said both ears with reference to a line in the direction to a listener's face and within planes perpendicular to a straight line passing through the centers of the listener's left and right ears.

16. An audio reproducing apparatus according to claim 11, wherein said supporting means comprises a supporting mechanism which moves the surface planes of said sound generating units opposed to listener's left and right ears close to or away from the listener's left and right ears.

17. An audio reproducing apparatus according to claim 11, wherein each of said sound generating units is formed of a plurality of sound generator units and said respective sound generator units are respectively supplied with signals obtained by dividing a frequency band of a corrected audio signal to be supplied to said audio reproducing means into a plurality of frequency bands.

18. An audio reproducing apparatus according to claim 11, wherein said audio reproducing means comprises an attachment member for attaching thereto said sound generating unit, said sound generating unit being disposed substantially in parallel to a side of a listener's head and said sound generating unit being attached to said attachment member with a diaphragm of said sound generating unit being inclined at a predetermined angle.

19. An audio reproducing apparatus comprising:

a signal source for supplying audio signals in a plurality of channels;

storage means which, after an impulse response from a virtual sound source position with respect to a reference direction of a head of a listener and both ears corresponding to a movement of the head of the listener is measured to form a measured impulse response, stores the measured impulse response or which, after a difference in time between the audio signals from the virtual sound source position with respect to the reference direction of the head and said both ears of said listener and a difference in a level therebetween are measured at every angle which the listener can recognize, stores a control signal representing the difference in time between said audio signals and the difference in the level therebetween;

at least one angle detecting means for detecting the movement of the head of the listener with respect to said reference direction at every predetermined angle to output a detection signal;

address signal generating means for converting an angle detected by said angle detecting means into an address signal;

control means for correcting the audio signals in said plurality of channels from said signal source based on the impulse response or the control signal read out from said storage means in response to said address signal;

audio signal reproducing means including a pair of sound generating units, wherein each of said pair of sound generating units includes a baffle plate forming a 90 degree angle with a straight line passing through said both ears of the listener, and a diaphragm forming an angle with said straight line other than 90 degrees, and wherein said audio signal reproducing means, which has a microphone provided so as to be opposed to one of said both ears of the listener for mounting on the head of the listener, is supplied with the audio signals corrected by said control means and reproduces the audio signals supplied by said signal source; and an adaptive processing filter which, after reproduction characteristics of the audio signals output from said audio signal reproducing means are measured by said microphone to form measured results, subjects said reproduction characteristics to a smoothing processing based on said measured results to thereby process the audio signals provided by said control means, wherein the impulse response or the control signal of said storage means is designated by the address signal output from said address signal generating means based on the detection signal from said angle detecting means and said control means corrects the audio signals from said signal source are corrected with respect to the movement of the head of the listener in a real-time fashion, and the corrected audio signals in said plurality of channels provided by said control means are processed by said adaptive processing filter by subjecting said reproduction characteristics to said smoothing processing and then reproduced by said audio reproducing means.

20. The audio reproducing apparatus according to claim 19, wherein said audio reproducing means comprises a head mount body which enables said audio reproducing means to be mounted on the head of the listener and a supporting means for supporting said microphone on said head mount body at a position away from one of said both ears of the listener by a predetermined distance.

21. The audio reproducing apparatus according to claim 20, wherein said audio reproducing means comprises a holding means for holding said microphone at a position opposed to an earhole of the listener.

22. The audio reproducing apparatus according to claim 21, wherein said audio reproducing means comprises a pair of sound generating units respectively supplied with said recorrected audio signals provided by said adaptive processing filter and said holding means holding said microphone at a position which is opposed to the earhole of the listener and said microphone is closer to an auricle of a listener as compared with said sound generating units.

23. The audio reproducing apparatus according to claim 21, wherein said audio reproducing means comprises a pair of sound generating units supplied with said recorrected audio signals provided by said adaptive processing filter and a pair of microphones, wherein said holding means holding said pair of microphones at positions which are opposed to earholes of a listener and are projected toward said auricles as compared with said pair of sound generating units.

24. The audio reproducing apparatus according to claim 21, wherein said holding means is provided at one end in said audio reproducing means and has at its other end a flexible supporting member to which said microphone is attached.

25. The audio reproducing apparatus according to claim 19, wherein said reproduction characteristic include reflection characteristics and noise characteristics, after the reflection characteristics and the noise characteristics of said audio signals at an earhole of a listener are measured by said microphone, said adaptive processing filter generates inverse characteristics of the reflection characteristics and the noise characteristics at the earhole based on said measured results, and corrects said corrected audio signals in said plurality of channels provided by said control means based on said inverse characteristics of the reflection characteristics and the noise characteristics.

26. The audio reproducing apparatus according to claim 25, wherein an adaptive processing FIR filter is employed as said adaptive processing filter.

27. The audio reproducing apparatus according to claim 25, wherein said adaptive processing filter sets a predetermined target value and corrects characteristics inherent in said audio reproducing means such that a value thereof becomes approximate to said target value.

28. The audio reproducing apparatus according to claim 25, wherein said adaptive processing filter sets a predetermined target value and carries out a correction by making a value approximate to said target value such that a sound field becomes approximate to a predetermined one.

29. The audio reproducing apparatus according to claim 25, wherein said adaptive processing filter is an indirect execution type filter which, after characteristics are measured based on an output from said microphone, carries out processing based on inverse characteristics thereof.

30. The audio reproducing apparatus according to claim 25, wherein said adaptive processing filter is a direct execution type filter which successively carries out measurements of characteristics based on an output from said microphone and processing based on inverse characteristics thereof.

31. The audio reproducing apparatus according to claim 19, wherein said audio reproducing means comprises a pair of sound generating units which can be attached to respective earholes of said both ears of the listener, wherein each of said Pair of sound generating units comprises a hollow cylinder-shaped member having a non-reflection portion at one end and an open end at the other end opposed to an earhole of the listener and having substantially the same inner diameter as that of an external auditory canal of the listener, said microphone being arranged on a side surface of said cylinder-shaped member, and a sound generator unit disposed in a vicinity of said microphone so as to be opposed to an inner peripheral surface of said cylinder-shaped member, wherein the other end of said cylinder-shaped member is opposed to the earhole of the listener in a state that said audio reproducing means is mounted on the head of the listener, and wherein said corrected audio signals provided by said control means are supplied to said pair of sound generator units.

32. The audio reproducing apparatus according to claim 19, wherein said audio reproducing means comprises a head mount body which can be mounted on the head of the listener, a pair of sound generating units, and supporting means for supporting said pair of sound generating units on said head mount body at positions which are away from said both ears of the listener by a predetermined distance.

33. The audio reproducing apparatus according to claim 31, wherein said microphone is provided such that a diaphragm of said microphone is substantially parallel to an inner peripheral surface of said cylinder-shaped member.

34. The audio reproducing apparatus according to claim 31, wherein said cylinder-shaped member comprises a flexible portion.

35. The audio reproducing apparatus according to claim 31, wherein said reproduction characteristics include reflection characteristics and noise characteristics, after the reflection characteristics and the noise characteristics of said audio signal at the earhole of a listener are measured by said microphone, said adaptive processing filter generates inverse characteristics of the reflection characteristics and the noise characteristics at the earhole based on said measured results and corrects said corrected audio signals in said plurality of channels provided by said control means based on the inverse characteristics of the reflection characteristics and the noise characteristics.

36. The audio reproducing apparatus according to claim 34, wherein an adaptive processing FIR filter is employed as said adaptive processing filter.

37. The audio reproducing apparatus according to claim 35, wherein said adaptive processing filter sets a predetermined target value and corrects characteristics inherent in said audio reproducing means such that a value thereof becomes approximate to said target value.

38. The audio reproducing apparatus according to claim 35, wherein said adaptive processing filter sets a predetermined target value and carries out a correction by making a value approximate to said target value such that a sound field becomes approximate to a predetermined one.

39. The audio reproducing apparatus according to claim 35, wherein said adaptive processing filter is an indirect execution type filter which, after characteristics are measured based on an output from said microphone, carries out processing based on inverse characteristics thereof.

40. The audio reproducing apparatus according to claim 35, wherein said adaptive processing filter is a direct execution type filter which successively carries out measurements of characteristics based on an output from said microphone and processing based on inverse characteristics thereof.

41. A headphone comprising:

a mount portion which is substantially U-shaped and is mounted on a head of a listener;

detecting means provided at a position on said mount portion for detecting a head gyration of the listener;

a pair of sound generating units respectively provided at positions on said mount portion opposed, respectively, to both ears of the listener; and supporting means provided on said mount portion for supporting said respective pair of second generating units at positions away from said both ears of the listener at a predetermined distance in a state that said mount portion is mounted on the head of the listener, wherein said supporting means includes a substantially tubular member positioned parallel to a straight line passing through said both ears, a disk-shaped contact portion, and wherein said tubular member is fitted at one end to said mount portion and fitted at another end to said contact portion which is brought in contact with a head side portion around each respective ear of the listener.

* * * * *